US010799046B2

(12) United States Patent
Zhang et al.

(10) Patent No.: US 10,799,046 B2
(45) Date of Patent: Oct. 13, 2020

(54) VALVE ASSEMBLY FOR A LEAK RESISTANT DRINKING CUP

(71) Applicant: Handi-Craft Company, St. Louis, MO (US)

(72) Inventors: Xiangwen Zhang, Ellisville, MO (US); Douglas Hanneken, St. Louis, MO (US); Bernard J. Kemper, Bonne Terre, MO (US)

(73) Assignee: HANDI-CRAFT COMPANY, St. Louis, MO (US)

( * ) Notice: Subject to any disclaimer, the term of this patent is extended or adjusted under 35 U.S.C. 154(b) by 171 days.

(21) Appl. No.: 15/750,585

(22) PCT Filed: Aug. 5, 2016

(86) PCT No.: PCT/US2016/045699

§ 371 (c)(1),
(2) Date: Feb. 6, 2018

(87) PCT Pub. No.: WO2017/024200

PCT Pub. Date: Feb. 9, 2017

(65) Prior Publication Data

US 2019/0008297 A1 Jan. 10, 2019

Related U.S. Application Data

(60) Provisional application No. 62/201,713, filed on Aug. 6, 2015, provisional application No. 62/211,240, filed on Aug. 28, 2015.

(51) Int. Cl.
*A47G 19/22* (2006.01)
*A61J 9/04* (2006.01)
(Continued)

(52) U.S. Cl.
CPC ..... *A47G 19/2272* (2013.01); *A61J 9/04* (2013.01); *B65D 47/2031* (2013.01);
(Continued)

(58) Field of Classification Search
CPC ..... A47G 19/2272; A47G 21/18; A61J 9/04; A61J 11/0065; B65D 51/165; B65D 47/32; B65D 47/2031; B65D 2543/00046
See application file for complete search history.

(56) References Cited

U.S. PATENT DOCUMENTS 3,490,488 A * 1/1970 Grist ..... B65D 59/06 137/512.4
9,151,398 B2 * 10/2015 Wharton ..... F16K 15/14
(Continued)

FOREIGN PATENT DOCUMENTS

EP 0634922 B2 4/2008
WO 1999039617 8/1999
WO 2013163856 A1 11/2013

OTHER PUBLICATIONS

International Search Report and Written Opinion, dated Oct. 31, 2016 for International Application No. PCT/US2016/045699 filed Aug. 5, 2016.

*Primary Examiner* — Eric Keasel
(74) *Attorney, Agent, or Firm* — Armstrong Teasdale LLP

(57) ABSTRACT

A valve assembly for a leak resistant drinking cup includes a tubular plug having an outer wall, an inner wall, and a web extending between and connecting the outer and inner walls. The web has at least one slit disposed intermediate the inner and outer walls. The valve assembly is configurable between a sealed position wherein liquid is inhibited from passing through the slit and an unsealed position wherein liquid can pass through the slit.

18 Claims, 42 Drawing Sheets

(51) Int. Cl.

| | |
|---|---|
| ***B65D 47/20*** | (2006.01) |
| ***B65D 47/32*** | (2006.01) |
| ***B65D 51/16*** | (2006.01) |
| ***A61J 11/00*** | (2006.01) |
| ***A47G 21/18*** | (2006.01) |

(52) U.S. Cl.
CPC ..... *B65D 47/32* (2013.01); *B65D 51/165* (2013.01); *A47G 21/18* (2013.01); *A61J 11/0065* (2013.01); *B65D 2543/00046* (2013.01)

(56) References Cited

U.S. PATENT DOCUMENTS

| | | | | |
|---|---|---|---|---|
| 2002/0158075 | A1* | 10/2002 | Caldicott ..... | A47G 19/2272 220/714 |
| 2002/0179615 | A1 | 12/2002 | Hakim | |
| 2004/0035815 | A1 | 2/2004 | Webb | |
| 2005/0242204 | A1 | 11/2005 | Ness | |
| 2008/0128438 | A1 | 6/2008 | Lane | |
| 2009/0020544 | A1* | 1/2009 | Yuen ..... | A47G 19/2272 220/714 |
| 2014/0252012 | A1 | 9/2014 | Wharton | |
| 2016/0235229 | A1* | 8/2016 | LOhn ..... | A47G 19/2272 |
| 2020/0180854 | A1* | 6/2020 | Christiansen ..... | B65D 51/1638 |

* cited by examiner

VALVE ASSEMBLY FOR A LEAK RESISTANT DRINKING CUP

CROSS-REFERENCE TO RELATED APPLICATIONS

This application is a National Stage application of International Application No. PCT/US2016/045699, filed on Aug. 5, 2016, which claims priority to U.S. Provisional Patent Application Ser. No. 62/201,713 filed on Aug. 6, 2015, and to U.S. Provisional Patent Application Ser. No. 62/211,240 filed on Aug. 28, 2015, the disclosures of which are incorporated herein by reference in their entirety.

FIELD

The field of this disclosure relates generally to leak resistant drinking cups and more particularly to a leak resistant drinking cup having a valve assembly moveable between a sealed position and an unsealed position.

BACKGROUND

Leak resistant drinking cups are often adapted for use by young children (e.g., infants, toddlers, preschoolers). Usually, the cup includes a container defining an interior space for receiving and holding liquids therein. The container typically includes an open top and the cup often includes a relatively rigid cover for closing the open top of the container. A spout is typically formed as one-piece with the rigid cover for allowing a child to drink from the cup. The cover can be releasably attached (e.g., snapped or screwed on) to the container. These types of drinking cups are often configured so that when they are turned over, liquid inside the cup is inhibited from spilling out of the cup by a valve or valve assembly.

The valve or valve assembly is typically disposed between the cover and the container and can be configured from a sealed configuration to an unsealed configuration to allow liquid to pass out of the cup for drinking. Most commonly, the valve is actuated by a vacuum pressure applied by the user to the interior of the cup by sucking on the spout. The applied vacuum pressure causes the valve to move or otherwise deform in such a way (i.e., move toward the spout) that a path past the valve is exposed so liquid can flow out of the cup. It is possible that the valve might be actuated in other ways, such as a purely mechanical actuation. But for young children, vacuum pressure actuation is most preferable because the only time the valve is open is when the child is in the act of taking a drink.

Vacuum pressure actuated drinking cups of the type just described must balance the need to assure positive sealing with the need to make the cup easy to use for the child. A strong seal by the valve requires greater vacuum pressure to open, making it difficult for the child to use. A valve having a seal that requires a lower vacuum pressure to open may not seal sufficiently tight to prevent at least some liquid flowing past it, especially when dropped, swung, shaken, or impacted. Thus, valves having low vacuum pressure actuated seals are more prone to leak.

Frequently, conventional valves are relatively small and located under the spout. These types of valves often require a substantial vacuum pressure to actuate because the pressure acts on only a relatively small area of the valve. In other words, children have to suck with significant effort to get the valve to open and obtain a drink, which makes the cup less desirable to the child.

Often, the valve or valve assembly can be disassembled from the cover for cleaning. Some valves and valve assemblies are difficult to detach and reassemble as they require precise alignment or orientation of relatively small parts or parts with small tolerances. Moreover, small valves or pieces of a valve assembly may be easily lost or pose a danger to the child if the cup becomes disassembled.

There remains a need for a valve assembly and a leak resistant drinking cup with such a valve assembly that effectively inhibits liquid from leaking from the cup but can be readily actuated when subjected to vacuum pressure applied by a user.

BRIEF DESCRIPTION

In one aspect, a valve assembly for a leak resistant drinking cup generally comprising a tubular plug including an outer wall, an inner wall, and a web extending between and connecting the outer and inner walls. The web has at least one slit disposed intermediate the inner and outer walls. The valve assembly is configurable between a sealed position wherein liquid is inhibited from passing through the slit and an unsealed position wherein liquid can pass through the slit.

In another aspect, a valve assembly for a leak resistant drinking cup generally comprises a tubular plug including an outer wall, an inner wall, and a web extending between and connecting the outer and inner walls. The inner wall has an exterior surface area and an interior surface area. The interior surface area is greater than the exterior surface area. The web has at least one slit disposed between the inner and outer walls. The valve assembly is moveable between a sealed position wherein liquid is inhibited from passing through the slit and an unsealed position wherein liquid can pass through the slit.

In yet another aspect, a valve assembly for a leak resistant drinking cup generally comprises a platform and a circular tubular plug extending upward from the platform. The circular tubular plug includes an outer wall, an inner wall, and a web extending between and connecting the outer and inner walls. The inner wall has a concaved bottom with at least one vent slit therein. An elliptical tubular plug is spaced from the circular tubular plug and extends upward from the platform. The elliptical tubular plug includes an outer wall, an inner wall, and a web extending between and connecting the outer and inner walls. The inner wall has a closed bottom to define a recess. The web has at least one slit disposed between the inner and outer walls. The web is moveable between a first position wherein liquid is inhibited from passing through the slit and a second position wherein liquid can pass through the slit. The web is moveable from the first position to the second position by applying vacuum pressure to the inner wall.

In yet another aspect, a valve assembly for a leak resistant drinking cup generally comprises a tubular plug including an outer wall, an inner wall, and a web extending between and connecting the outer and inner walls. The web has at least one slit disposed intermediate the inner and outer walls. The inner wall has a bottom and the bottom has a vent slit disposed therein. The valve assembly is configurable between a sealed position wherein liquid is inhibited from passing through the slit in the web and an unsealed position wherein liquid can pass through the slit in the web.

In yet another aspect, a valve assembly for a leak resistant drinking cup generally comprises a first tubular plug including an outer wall, an inner wall, and a web extending between and connecting the outer and inner walls. The web has at least one slit disposed intermediate the inner and outer walls. The inner wall has a bottom and the bottom has a vent slit disposed therein. The valve assembly is configurable between a sealed position wherein liquid is inhibited from passing through the slit in the web and an unsealed position wherein liquid can pass through the slit in the web. A second tubular plug includes an outer wall, an inner wall, and a web extending between and connecting the outer and inner walls. The web has at least one slit disposed intermediate the inner and outer walls. The inner wall has a bottom and the bottom has a vent slit disposed therein. The valve assembly is configurable between a sealed position wherein liquid is inhibited from passing through the slit in the web and an unsealed position wherein liquid can pass through the slit in the web.

Another lid assembly for a leak resistant drinking cup generally comprises a valve assembly including a tubular plug having an outer wall, an inner wall, and a web extending between and connecting the outer and inner walls. The web has at least one slit disposed intermediate the inner and outer walls. The inner wall has a bottom and the bottom has a vent slit disposed therein. The valve assembly is configurable between a sealed position wherein liquid is inhibited from passing through the slit in the web and an unsealed position wherein liquid can pass through the slit in the web. A closure member has a liquid discharge opening and a socket circumscribes the liquid discharge opening. The socket is adapted to capture the tubular plug of the valve assembly.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
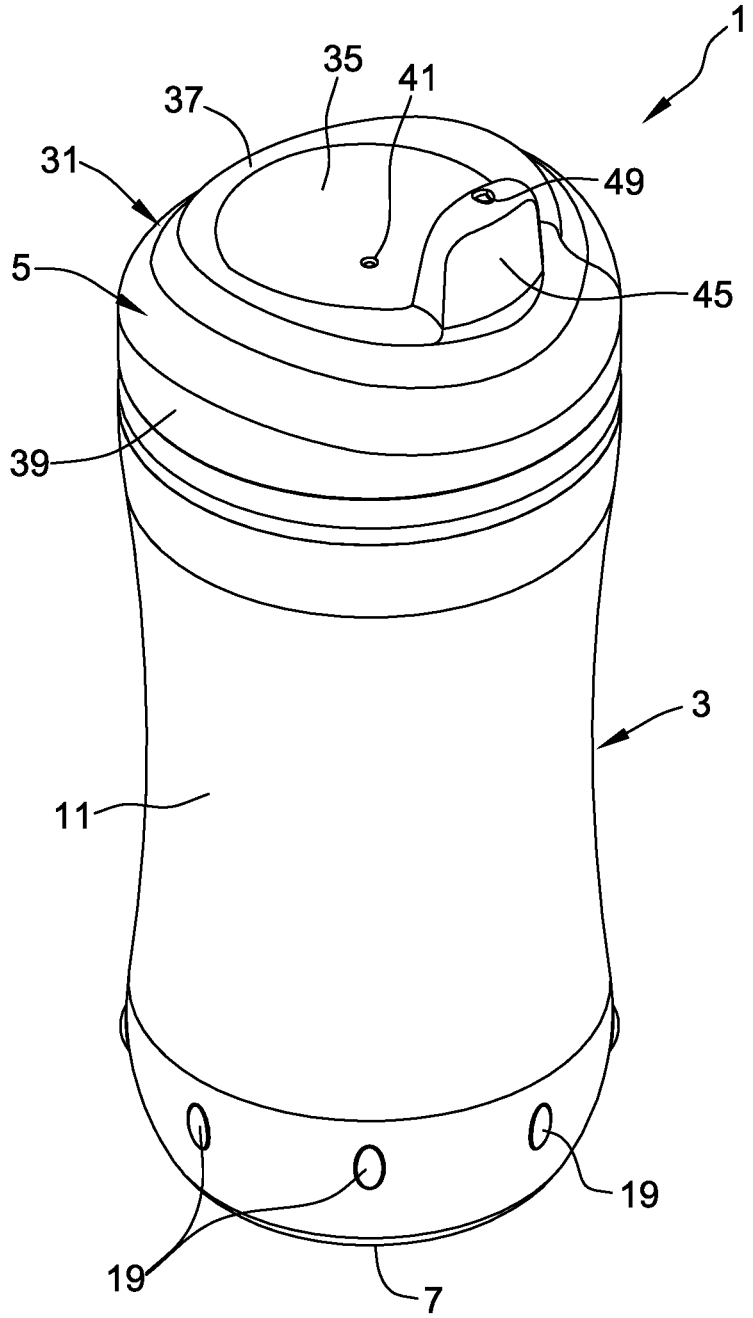
FIG. 1 is a perspective of one embodiment of a leak resistant drinking cup having a container and a lid assembly coupled to the container.
Figure 2:
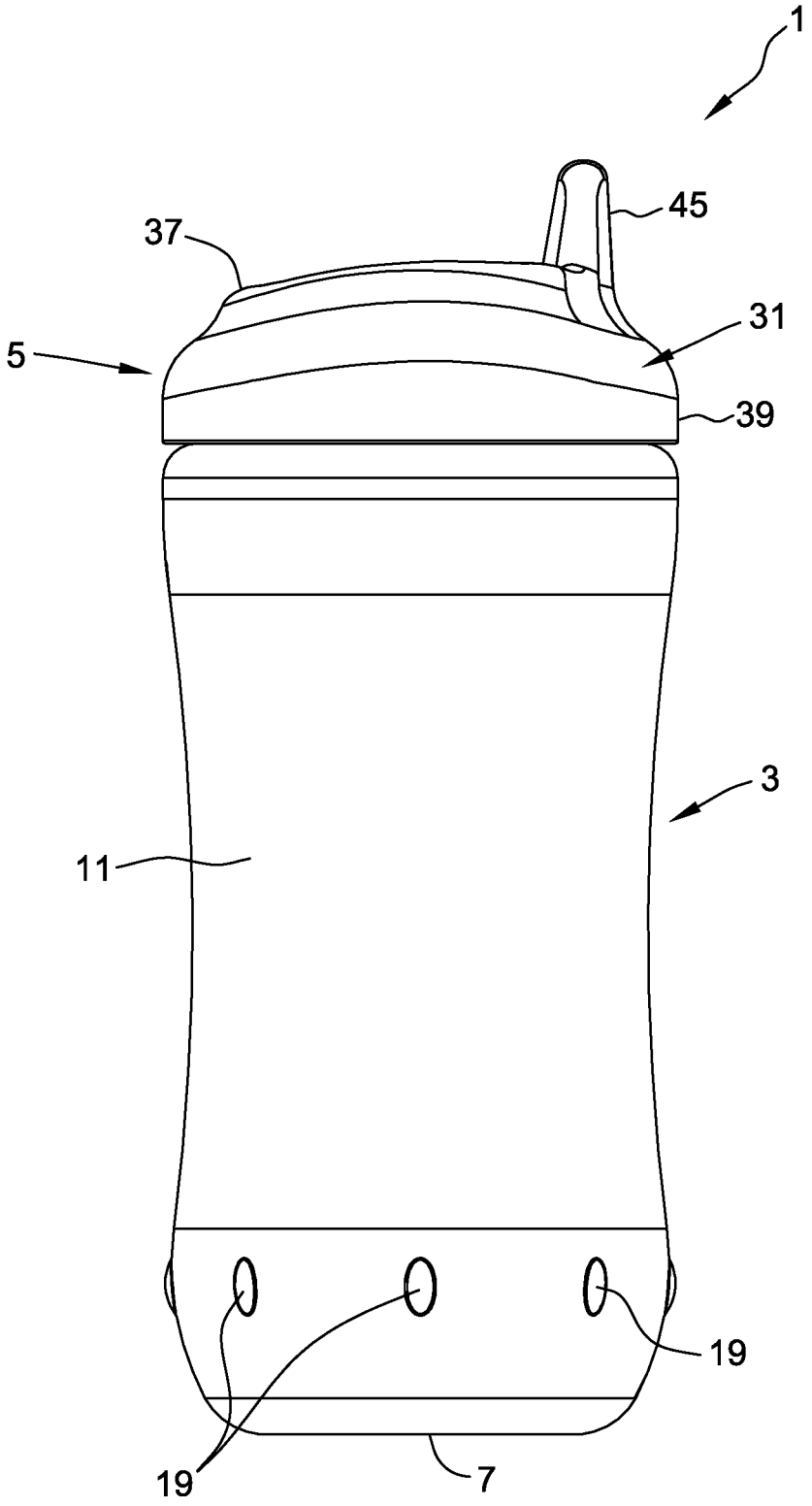
FIG. 2 is a side elevation of the cup.
Figure 3:
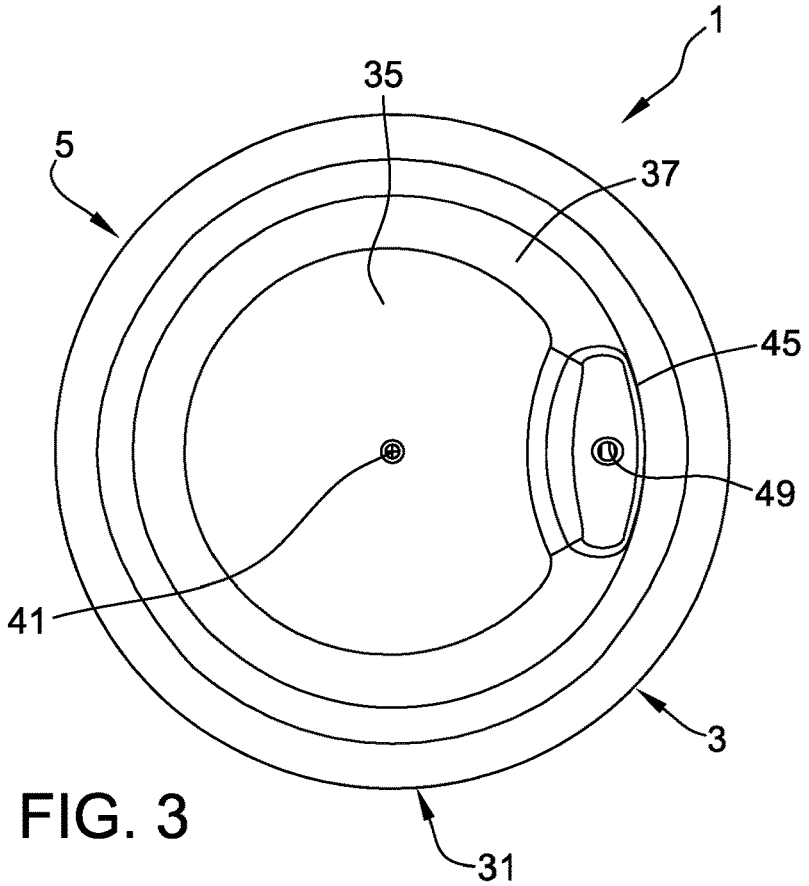
FIG. 3 is a top view of the cup.
Figure 4:
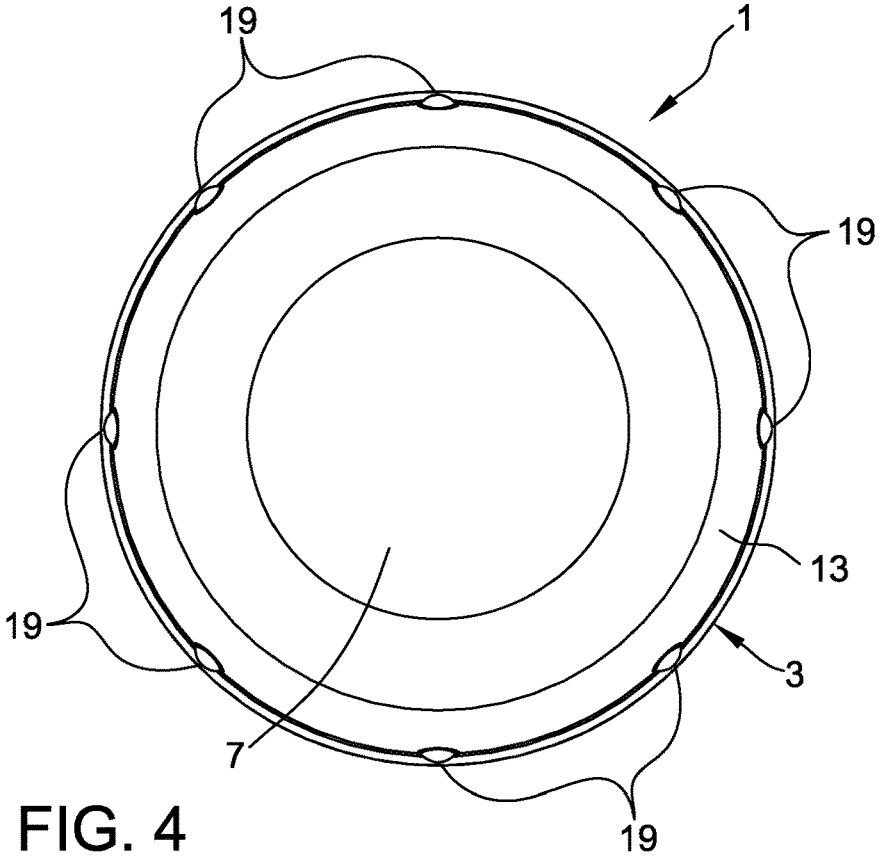
FIG. 4 is a bottom view of the cup.
Figure 5:
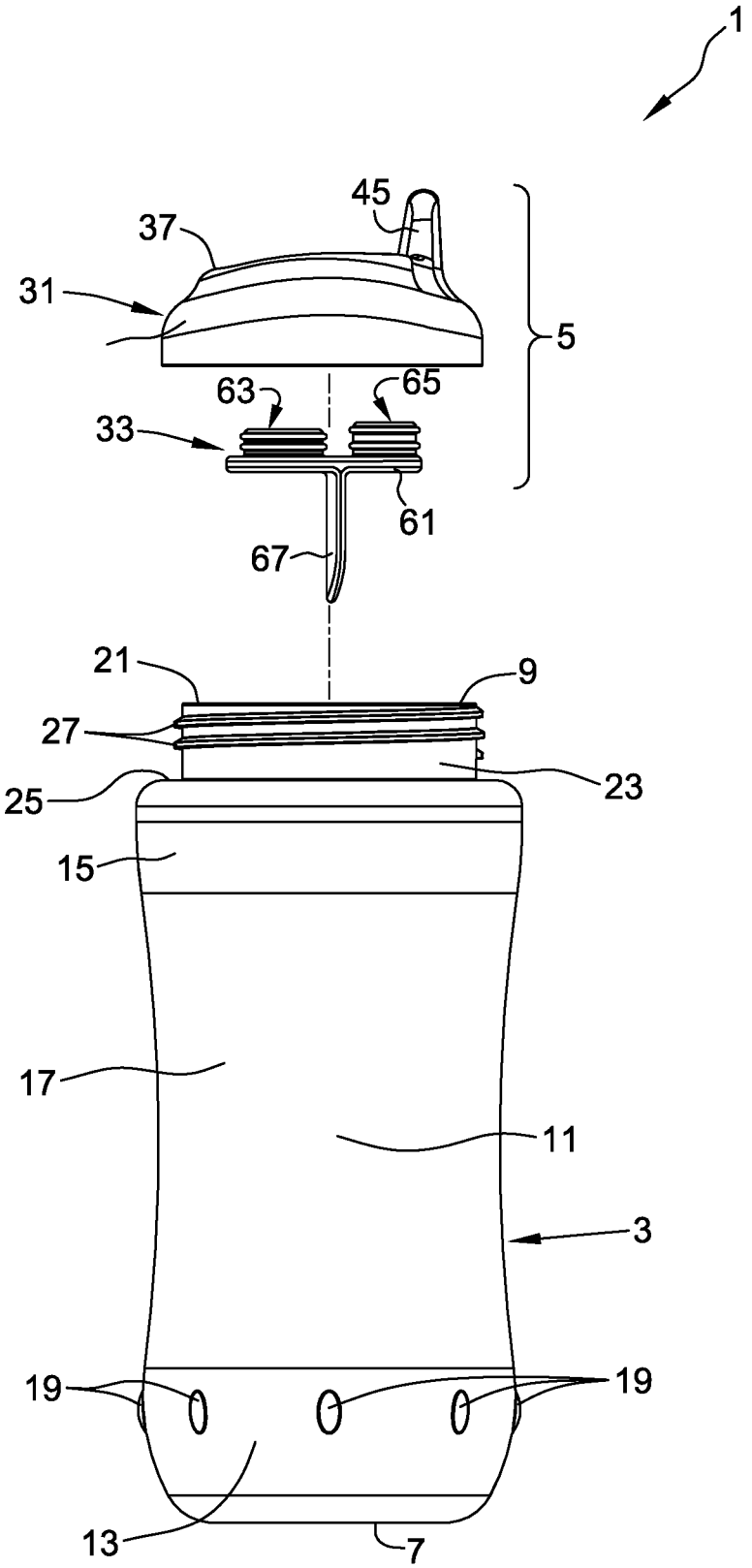
FIG. 5 is an exploded side view of the cup.
Figure 6:
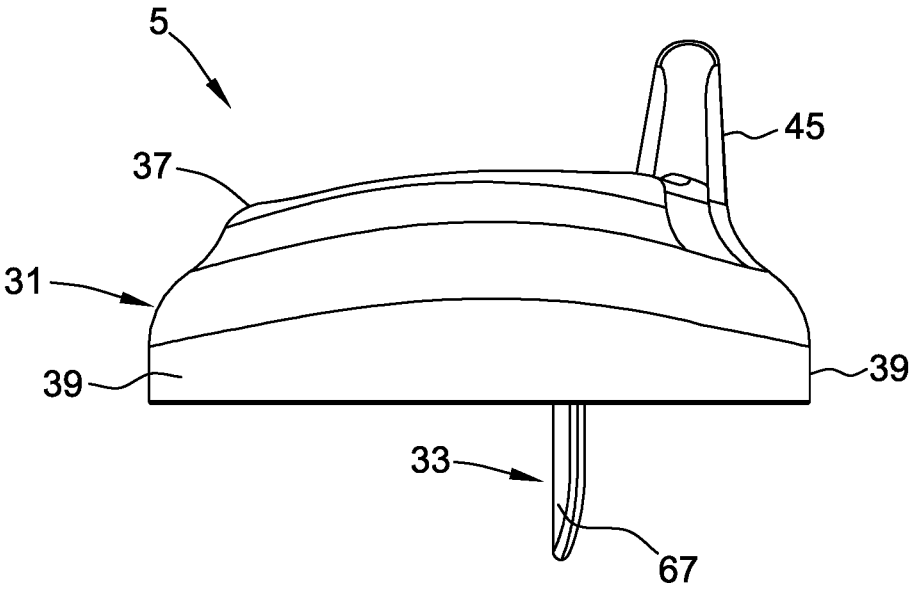
FIG. 6 is a side elevation of the lid assembly removed from the container, the lid assembly including a closure member and a valve assembly secured to the closure member.

Referring now to the drawings and in particular to FIGS. 1-5, a leak resistant drinking cup, generally indicated at 1, includes a container, which is generally indicated at 3, and a lid assembly, which is generally indicated at 5. The illustrated container 3 is generally cylindrical and symmetric about a central axis. As seen in FIGS. 4 and 5, the container 3 has a closed bottom 7, an open top 9, and a generally cylindrical side wall 11 extending between the closed bottom and the open top. The cylindrical side wall 11 includes a base portion 13, a top portion 15, and a concaved middle portion 17 extending between the base and top portions. The middle portion 17 of the side wall 11 of the illustrated container 3 is concaved to facilitate grasping of the container and thereby the cup 1. It is understood, however, that the middle portion 17 can be convex or generally straight. The base portion 13 of the side wall 11 has a plurality of circumferentially spaced-apart nubs 19. As illustrated in FIG. 5, the top portion 15 of the side wall 11 includes a circular upper edge 21, an attachment collar 23 disposed beneath and adjacent to the upper edge, and a shoulder 25 disposed below the attachment collar. The attachment collar 23 seen in FIG. 5 has external threads 27 thereon.

The illustrated container 3 has a liquid chamber adapted to hold a quantity of liquid for consumption by a user, such as a small child. More specifically, the illustrated container 3 is adapted to hold approximately 10 ounces of liquid. It is to be understood, however, that the cup 1 can be sized to hold other quantities of liquid (e.g., 6 ounces, 9 ounces, 12 ounces, 20 ounces, etc.). For example, the container 3 can be adapted for older children or adults and hold larger quantities of liquid. It is also understood that the container 3 can have a different configuration than the one illustrated herein, such as a sports bottle, a drink tumbler, a commuter cup, etc.

The container 3 can be made of any suitable material such as, without limitation, polypropylene, aluminum, or stainless steel. The container 3 can also be made in any desired color or colors, and may be transparent, translucent, opaque, or combinations thereof. The container 3 can be rigid, as illustrated in FIGS. 1-5, or non-rigid. It is further understood that the container 3 can be insulated or non-insulated. The container 3 illustrated in FIGS. 1-5, for example, is insulated having an inner container wall 11*a* and an outer container 11*b* wall that is spaced from the inner container wall (see, e.g., FIGS. 17 and 19). In other words, the container 3 is double walled for insulation purposes as is known in the art. It is contemplated that the container 3 can comprise a single, non-insulated wall.

Figure 7:
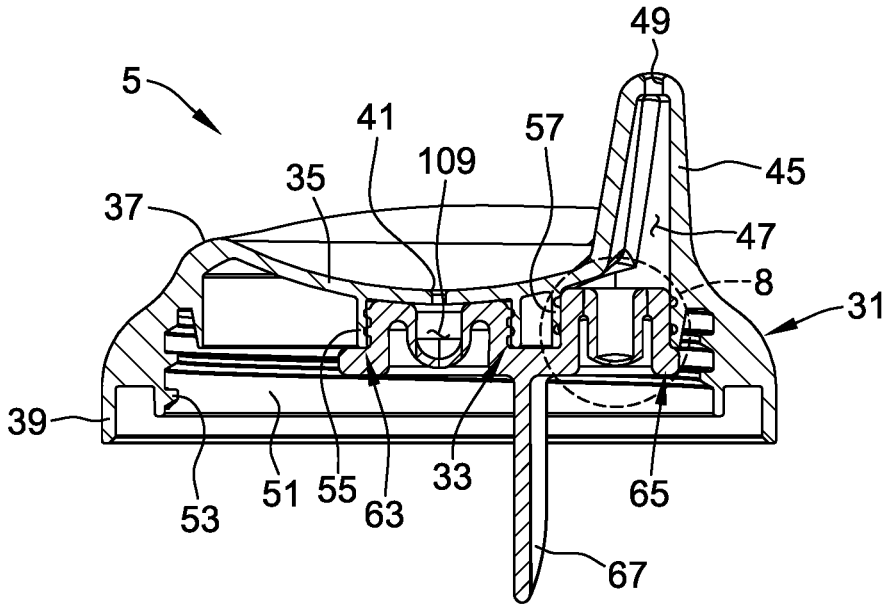
FIG. 7 is a vertical cross-section of the lid assembly illustrated in FIG. 6 illustrating the valve assembly secured to the closure member, the valve assembly being in a closed, sealed configuration.

The lid assembly 5 of the cup 1 is adapted for removable attachment to the container 3 for selectively closing the open top 9 of the container. The lid assembly 5, as illustrated in FIGS. 5 and 7, comprises a closure member 31 and a valve assembly 33 (each of the lid assembly components being indicated generally by their respective reference numbers). As described in more detail below, the valve assembly 33 is operable to block the flow of liquid from the liquid chamber of the container 3 to thereby inhibit liquid being spilled from the cup 1. As also described in more detail below, the valve assembly 33 can be deflected, flexed, or otherwise reconfigured by application of vacuum pressure applied by a user drinking from the cup 1 to permit liquid in the container 3 to flow past the valve assembly and out of the cup. In addition and as described in more detail below, the valve assembly 33 is further operable to block the flow of air into the liquid chamber of the container 3 but can be deflected, flexed, or otherwise reconfigured by application of vacuum pressure applied by a user drinking from the cup 1 to permit air to flow past the valve assembly and into the container. Thus, the valve assembly 33 disclosed herein defines a valve that regulates both the flow of liquid from the container 3 and the flow of air into the container.

The closure member 31 and the valve assembly 33 can be made of any suitable materials. In one suitable embodiment, for example, the closure member 31 can be made of polypropylene and the valve assembly 33 can be made of silicone. The closure member 31 and the valve assembly 33 can be made in any desired color or colors, and may be transparent, translucent, opaque, or combinations thereof.

The cup 1 can optionally include a cap (not shown) that is removeably securable to the closure member 31 via a snap-fit (or any suitable) connection. The cap can be selectively placed on the closure member 31 during periods of non-use (e.g., storage, travel) of the cup 1 and removed during periods of use. The cap can be made of any suitable material, such as polypropylene, and can be made in any desired color or colors, and may be transparent, translucent, or opaque. One suitable cap for use with the cup 1 described herein is disclosed in U.S. Pat. No. 8,333,299 to Bernard J. Kemper et al., which is incorporated herein in its entirety.

The illustrated cup 1 can also optionally include a handle assembly (not shown) for grasping by the user of the cup. One suitable handle assembly for use with the cup 1 described herein is disclosed in U.S. Pat. No. 8,333,299 to Bernard J. Kemper et al., which is incorporated herein in its entirety.

With reference now to FIGS. 1-3, 6, and 7, the closure member 31 of the lid assembly 5 includes a concaved, central upper portion 35, an annular ridge 37 circumscribing and extending upward from the central upper portion, and a peripheral skirt 39 depending downward from the annular ridge. The upper portion 35 includes a relatively small, circular vent aperture 41 generally in its center (e.g., at the nadir of the concaved upper portion as illustrated in FIG. 7). The vent aperture 41 allows air to pass through the closure member 31 when the closure member is attached to the container 3. The closure member 31 further comprises a spout 45 (broadly, a "liquid discharge member") projecting up from the annular ridge 37. The spout 45 includes a passageway 47 (FIG. 7) and an opening 49 fluidly connected to the passageway for allowing liquid to exit (or discharge) the drinking cup 1. It is understood that the liquid discharge member can be other than a spout, e.g., an elliptical opening or a straw, without departing from the scope of this disclosure. It is also understood that, in other suitable embodiments, the spout 45 (or liquid discharge member) can be formed separately from the closure member 31.

Figure 9:
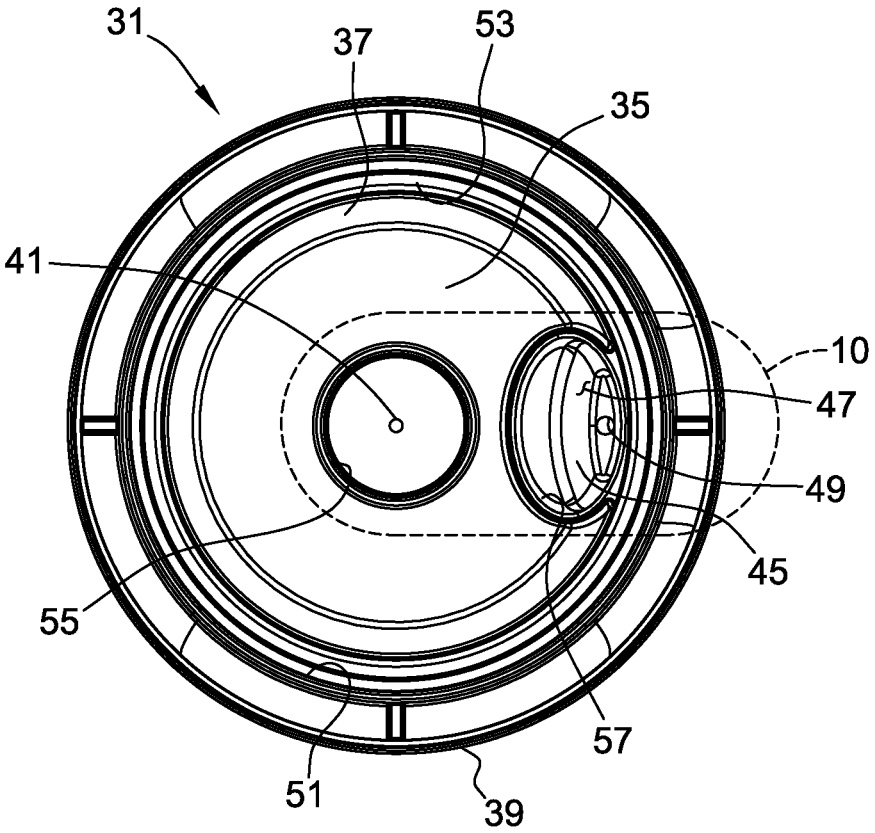
FIG. 9 is a bottom view of the closure member having the valve assembly removed therefrom.

As illustrated in FIGS. 7 and 9, the closure member 31 has an inner socket 51 defined by the peripheral skirt 39. The inner socket 51 includes internal threads 53 for releasably mating with the external threads 27 of the attachment collar 23 of the container 3. Thus, the closure member 31 can be selectively attached and detached from the container 3 via the threaded connection between the internal threads 53 of the inner socket 51 and the external threads 27 of the attachment collar 23. It is understood, however, that the closure member 31 can be selectively attached and detached from the container 3 using any suitable connection (e.g., snap-fit).

Figure 10:
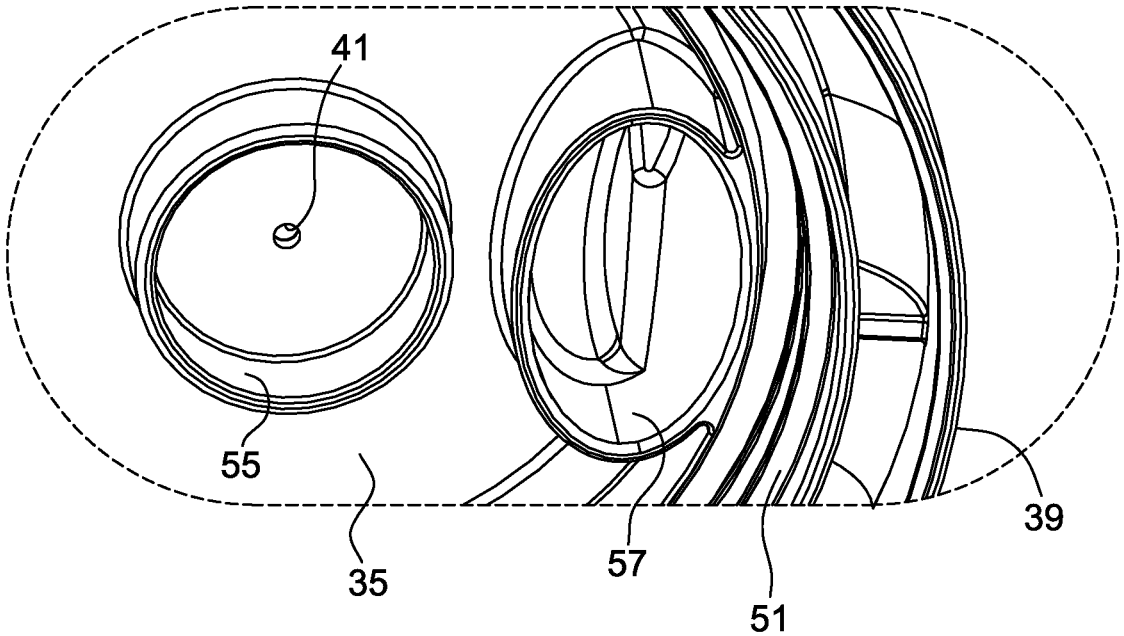
FIG. 10 is an enlargement of the encircled portion of FIG. 9.

The closure member 31, as illustrated in FIGS. 7-10, also includes an interior, annular socket 55 extending downward from the central upper portion 35 and circumscribing the vent aperture 41. As best seen in FIG. 9, the vent aperture 41 in the upper portion 35 is centered relative to the annular socket 55. An elliptical socket 57 is disposed adjacent but spaced from the annular socket 55. As best seen in FIGS. 9 and 10, the elliptical socket 57 is fluidly connected with the passageway 47 of the spout 45. In the illustrated embodiment, the passageway 47 of the spout 45 is aligned with approximately half of the elliptical socket 57 (see, e.g., FIG. 9). It is understood, however, that the passageway 47 of the spout 45 can be aligned with more or less of the elliptical socket 57 including its entirety.

It is noted that the annular socket 55 and the elliptical socket 57 are shaped differently (i.e., circular as compared to elliptical) in the illustrated embodiment. The annular socket 55 and the elliptical socket 57 are shaped different from each other to facilitate attachment of the valve assembly 33 to the closure member 31 in the correct orientation. It is understood, however, that the sockets 55, 57 can have the same shape (e.g., both be circular, both be elliptical) without departing from the scope of this disclosure. It is also understood that the sockets 55, 57 can have any suitable shape.

Figure 11:
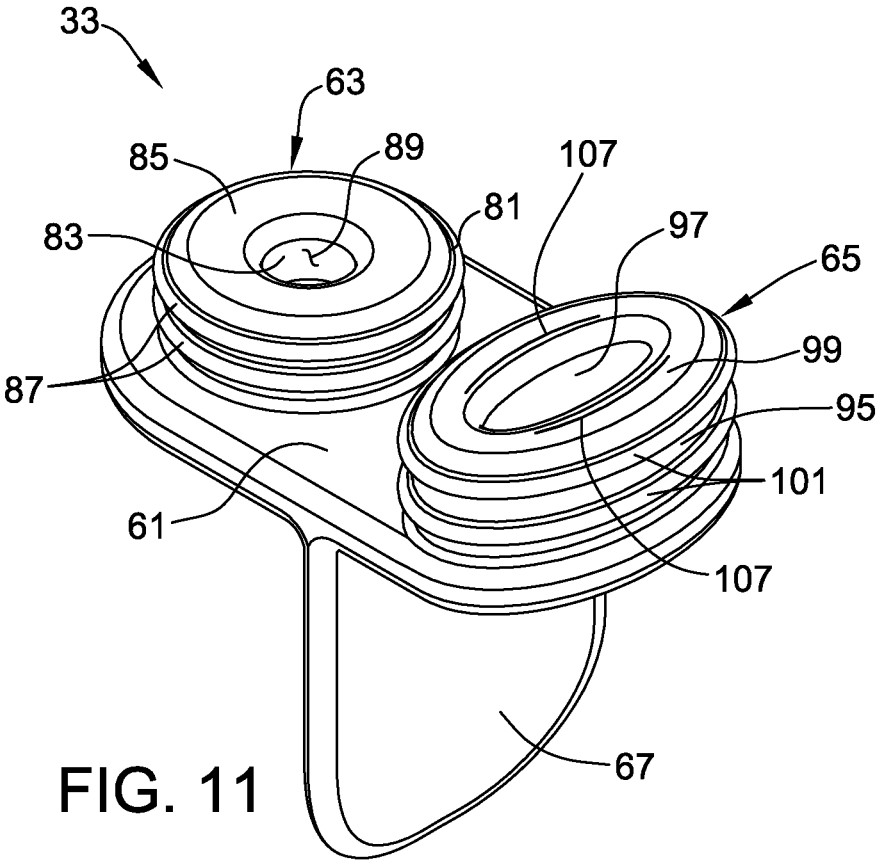
FIG. 11 is a perspective of the valve assembly of the lid assembly removed from the closure member.
Figure 12:
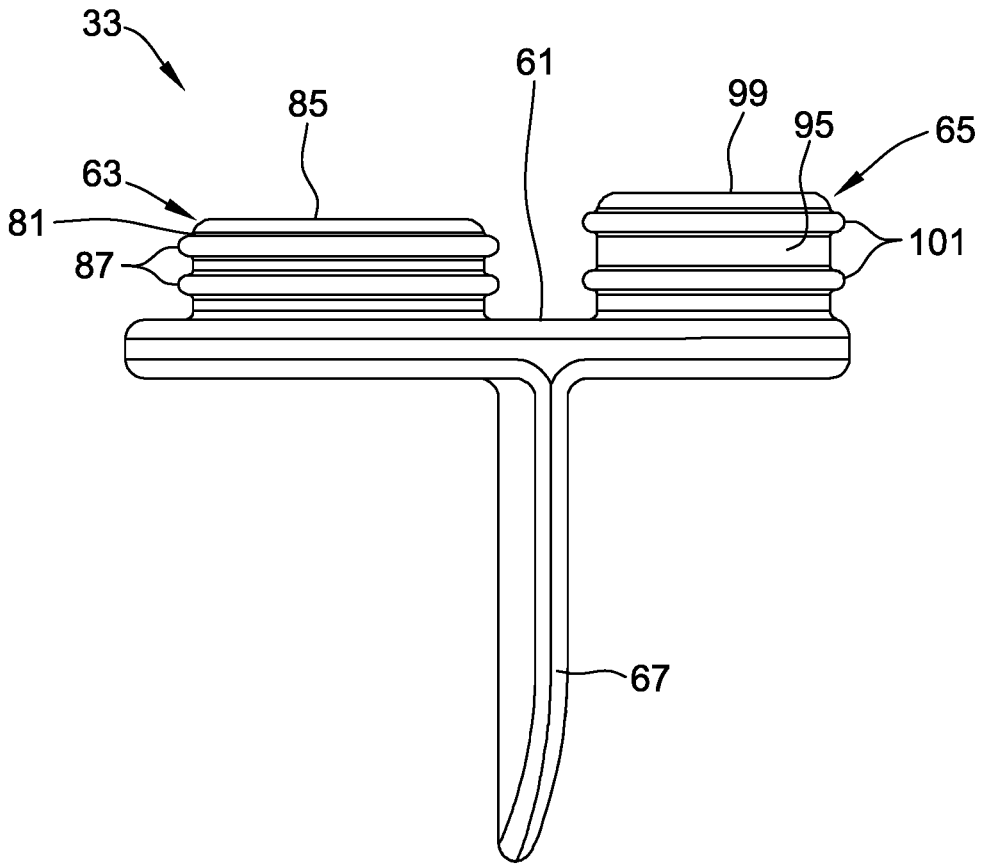
FIG. 12 is a side elevation of the valve assembly.
Figure 13:
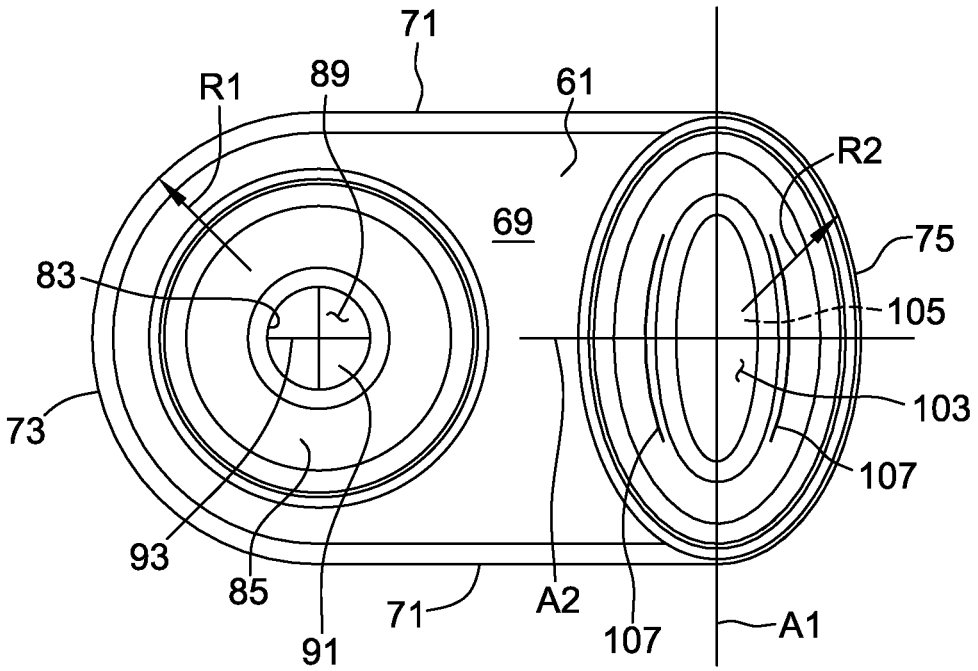
FIG. 13 is a top view of the valve assembly.
Figure 14:
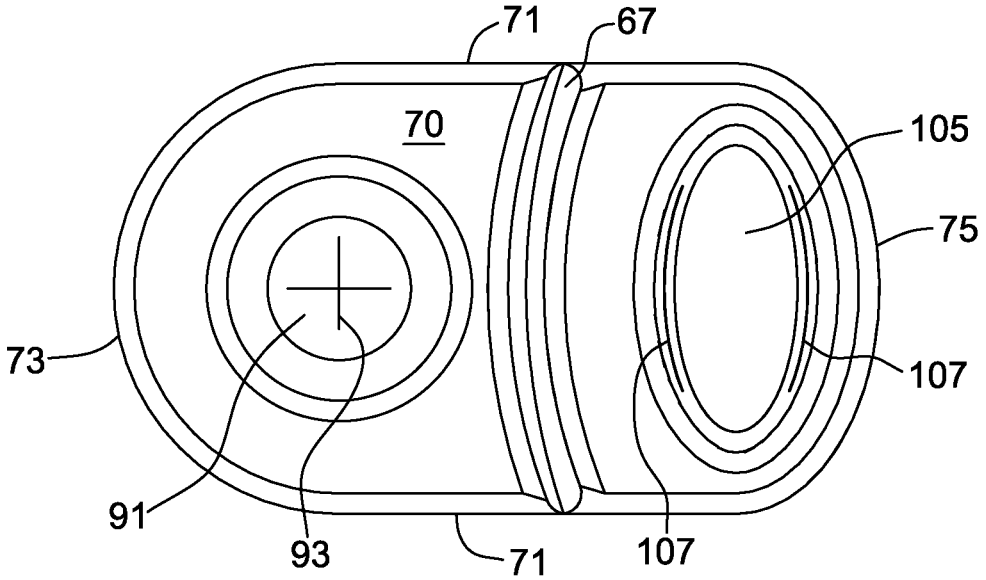
FIG. 14 is a bottom view of the valve assembly.

As illustrated in FIGS. 11-16, the valve assembly 33 includes a generally ovate platform 61, a circular tubular plug, indicated generally at 63, adapted for insertion into the annular socket 55 of the closure member 31, an elliptical tubular plug 65 adapted for insertion into the elliptical socket 57 in the closure member, and a tab 67 projecting from the platform for gripping by a user. As best seen in FIGS. 13 and 14, the ovate platform 61 includes an upper planer surface 69, a lower planer surface 70, two generally parallel side edges 71, a first end edge 73, and a second end edge 75 spaced from the first end edge. The first end edge 73, which generally defines a semicircle, has a constant radius R1 about its circumference. The second end edge 75, however, is a curved edge with a non-constant radius R2. That is, as the second end edge 75 extends between the side edges 71, the radius R2 changes such that the second end edge generally defines half an ellipse. It is understood, however, that the platform 61 can have any suitable shape (e.g., elliptical, rectangular).

With reference now to FIGS. 11-15, the circular tubular plug 63 of the valve assembly 33 includes an outer wall 81, an inner wall 83, and a web 85 extending between and connecting the outer and inner walls. The outer wall 81 of the circular tubular plug 63 includes a pair of spaced-apart ribs 87 that circumscribe the outer wall. As best seen in FIG. 13, the annular web 85 is disk-shaped and defines the upwardly facing surface of the circular tubular plug 63. With reference now to FIGS. 13 and 14, the inner wall 83 defines a recess 89 having a concaved bottom 91. More specifically, in the illustrated embodiment, the bottom 91 of the inner wall 83 is a hollowed hemisphere. As illustrated in FIGS. 13 and 14, the concaved bottom 91 of the inner wall 83 has a cruciform vent slit 93 defined by two elongate slits of approximately equal length crossing at their center. It is understood, however, that the vent slit 93 can have any suitable configuration including being defined by a single elongate slit.

With reference still to FIGS. 11-15, the elliptical tubular plug 65 of the valve assembly 33 includes an outer wall 95, an inner wall 97, and a web 99 extending between and connecting the outer and inner walls. The outer wall 95 of the elliptical tubular plug 65 includes a pair of spaced-apart ribs 101 that circumscribe the outer wall. With reference now to FIGS. 13 and 14, the inner wall 97 defines a recess 103 having a closed, concaved bottom 105. As best seen in FIG. 13, the web 99 is non-circular, and more suitably, generally racetrack-shaped (e.g., elliptical, ovate) and defines the upwardly facing surface of the elliptical tubular plug 65. The web 99, as explained in more detail below, includes a pair of slits 107 disposed in the web spaced intermediate the outer and inner walls 95, 97 and extend through the thickness of the web. In the illustrated embodiment, the slits 107 are generally arcuate (e.g., nonlinear) and follow approximately the same curvature as the inner and outer walls 95, 97. It is contemplated that the web 99 can have fewer slits 107 (i.e., a single slit) or more than two slits without departing from some aspects of this disclosure.

Figure 15:
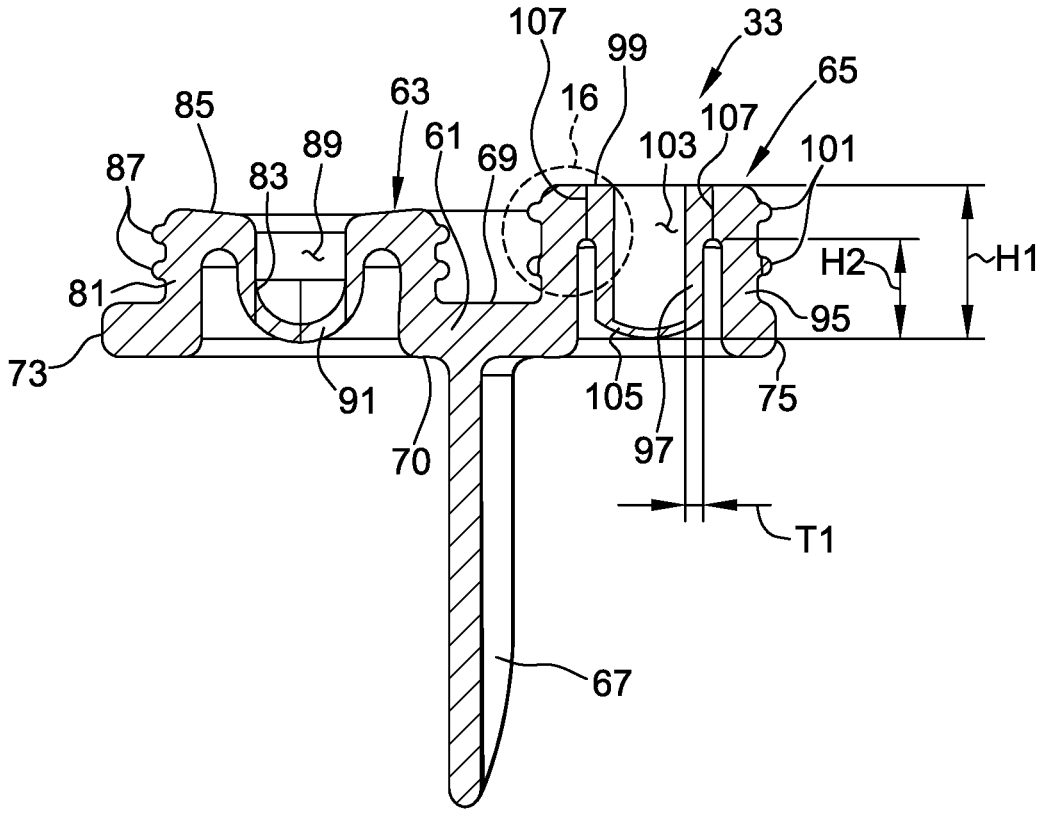
FIG. 15 is a vertical cross-section taken from the side elevation of FIG. 12.
Figure 16:
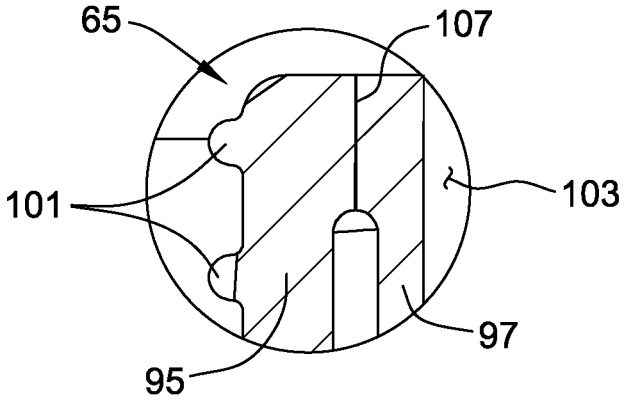
FIG. 16 is an enlargement of the encircled portion of FIG. 15.

With reference to FIG. 15, the inner wall 97 has an interior height H1 that is defined by the interior surface of the inner wall and an exterior height H2 that is defined by the exterior surface of the inner wall. The interior height H1 of the inner wall is greater than the exterior height H2 of the inner wall. For example, in one embodiment, the interior height H1 is between 1 mm and 100 mm, more preferably between 3 mm and 25 mm, and even more preferably between 5 mm and 15 mm, and the exterior height H2 is between 1 mm and 100 mm, more preferably between 3 mm and 25 mm, and even more preferably between 5 mm and 10 mm. In the illustrated embodiment, for example, the interior height H1 is approximately 9.55 mm, and the exterior height H2 is approximately 6.55 mm.

As a result, the surface area of the interior surface of the inner wall 97 is greater than the surface area of the exterior surface of the inner wall. In the illustrated embodiment, for example, the surface area of the interior surface of the inner wall 97 is approximately 206.5 square millimeters (0.32 square inches), and the surface area of the exterior surface of the inner wall is approximately 132.6 square millimeters (0.21 square inches). In one suitable embodiment, the ratio between the surface area of the interior surface and the exterior surface of the inner wall 97 is between 1 and 10. Suitably, the ratio is greater than 1 and less than 10. More preferably, the ratio between the surface area of the interior surface and the exterior surface of the inner wall 97 is between 1.2 and 5 and, even more preferably, between 1.4 and 2. In the illustrated embodiment, for example, the ratio between the surface area of the interior surface and the exterior surface is approximately 1.55.

Suitably, a ratio between the interior surface area of the inner wall 97 and its cross sectional area comprising thickness T1 of the inner wall is between 1 and 50 wherein the thickness T1 is taken above the bottom 105 and below the web 99. Suitably, the ratio is greater than 1 and less than 50. More suitably, the ratio between the interior surface of the inner wall 97 and its cross sectional area comprising thickness T1 of the inner wall is between 2 and 20 and, ever more suitably, between 5 and 10.

With reference to FIG. 13, the elliptical tubular plug 65 has a major axis A1 and a minor axis A2. As a result, the maximum extent of the elliptical tubular plug 65 along the major axis A1 is greater than the maximum extent of the elliptical tubular plug along the minor axis A2. For example, in one suitable embodiment, the major axis A1 can be between 6 mm and 133 mm, more preferably between 16 mm and 66 mm, and even more preferably between 20 mm and 26 mm, and the minor axis A2 can be between 4 mm and 107 mm, more preferably between 13 mm and 53 mm, and even more preferably between 16 mm and 21 mm. Suitably, the ratio between the major axis A1 and the minor axis A2 is between 1 and 10, more preferably between 1.2 and 5, and even more preferably between 1.5 and 2.

The grip tab 67, as illustrated in FIGS. 11 and 12, extends downward from the lower planer surface 70 of the platform 61 and provides a grip to facilitate removal of the circular tubular plug 63 and the elliptical tubular plug 65 of the valve assembly 33 from the annular socket 55 and the elliptical socket 57 of the closure member 31. In the illustrated embodiment, the grip tab 67 extends substantially the entire distance between the two side edges 71 of the platform 61 along an arcuate pathway. It is contemplated, however, that the grip tab 67 can have any suitable width and any suitable shape.

As seen in FIG. 7, the closure member 31 and the valve assembly 33 cooperatively define a vent chamber 109 and a suction chamber 111. More specifically with respect to the vent chamber 109, the concaved upper portion 35 of the closure member 31 and the inner wall 83 of the circular tubular plug 63 cooperatively define the vent chamber when the valve assembly 33 is connected to the closure member. In the illustrated embodiment, the volume of the vent chamber 109 is approximately equal to the volume of the recess 89 defined by the inner wall 83 of the circular tubular plug 63 but it is understood that the vent chamber 109 and recess 89 can have different volumes. The aperture 41 in the upper portion 35 of the closure member 31 is in fluid communication with the vent chamber 109 for maintaining the vent chamber generally at ambient pressure. The web 85 of the circular tubular plug 63 of the valve assembly 33 engages, in face-to-face relationship, the bottom surface of the upper portion 35 of the closure member 31 to form a seal between the vent chamber 109 and the liquid chamber of the container 3.

With respect to the suction chamber 111, the passageway 47 in the spout 45 of the closure member 31 and the inner wall 97 of the elliptical tubular plug 65 cooperatively define the suction chamber when the valve assembly 33 is connected to the closure member (FIG. 7). In the illustrated embodiment, the volume of the suction chamber 111 is approximately equal to the volume of the recess 103 defined by the inner wall 97 of the elliptical tubular plug 65. The opening 49 in the spout 45 of the closure member 31 is in fluid communication with the suction chamber 111 for allowing a user to apply a suction (i.e., vacuum) pressure to the suction chamber by sucking on the spout. The outer wall 95 of the elliptical tubular plug 65 and the associated ribs 101 engage the inner surface of the elliptical socket 57 of the closure member to form a seal between the suction chamber 111 and the liquid chamber of the container 3.

Figure 8:
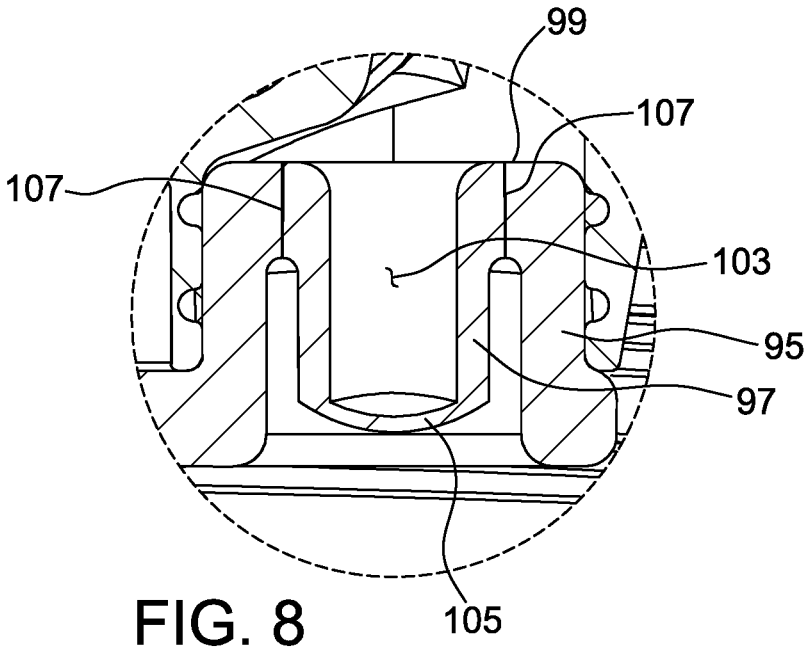
FIG. 8 is an enlarged fragmentary view of the cross-section illustrated in FIG. 7 taken from area "8" of FIG. 7.
Figure 17:
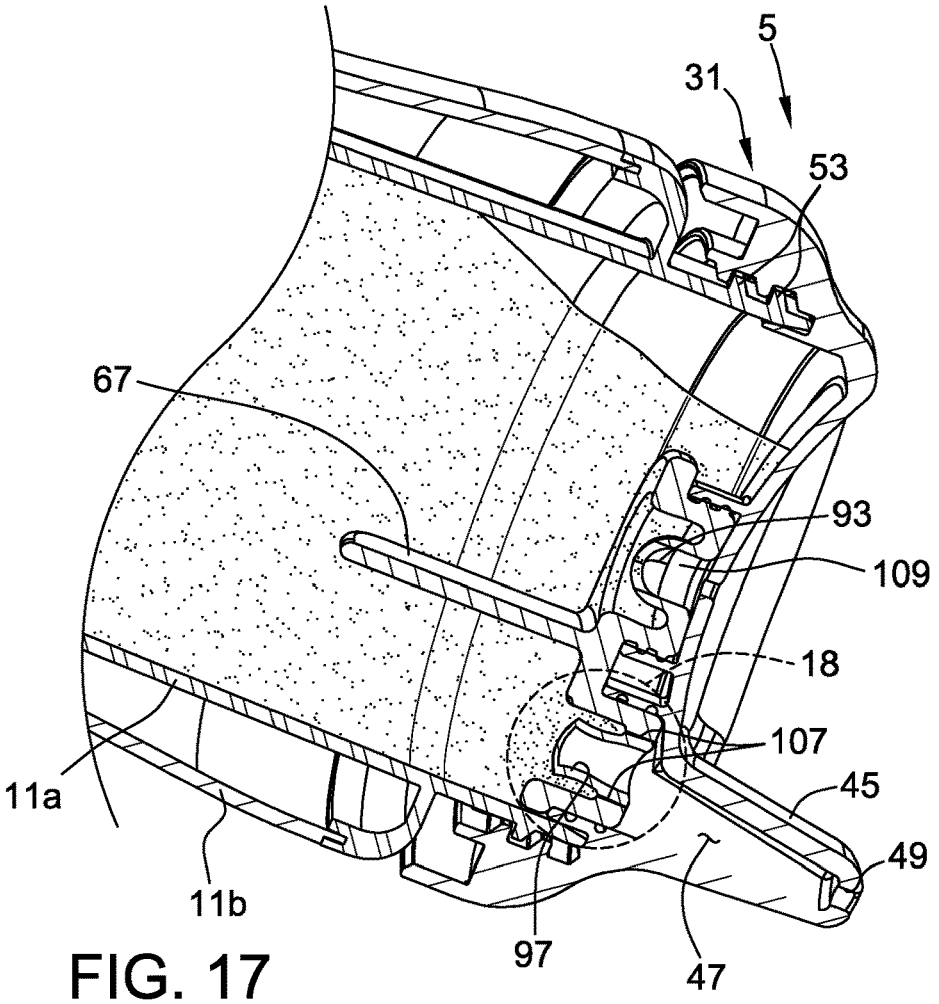
FIG. 17 is a fragmented, enlarged vertical cross-section of the leak resistant drinking cup, the cup being seen in a tilted, drinking position, the valve assembly being in the closed, sealed configuration thereby inhibiting liquid from exiting the cup.
Figure 18:
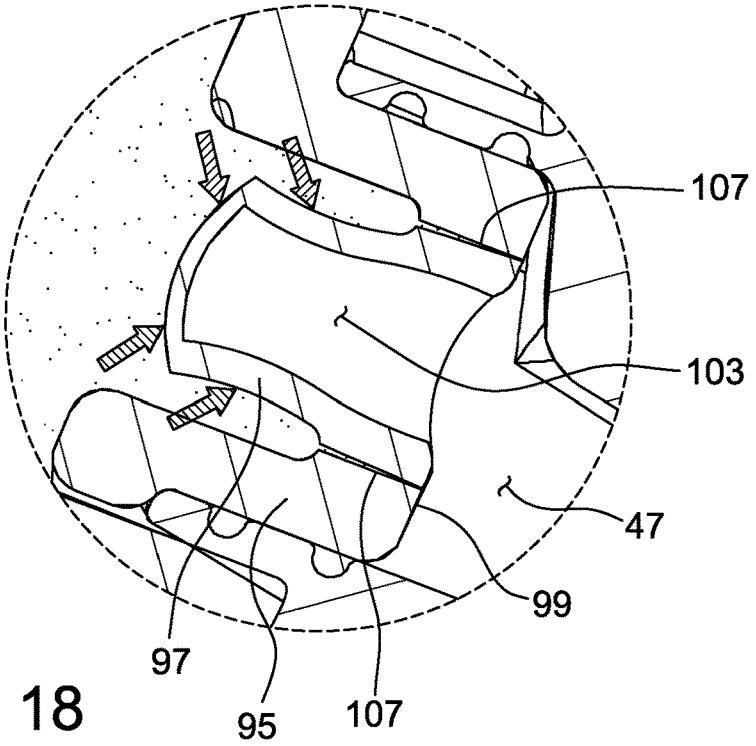
FIG. 18 is an enlarged fragmentary view of the cross-section illustrated in FIG. 17 taken from area "18" of FIG. 17.
Figure 19:
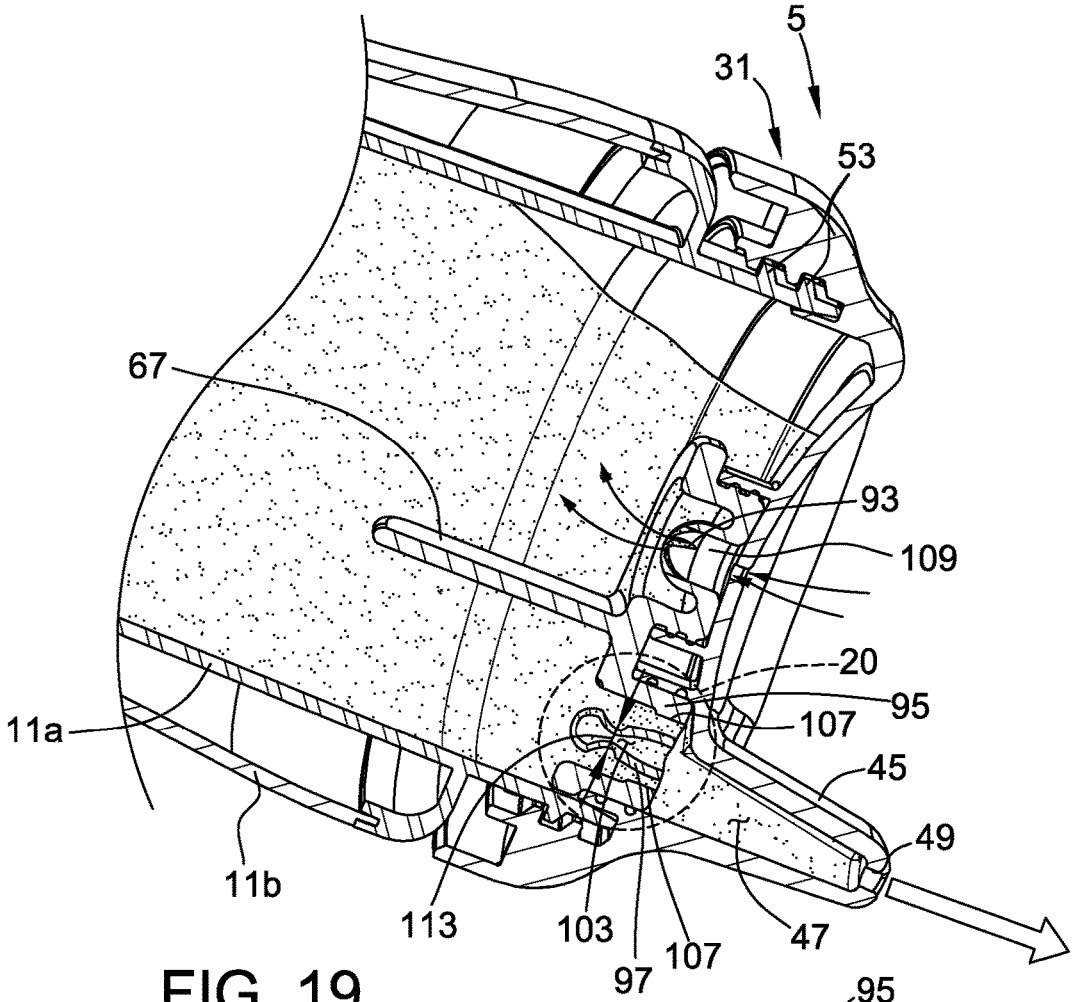
FIG. 19 is a fragmented, enlarged vertical cross-section similar to FIG. 17 but showing the valve assembly in an opened, unsealed configuration thereby allowing liquid to exit the cup.
Figure 20:
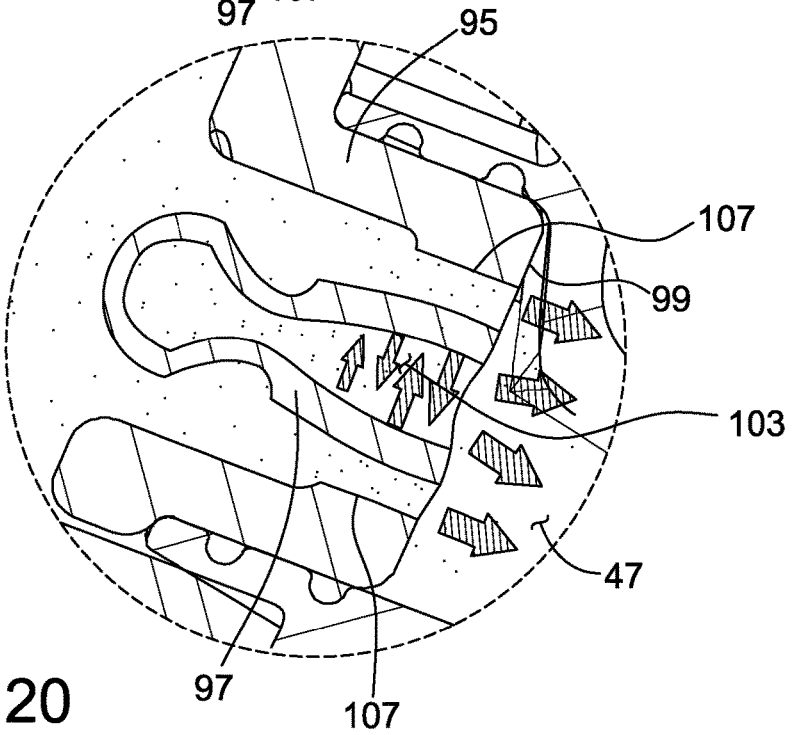
FIG. 20 is an enlarged fragmentary view of the cross-section illustrated in FIG. 19 taken from area "20" of FIG. 19.

Referring now to FIGS. 17 and 19, it is relatively easy for a small child (and more generally "a user") to drink from the drinking cup 1 by placing her lips around the spout 45 so as to form a seal with the spout, tilting the cup so that liquid in the container 3 flows into contact with the elliptical tubular plug 65, and sucking on the spout. Sucking on the spout 45 removes air from the suction chamber 111 through the opening 49 in the spout and thereby applies vacuum pressure to the inner wall 97 of the elliptical tubular plug 65. Upon a threshold vacuum being applied to the inner wall 97, the inner wall flexes inward, which moves the valve assembly 33 from a sealed, closed configuration (FIGS. 7, 8, 17 and 18), which inhibits liquid from passing through the slits 107 in the web 99, to an unsealed, opened configuration, which allows liquid to pass through the slits (FIGS. 19 and 20). FIG. 8 is an enlarged fragmentary view of the cross-section illustrated in FIG. 7 wherein the valve assembly 33 is in the sealed, closed configuration and not being acted upon in any manner. In other words, the valve assembly 33 is in its initial, rest state. As seen therein, neither the outer wall 95 nor inner wall 97 are deformed in anyway. FIG. 18 is an enlarged fragmentary view of the cross-section illustrated in FIG. 17 wherein the valve assembly 33 is in the sealed, closed configuration but with liquid acting on the exterior surface of the inner wall 97 as indicated by arrows. As seen therein, the inner wall 97 is deformed (e.g., bowed slightly inward between the web 99 and the closed bottom 105) by liquid acting on the exterior surface thereof. The inner wall 97 can be similarly deformed by the container 3 containing a warm liquid and/or a carbonated liquid.

Vacuum pressure applied by the user to the elliptical tubular plug 65 at or below (i.e., greater vacuum) the threshold vacuum causes at least a portion of the elliptical tubular plug 65 to flex inward toward the major axis A1 of the elliptical tubular plug. More specifically and as illustrated in FIGS. 19 and 20, vacuum pressure acting on the interior surface of the inner wall 97 causes the inner wall 97 to flex inward toward the major axis A1 of the elliptical tubular plug as indicated by arrows in FIG. 20. Once the inner wall 97 is flexed (or otherwise moved or deformed) a sufficient amount, the slits 107 in the web 99 are altered to define a pathway therethough and allow liquid to pass the valve assembly 33 as also indicated by arrows in FIG. 20. Thus, the user applying vacuum to the spout 45 at or above the threshold vacuum permits liquid to flow past the valve assembly 33 through the slits 107 and into the passageway 47 of the spout 45. Once in the passageway 47, the liquid flows out through the opening 49 and into the user's mouth for drinking.

The amount of vacuum pressure (applied by the user sucking on the spout 45) needed to configure the valve assembly 33 from its sealed (or closed) configuration to its unsealed (or opened) configuration can be predetermined by varying the surface area of the interior surface of the inner wall 97 and/or the thickness T2 of the inner wall of the elliptical tubular plug 65. Suitably, the amount of vacuum pressure needed to move the valve assembly 33 between its sealed and unsealed position is less than 5 inches of mercury. In one suitable embodiment, the amount of vacuum pressure needed to move the valve assembly 33 between its sealed and unsealed position is between 2 inches of mercury and 5 inches of mercury. In the illustrated embodiment, for example, the amount of vacuum pressure needed to move the valve assembly 33 between its sealed and unsealed position is about 3 inches of mercury.

Once the user stops applying a vacuum pressure to the spout 45, the resiliency (e.g., elasticity) of the valve assembly 33 causes the valve assembly to move from the unsealed position back to the sealed position. More specifically, terminating the vacuum pressure applied to the inner wall 97 of the elliptical tubular plug 65 results in the inner wall moving away from the major axis A1 of the elliptical tubular plug and toward its prior position (shown in FIGS. 17 and 18). As the inner wall 97 moves back to its prior position, the slits 107 in the web 99 are altered to close the pathway therethough and inhibit liquid from passing the valve assembly 33. Thus, the user by stopping to apply vacuum to the spout 45 at or above the threshold vacuum causes the valve assembly 33 to return to its closed, sealed position and inhibits liquid from flowing past the valve assembly 33 through the slits 107 and into the passageway 47 of the spout 45.

As liquid is drawn out of the container 3 by the child, the pressure within the liquid chamber of the container is reduced. Upon reaching a threshold vacuum pressure within the liquid chamber of the container, the vent slit 93 in the inner wall 83 of the circular tubular plug 63 opens allowing ambient air to pass through the aperture 41 in the closure member 31 and enter into the vent chamber 109 (see, e.g., FIG. 19). From the vent chamber 109, the ambient air passes through the vent slit 93 and into the interior space of the container 3 to bring the pressure within the liquid chamber to or approximately to ambient. Once the vacuum pressure within the liquid chamber of the container 3 returns approximately to ambient, the vent slits 93 in the inner wall 83 of the circular tubular plug 63 return to a sealed position inhibiting air from flowing into the chamber.

The illustrated drinking cup 1 can be repeatedly taken apart for thorough cleaning and reassembled for the next use. The separable components (as seen in FIG. 5) are all relatively large so that they are easy to handle. In addition, the number of separable components (i.e., three) is minimized to make assembly and reassembly of the cup 1 relatively easy without compromising the ability to clean each of the components. As mentioned above, the closure member 31, in the illustrated embodiment, can be removed from or secured to the container 3 via its threaded connection therewith. That is, the internal threads 53 of the inner socket 51 of the closure member 31 can be selectively engaged with and disengaged from the external threads 27 on the attachment collar 23 of the container 3. As noted above, it is understood that other forms and structures for making a releasable connection between the closure member 31 and the container 3 may be used. For instance, the closure member 31 may have a snap-fit connection with the container 3.

The valve assembly 33 can be selectively inserted into and pulled off of the closure member 31. More particularly, the valve assembly 33 can be releasably coupled to the closure member 31 by inserting the circular tubular plug 63 of the valve assembly into the annular socket 55 of the closure member, and the elliptical tubular plug 65 of the valve assembly into the elliptical socket 57 of the closure member. Thus, in the illustrated embodiment, the valve assembly 33 has a friction fit (or interference fit) with the closure member 31. To remove the valve assembly 33 from the closure member 31, a user grabs the grip tab 67 and pulls downward to withdraw the circular tubular plug 63 of the valve assembly from the annular socket 55 of the closure member, and the elliptical tubular plug 65 of the valve assembly from the elliptical socket 57.

Figure 21:
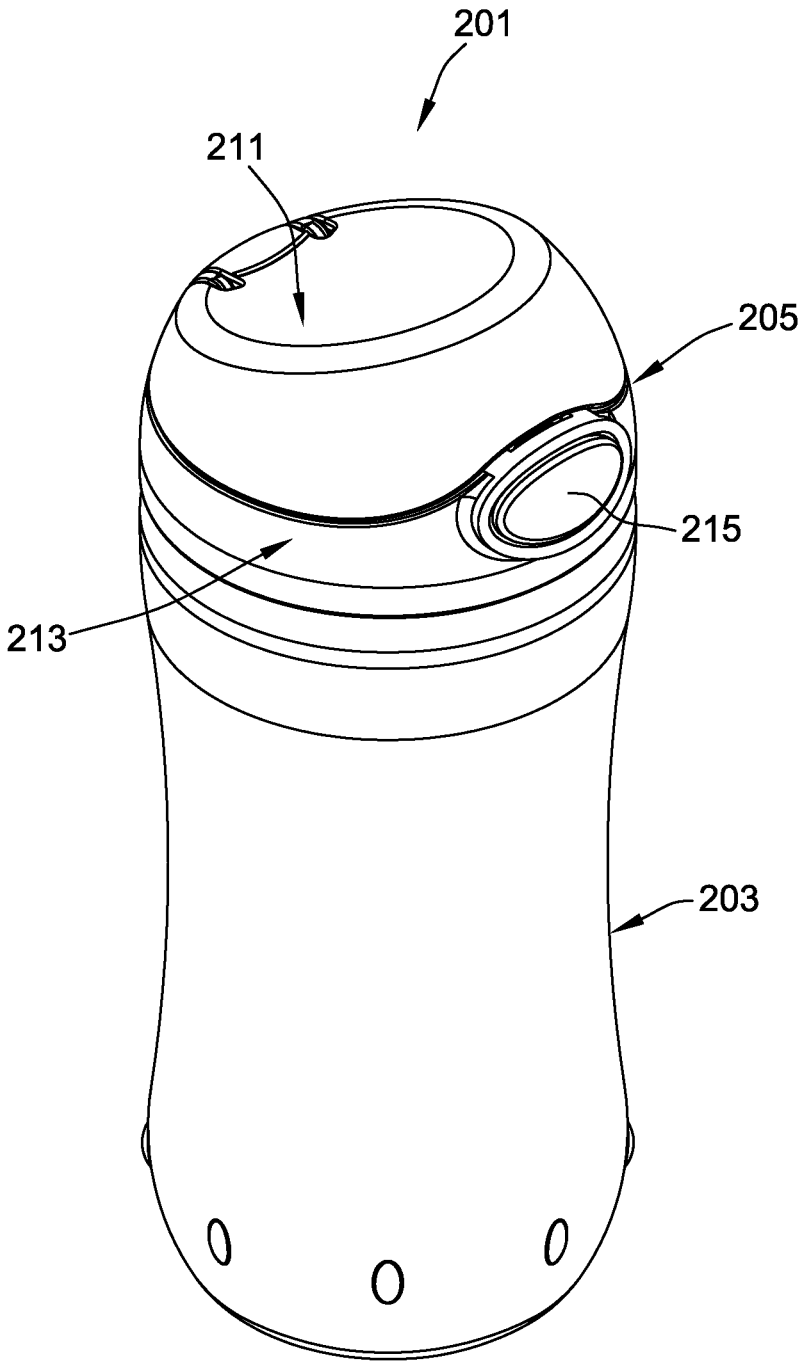
FIG. 21 is a perspective of one embodiment of a leak resistant straw cup having a container and a lid assembly coupled to the container.
Figure 22:
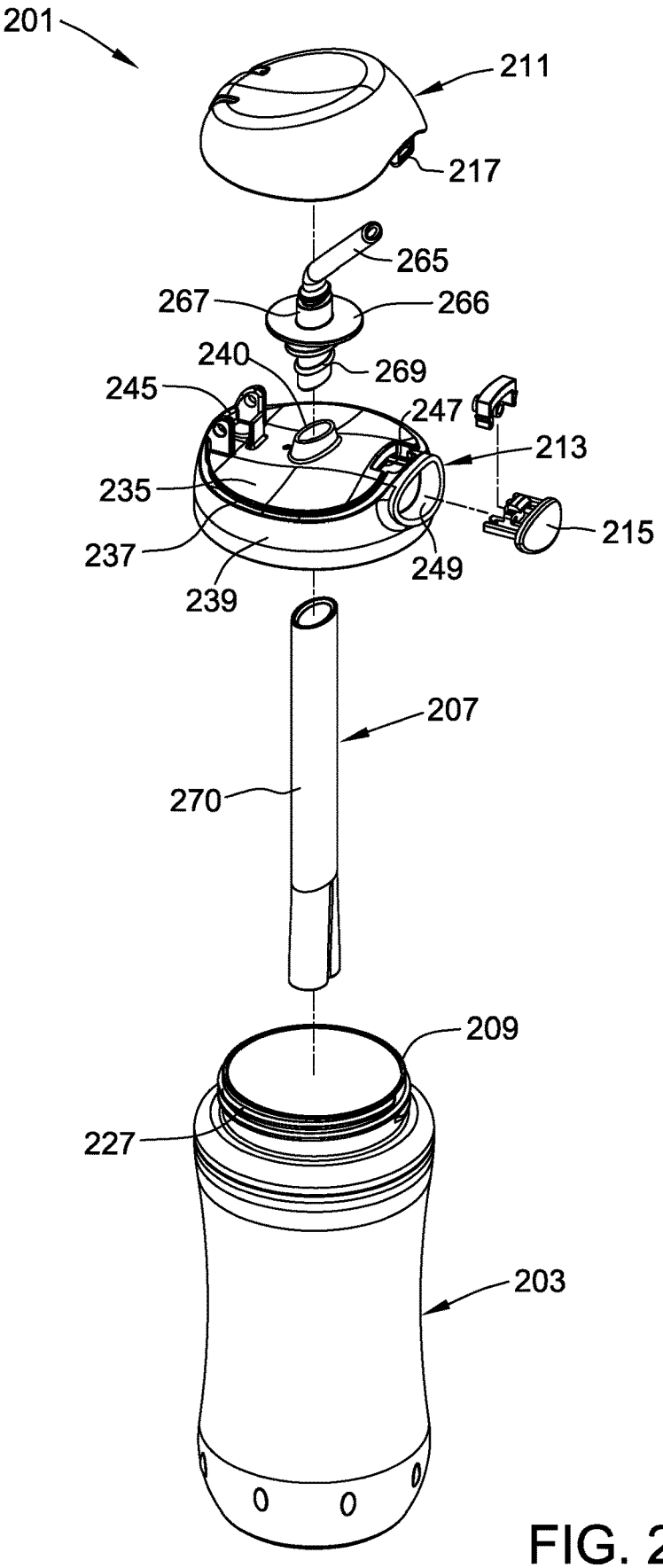
FIG. 22 is an exploded side view of the straw cup of FIG. 21.
Figure 23:
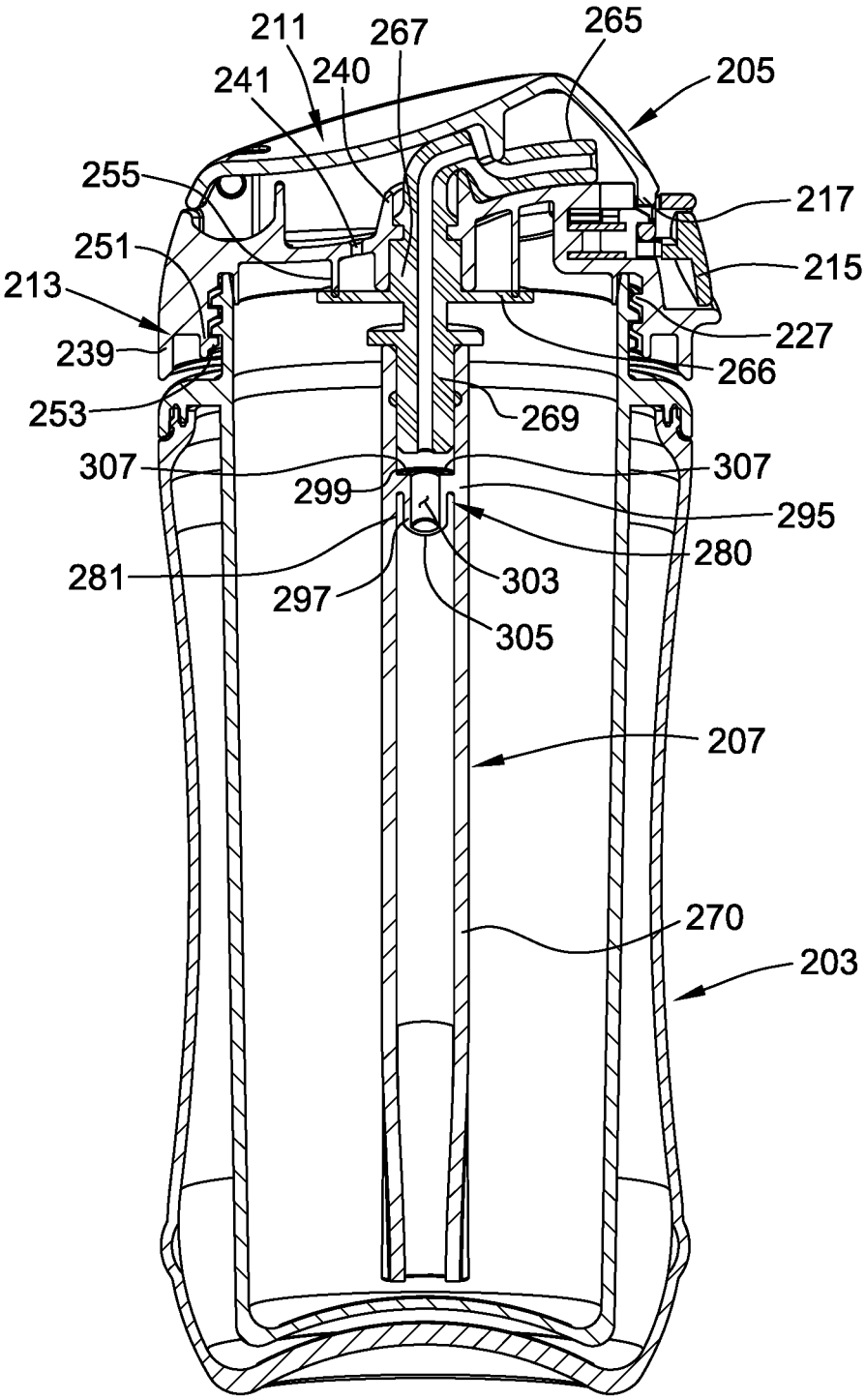
FIG. 23 is a vertical cross-section of the straw cup of FIG. 21.

FIGS. 21-23 illustrate another suitable embodiment of a leak resistant drinking cup of the present disclosure in the form of a straw cup, generally indicated at 201. The straw cup 201 includes a container, which is generally indicated at 203, a lid assembly, which is generally indicated at 205, and a straw assembly, which is generally indicated at 207. The illustrated container 203 is substantially the same as the container 3 seen in FIG. 1 and described above. As a result, the container 203 will not be described in detail with respect to FIGS. 21-23.

The lid assembly 205 of the cup 201 is adapted for removable attachment to the container 203 for selectively closing an open top 209 of the container. The lid assembly 205, as illustrated in FIG. 22, comprises a cover (or cap) 211 and a closure member 213. Both the cover 211 and the closure member 213 are indicated generally by their respective reference numbers. The cover 211 and the closure member 213 can be made of any suitable material. In one embodiment, the cover 211 and the closure member 213, for example, can be made of polypropylene. The cover 211 and the closure member 213 can be made in any desired color or colors, and may be transparent, translucent, or opaque.

In the embodiment illustrated in FIGS. 21-23, the cover 211 is hingedly connected to the closure member 213 and is selectively pivotable between a closed position (FIGS. 21 and 23) and an opened position (not shown). In addition, the cover 211 is biased toward the opened position, such as by a spring. A push button actuator 215 cooperates with a latch 217 of the cover 211 to hold the cover in the closed position against the bias. Actuation of the actuator 215 (i.e., pushing the button) releases the latch 217 from the actuator 215 thereby allowing the bias to pivot the cover 211 from the closed position to the opened position. The cover 211 can be selectively closed by manually pivoting the cover from the opened position to the closed position so that the latch 217 of the cover 211 is captured by the actuator 215. It is contemplated that in other suitable embodiments the cover 211 can be omitted or be fully removable from the closure member 213.

With reference now to FIGS. 22 and 23, the closure member 213 of the lid assembly 205 comprises a contoured upper portion 235, an annular shoulder 237 circumscribing and stepped down from the upper portion, and a peripheral skirt 239 depending downward from the annular shoulder. The closure member 213 includes an elliptical socket 240 that extents both upward and downward through the center of the upper portion 235 for allowing at least a portion of the straw assembly 207 to pass through the closure member 213 (FIG. 23). A relatively small, circular vent aperture 241, which can be seen in FIG. 23, is located adjacent the elliptical socket 240. The vent aperture 241 allows air to pass through the closure member 213 when the closure member is attached to the container 203. The closure member 213 further comprises a hinge mount 245 for facilitating the hinged connection between the closure member and the cover 211 and a generally rectangular opening 247. With reference still to FIG. 23, the skirt 239 of the closure member 213 includes an elliptical opening 249 for receiving the actuator 215. The opening 249 in the skirt 239 is located adjacent the opening 247 in the closure member 213 so that the latch 217 can pass through the closure member 213 to the actuator 215, which is receiving in the opening 249 in the skirt 239.

As illustrated in FIG. 23, the closure member 213 has an inner socket 251 defined by the peripheral skirt 239. The inner socket 251 includes internal threads 253 for releasably mating with external threads 227 of the container 203. Thus, the closure member 213 can be selectively attached and detached from the container 203 via the threaded connection between the internal threads 253 of the inner socket 251 and the external threads 227 of the container 203. It is understood, however, that the closure member 213 can be selectively attached and detached from the container 203 using any suitable connection (e.g., snap-fit). The closure member 213, as illustrated in FIG. 23, also includes an interior socket 255 extending downward from the upper portion 235 and circumscribing the downward extending portion of the elliptical socket 240 such that the vent aperture 241 is disposed between the interior socket and the downward extending portion of the elliptical socket.

The straw assembly 207 is elongate and includes an upper tubular portion 265 suitable for being partially received in the child's (or broadly, the user's) mouth for drawing liquid from the container 203. The straw assembly 207 further includes an upper mounting member 267, a generally ring-shaped diaphragm 266, and a lower mounting member 269. The upper mounting member 267 is sized and shaped for being received in and thereby captured by the elliptical socket 240 in the closure member 213. The lower mounting member 269 is adapted for selectively receiving a straw extension 270.

In one suitable embodiment, the straw assembly 207 is manufactured from a suitably pliable material so that at least a portion of the straw assembly can be resiliently deformed and passed through the elliptical socket 240 in the closure member 213. The straw assembly 207 is adapted to return to approximately its original shape after deformation and passing through the opening elliptical socket 240 to thereby mount the straw assembly to the closure member 213. More specifically, to mount the straw assembly 207 to the closure member 213 (or more broadly to the lid assembly 209), the upper tubular portion 265 is inserted through the elliptical socket 240 in the closure member 213 from the underside (or bottom) of the closure member until the upper mounting member 267 is disposed within and captured by the elliptical socket. With the straw assembly 207 mounted on the closure member 213, the diaphragm 266 sealingly engages the inner socket 255 surrounding the elliptical socket 240. As illustrated in FIGS. 19 and 20, the straw extension 270 can be readily coupled to the lower mounting member 269 via a friction fiction connection. The illustrated straw extension 270 has a generally elliptical cross-sectional shape.

In this embodiment and as illustrated in FIG. 23, at least a portion of a valve assembly, indicated generally at 280, is integrally formed within the straw extension 270. More specifically, an elliptical tubular plug 281 (substantially similar to the elliptical tubular plug 65 described above) is integrally formed with and located along the length of the straw extension 270. In other words, the elliptical tubular plug 281 is formed as a single piece with the straw extension 270.

The elliptical tubular plug 281 of the valve assembly 280 includes an outer wall 295 (which also defines part of the wall of the straw extension), an inner wall 297, and a web 299 extending between and connecting the outer and inner walls. The inner wall 297 defines a recess 303 having a closed, concaved bottom 305. The web 299 is non-circular, and more suitably, generally racetrack-shaped (e.g., elliptical, ovate) and defines the upwardly facing surface of the elliptical tubular plug 281. The web 299 includes a pair of slits 307 disposed in the web spaced intermediate the outer and inner walls 295, 297 and extend through the thickness of the web. In the illustrated embodiment, the slits 307 are generally arcuate (e.g., nonlinear) and follow approximately the same curvature as the inner and outer walls 295, 297. It is contemplated that the web 299 can have fewer slits 307 (i.e., a single slit) or more than two slits without departing from some aspects of this disclosure.

It is easy for a young child (or any other user) to get a drink out of the cup 201 by placing her lips around the upper tubular portion 265 of the straw assembly 207 so as to form a seal with the straw assembly and sucking so that liquid in the container 203 is drawn up through the straw extension 270 and other parts of the straw assembly 207, and into the child's mouth. Sucking on the straw assembly 207 removes air therefrom and applies vacuum pressure to the inner wall 297 of the elliptical tubular plug 281. Upon a threshold vacuum being applied to the inner wall 297, the inner wall flexes inward, which moves the valve assembly 280 from a sealed, closed configuration (FIG. 23), which inhibits liquid from passing through the slits 307 in the web 299, to an unsealed, opened configuration, which allows liquid to pass through the slits (not shown). More specifically, vacuum pressure applied by the user to the elliptical tubular plug 281 at or below (i.e., greater vacuum) the threshold vacuum causes at least a portion of the elliptical tubular plug 281 to flex inward toward a major axis of the elliptical tubular plug. The inner wall 297 of the elliptical tubular plug 281, which is readily flexible because of its reduced wall thickness, flexes inward toward the major axis of the elliptical tubular plug. Once the inner wall 297 is flexed (or otherwise moved or deformed) a sufficient amount, the slits 307 in the web 299 are altered to define a pathway therethough and allow liquid to pass the valve assembly 280. Thus, the user applying vacuum to the straw assembly 207 at or above the threshold vacuum permits liquid to flow past the valve assembly 280 through the slits 307 and into the user's mouth for drinking.

Once the user stops applying a vacuum pressure to the straw assembly, the resiliency of the valve assembly 280 causes the valve assembly to move from the unsealed position back to the sealed position. More specifically, terminating the vacuum pressure applied to the inner wall 297 of the elliptical tubular plug 281 results in the inner wall moving away from the major axis of the elliptical tubular plug and toward its original, at rest position (shown in FIG. 23). As the inner wall 297 moves back to its rest position, the slits 307 in the web 299 are altered to close pathway therethough and inhibit liquid from passing the valve assembly 280. Thus, the user by stopping to apply vacuum at or above the threshold vacuum causes the valve assembly 280 to return to its closed, sealed position.

As liquid is drawn out of the container 203 by the child, the pressure within the liquid chamber of the container is reduced. Upon reaching a threshold vacuum pressure within the liquid chamber of the container 203, the diaphragm 266 of the straw assembly 207 moves away from interior socket 255 of the closure member 213 thereby allowing ambient air to pass through the aperture 241 in the closure member and into the liquid chamber of the container 203 to bring the pressure within the liquid chamber to or approximately to ambient. Once the vacuum pressure within the liquid chamber of the container 203 returns approximately to ambient, the diaphragm 266 of the straw assembly 207 moves back into a sealed position with the interior socket 255 of the closure member 213.

Figure 24:
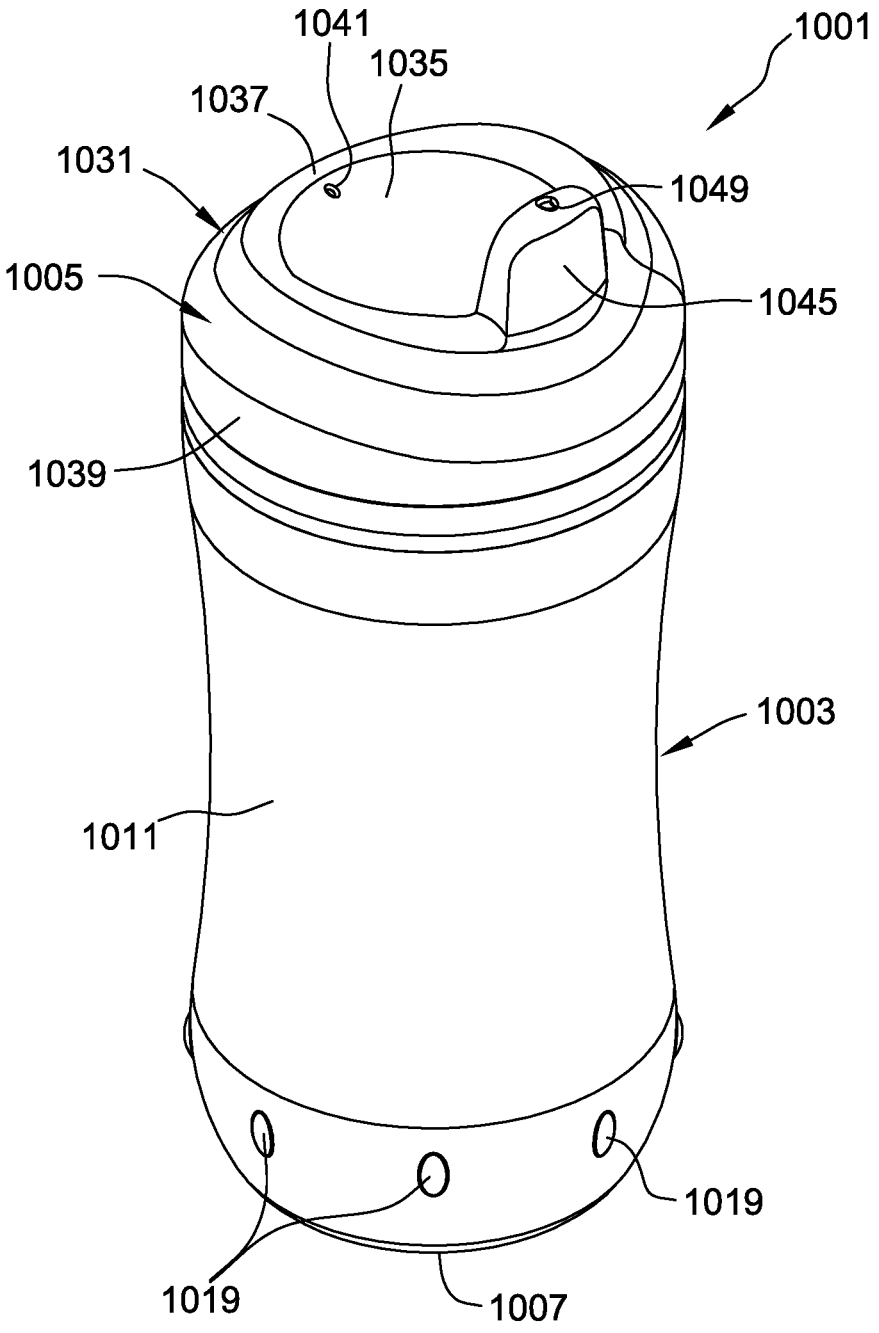
FIG. 24 is a perspective of another embodiment of a leak resistant drinking cup having a container and a lid assembly coupled to the container.
Figure 25:
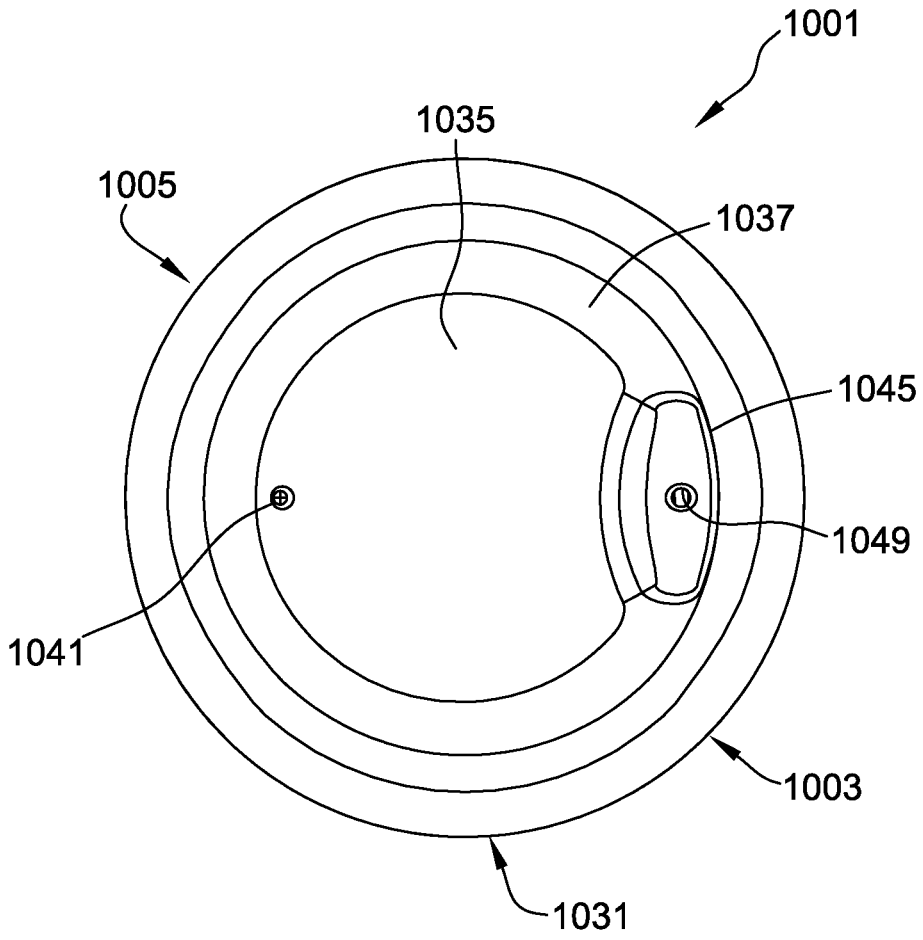
FIG. 25 is a top view of the cup.
Figure 26:
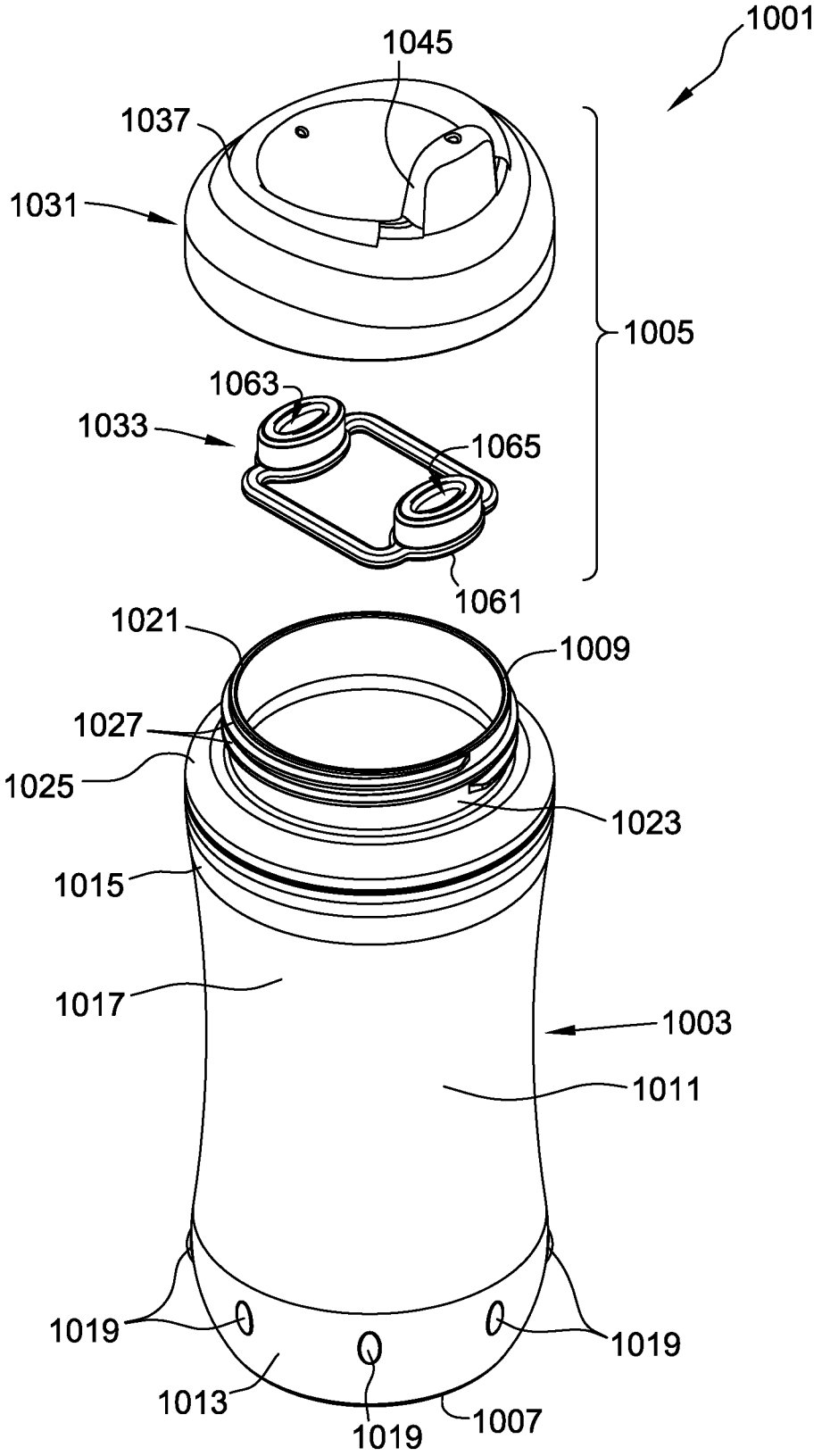
FIG. 26 is an exploded perspective of the cup.
Figure 27:
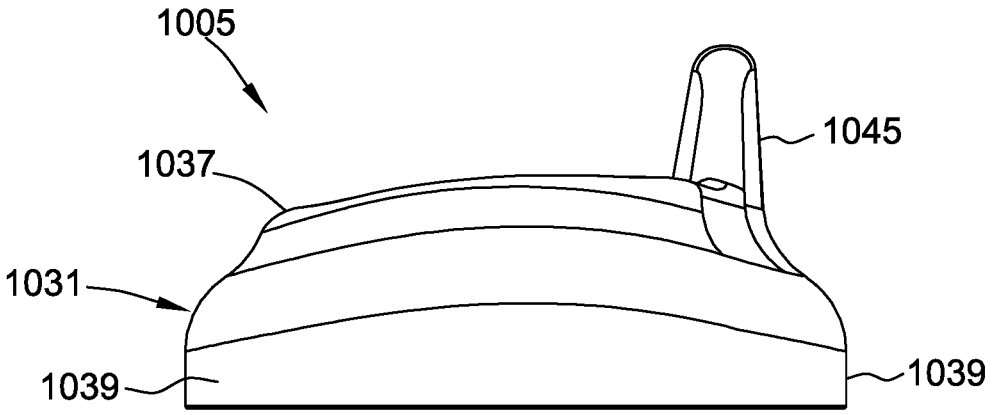
FIG. 27 is a side elevation of the lid assembly removed from the container, the lid assembly including a closure member and a valve assembly secured to the closure member.

FIGS. 24-42 illustrate another embodiment of a leak resistant drinking cup 1001 that is similar to the drinking cup 1 of the embodiment of FIGS. 1-20 with the primary difference being the use of different valve assembly. Like components are indicated with reference numbers "1*xxx*" with the "xxx" being the corresponding reference number from the embodiment of FIGS. 1-20. As seen in FIGS. 24 and 25, in this embodiment the closure member 1031 of the lid assembly 1005 includes a concaved, central upper portion 1035, an annular ridge 1037 circumscribing and extending upward from the central upper portion, and a peripheral skirt 1039 depending downward from the annular ridge. The upper portion 1035 includes a relatively small, circular vent aperture 41 disposed adjacent the annular ridge 1037.

Figure 28:
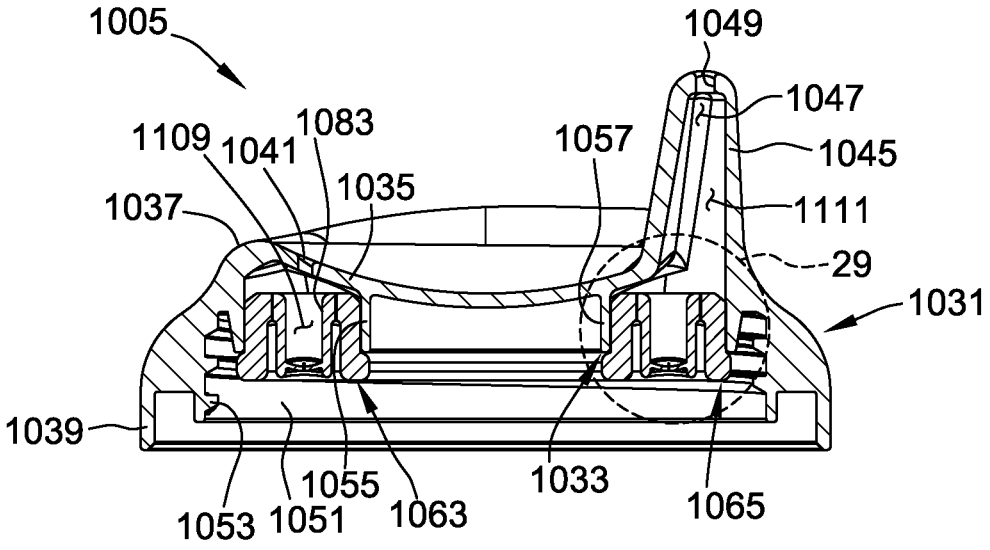
FIG. 28 is a vertical cross-section of the lid assembly illustrated in FIG. 27 illustrating the valve assembly secured to the closure member, the valve assembly being in a closed, sealed configuration.
Figure 30:
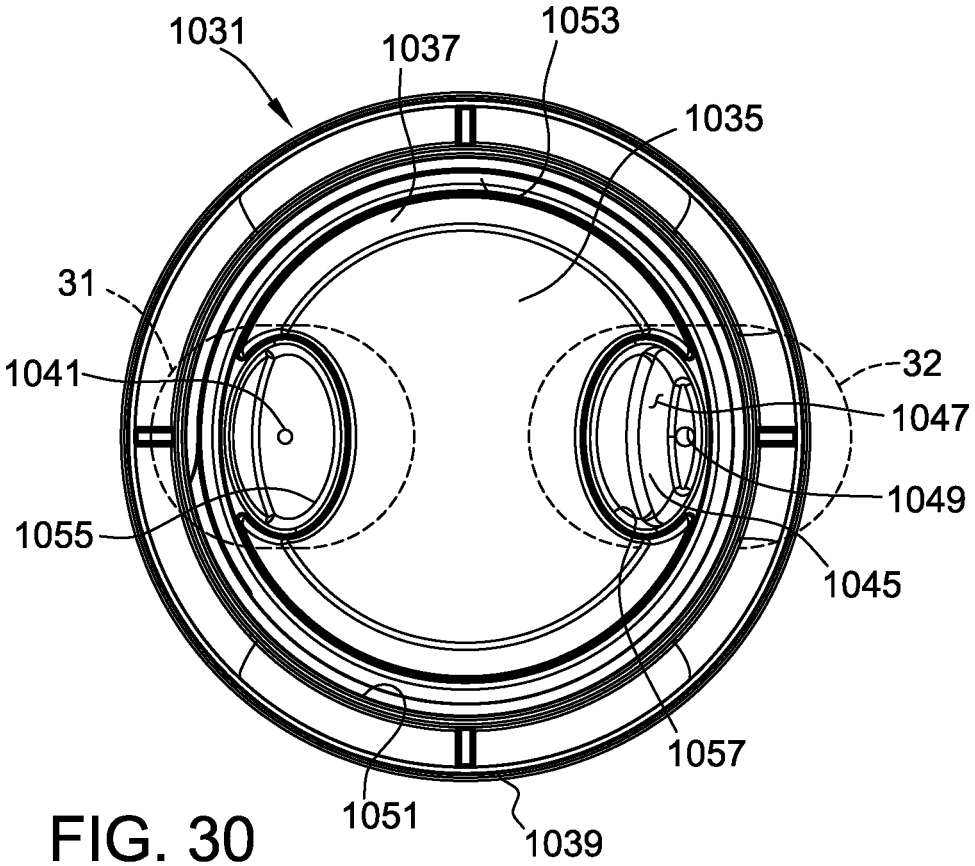
FIG. 30 is a bottom view of the closure member having the valve assembly removed therefrom.

As illustrated in FIGS. 28 and 30, the closure member 1031 has an inner socket 1051 defined by the peripheral skirt 1039. The inner socket 1051 includes internal threads 1053 for releasably mating with the external threads 1027 of the attachment collar 1023 of the container 1003. Thus, the closure member 1031 can be selectively attached and detached from the container 1003 via the threaded connection between the internal threads 1053 of the inner socket 1051 and the external threads 1027 of the attachment collar 1023. It is understood, however, that the closure member 1031 can be selectively attached and detached from the container 1003 using any suitable connection (e.g., snap-fit).

Figure 31:
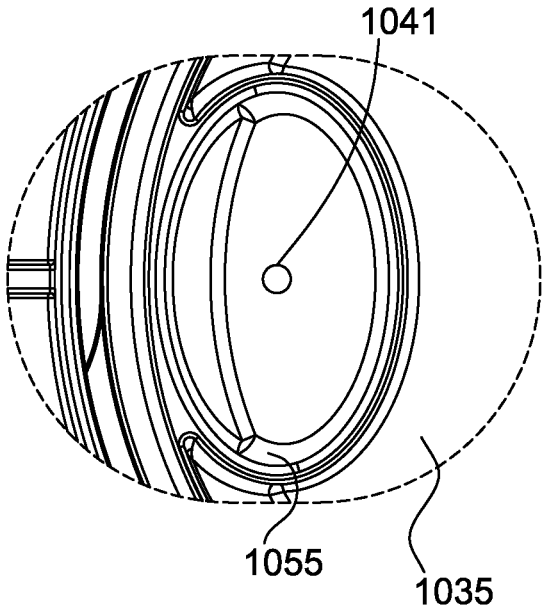
FIGS. 31 and 32 are enlargements of the respective encircled portions of FIG. 30.
Figure 32:
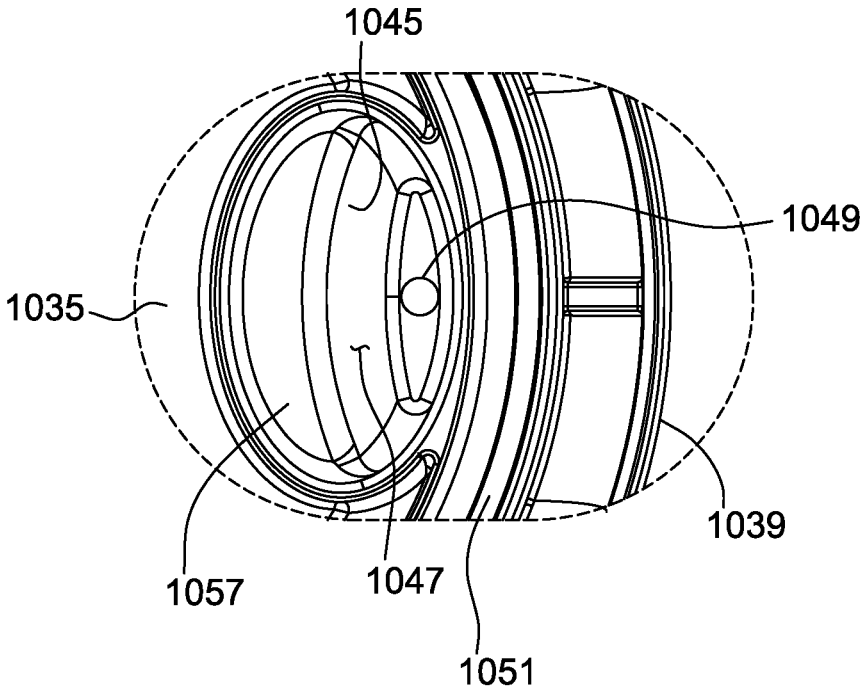

In this embodiment, the closure member 1031, as illustrated in FIGS. 28-31, also includes a first interior, elliptical socket 1055 extending downward from the central upper portion 1035 and circumscribing the vent aperture 1041. As best seen in FIGS. 30 31, the vent aperture 1041 in the upper portion 1035 is generally centered relative to the first elliptical socket 1055. A second elliptical socket 1057 is spaced from and opposed the first elliptical socket 1055. As best seen in FIGS. 30 and 32, the second elliptical socket 1057 is fluidly connected with the passageway 1047 of the spout 1045. In the illustrated embodiment, the passageway 1047 of the spout 1045 is aligned with approximately half of the second elliptical socket 1057. It is understood, however, that the passageway 1047 of the spout 1045 can be aligned with more or less of the second elliptical socket 1057 including its entirety.

It is noted that the first elliptical socket 1055 and the second elliptical socket 1057 have the same shape and size in the illustrated embodiment. The first elliptical socket 1055 and the second elliptical socket 1057 are sized and shaped the same to facilitate attachment of the valve assembly 1033 to the closure member 1031 in two different orientations as is described in more detail below. It is also understood that the sockets 1055, 1057 can have any suitable size or shape. It is also understood that the sockets 1055, 1057 can have different sizes and shapes relative to each other without departing from some aspects of this disclosure.

Figure 35:
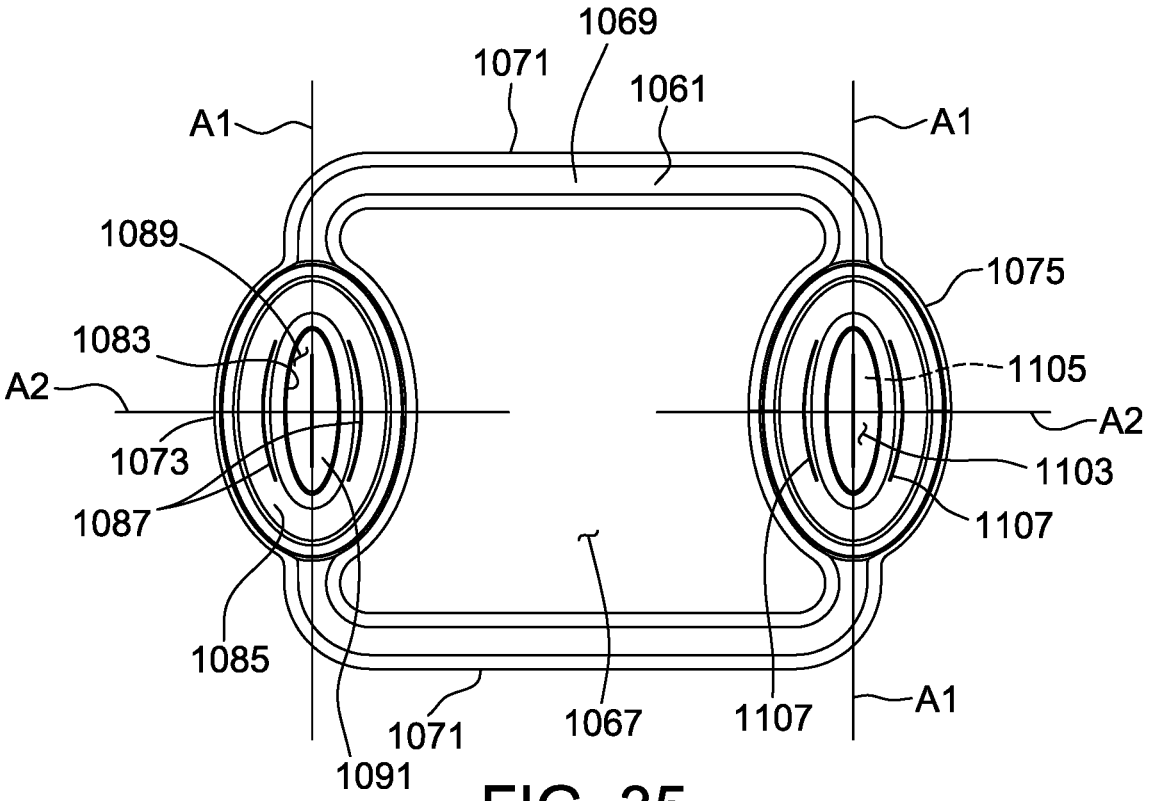
FIG. 35 is a top view of the valve assembly.
Figure 36:
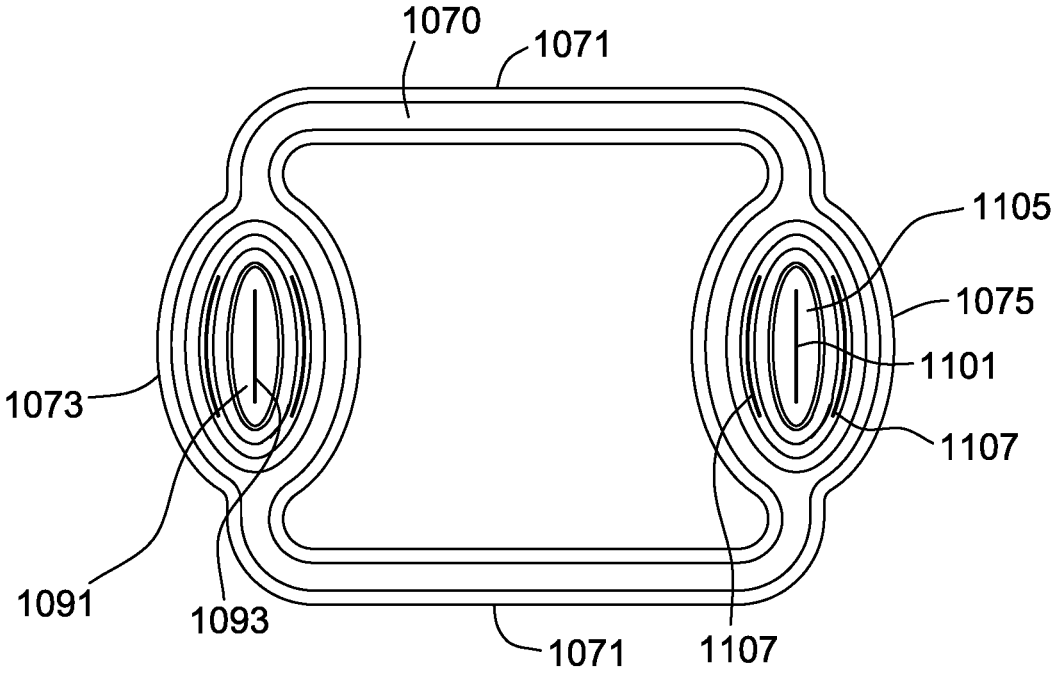
FIG. 36 is a bottom view of the valve assembly.

As illustrated in FIGS. 33-38, the valve assembly 1033 includes a generally ovate base or platform 1061, a first elliptical tubular plug, indicated generally at 1063, adapted for insertion into one of the first or second elliptical sockets 1055, 1057 of the closure member 1031, and a second elliptical tubular plug 1065 adapted for insertion into the other elliptical socket 1057 in the closure member. As best seen in FIGS. 35 and 36, the ovate platform 1061 includes a relatively large central opening 1067, an upper planer surface 1069, a lower planer surface 1070, two generally parallel side edges 1071, a first end edge 1073, and a second end edge 1075 spaced from the first end edge.

With reference now to FIGS. 33-37, the first elliptical tubular plug 1063 of the valve assembly 1033 includes an outer wall 1081, an inner wall 1083, and a web 1085 extending between and connecting the outer and inner walls. As best seen in FIG. 35, the web 1085 is non-circular, and more suitably, generally racetrack-shaped (e.g., elliptical, ovate) and defines the upwardly facing surface of the elliptical tubular plug 1063. With reference now to FIGS. 35 and 36, the inner wall 1083, which has a generally concave bottom 1091 in the illustrated embodiment, defines a recess 1089. The web 1085, as explained in more detail below, includes a pair of slits 1087 disposed in the web spaced intermediate the outer and inner walls 1081, 1083 and extend through the thickness of the web. In the illustrated embodiment, the slits 1087 are generally arcuate (e.g., nonlinear) and follow approximately the same curvature as the inner and outer walls 1081, 1083. It is contemplated that the web 1085 can have fewer slits 1087 (i.e., a single slit) or more than two slits without departing from some aspects of this disclosure.

As illustrated in FIGS. 35 and 36, the concave bottom 1091 of the inner wall 1083 has a vent slit 1093 defined by an elongate slit. It is understood, however, that the vent slit 1093 can have any suitable configuration including being defined by more than one elongate slit. For example, in another suitable embodiment, the vent slit 1093 can be cruciform (e.g., X-shaped, +-shaped). The concaved shape of the bottom 1091 allows easy opening via pressure from outside air while resisting fluid flow from the opposing convex side. It is also understood that the relatively concave bottom 1091 seen in FIGS. 35 and 36 can have any suitable shape without departing from some aspects of this invention.

As seen in FIG. 35, the first elliptical tubular plug 1063 has a major axis A1 and a minor axis A2. As a result, the maximum extent of the first elliptical tubular plug 1063 along the major axis A1 is greater than the maximum extent of the first elliptical tubular plug along the minor axis A2. For example, in one suitable embodiment, the major axis A1 can be between 6 mm and 133 mm, more preferably between 16 mm and 66 mm, and even more preferably between 20 mm and 26 mm, and the minor axis A2 can be between 4 mm and 107 mm, more preferably between 13 mm and 53 mm, and even more preferably between 16 mm and 21 mm. Suitably, the ratio of the maximum extents between the major axis A1 and the minor axis A2 is between 1 and 10, more preferably between 1.2 and 5, and even more preferably between 1.5 and 2. Suitably, the ratio between the maximum extents of the major axis A1 and the minor axis A2 is greater than 1 and less than 10.

Figure 37:
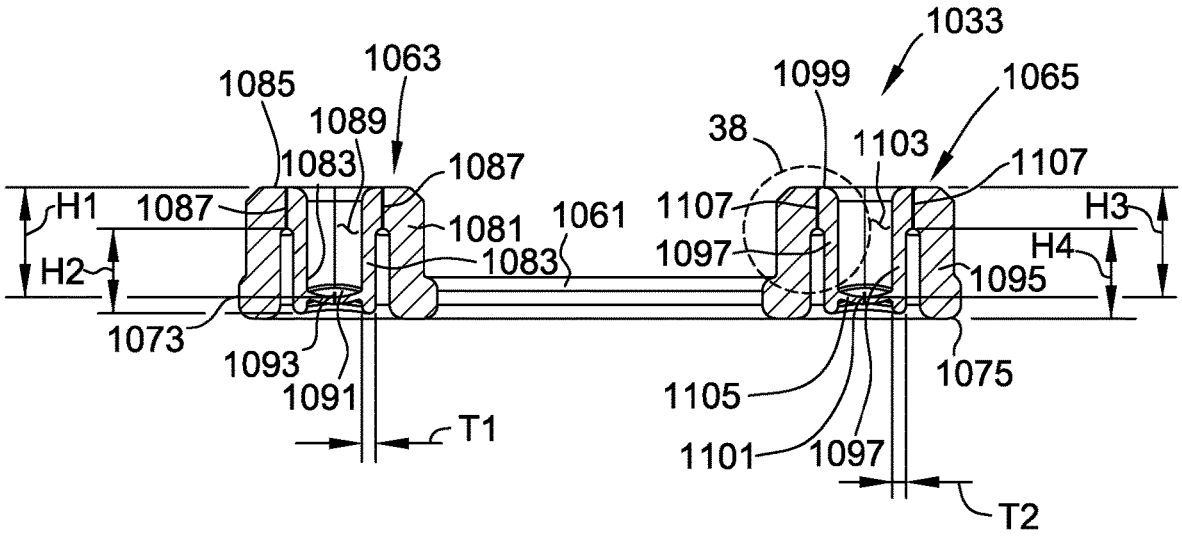
FIG. 37 is a vertical cross-section taken from the side elevation of FIG. 34.
Figure 38:
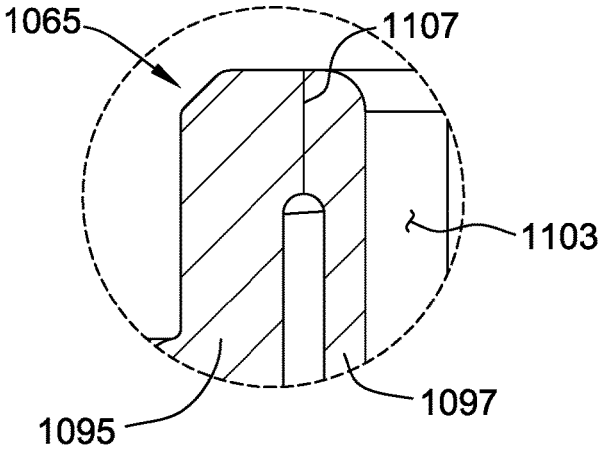
FIG. 38 is an enlargement of the encircled portion of FIG. 37.

With reference to FIG. 37, the inner wall 1083 has an interior height H1 that is defined by the interior surface of the inner wall and an exterior height H2 that is defined by the exterior surface of the inner wall. The interior height H1 of the inner wall 1083 is greater than the exterior height H2 of the inner wall. For example, in one embodiment, the interior height H1 is between 1 mm and 100 mm, more preferably between 3 mm and 25 mm, and even more preferably between 5 mm and 15 mm, and the exterior height H2 is between 1 mm and 100 mm, more preferably between 3 mm and 25 mm, and even more preferably between 5 mm and 10 mm. In the illustrated embodiment, for example, the interior height H1 of the inner wall 1083 is approximately 9.55 mm, and the exterior height H2 is approximately 6.55 mm.

As a result, the surface area of the interior surface of the inner wall 1083 is greater than the surface area of the exterior surface of the inner wall. In the illustrated embodiment, for example, the surface area of the interior surface of the inner wall 1083 is approximately 206.5 square millimeters (0.32 square inches), and the surface area of the exterior surface of the inner wall is approximately 132.6 square millimeters (0.21 square inches). In one suitable embodiment, the ratio between the surface area of the interior surface and the exterior surface of the inner wall 1083 is between 1 and 10. Suitably, the ratio is greater than 1 and less than 10. More preferably, the ratio between the surface area of the interior surface and the exterior surface of the inner wall 1083 is between 1.2 and 5 and, even more preferably, between 1.4 and 2. In the illustrated embodiment, for example, the ratio between the surface area of the interior surface and the exterior surface is approximately 1.55.

Suitably, a ratio between the interior surface of the inner wall 1083 and a cross sectional area of the inner wall with a thickness T1 is between 1 and 50. Suitably, the ratio is greater than 1 and less than 50. More suitably, the ratio between the interior surface of the inner wall 1083 and the cross sectional area at the thickness T1 is between 2 and 20 and, ever more suitably, between 5 and 10.

With reference still to FIGS. 33-37, the second elliptical tubular plug 1065 of the valve assembly 1033 includes an outer wall 1095, an inner wall 1097, and a web 1099 extending between and connecting the outer and inner walls. The inner wall 1097, which has a generally concave bottom 1105 in the illustrated embodiment, defines a recess 1103. As best seen in FIG. 35, the web 1099 is non-circular, and more suitably, generally racetrack-shaped (e.g., elliptical, ovate) and defines the upwardly facing surface of the second elliptical tubular plug 1065. The web 1099, as explained in more detail below, includes a pair of slits 1107 disposed in the web spaced intermediate the outer and inner walls 1095, 1097 and extend through the thickness of the web. In the illustrated embodiment, the slits 1107 are generally arcuate (e.g., nonlinear) and follow approximately the same curvature as the inner and outer walls 1095, 1097. It is contemplated that the web 1099 can have fewer slits 1107 (i.e., a single slit) or more than two slits without departing from some aspects of this disclosure.

As illustrated in FIGS. 35 and 36, the concave bottom 1105 of the inner wall 1097 has a vent slit 1101 defined by an elongate slit. It is understood, however, that the vent slit 1101 can have any suitable configuration including being defined by more than one elongate slit. For example, in another suitable embodiment, the vent slit 1101 can be cruciform (e.g., X-shaped, +-shaped). The concaved shape of the bottom 1105 allows easy opening via pressure from outside air while resisting fluid flow from the opposing convex side. It is also understood that the relatively concave bottom 1105 seen in FIGS. 35 and 36 can have any suitable shape without departing from some aspects of this invention.

With reference to FIG. 37, the inner wall 1097 has an interior height H3 that is defined by the interior surface of the inner wall and an exterior height H4 that is defined by the exterior surface of the inner wall. The interior height H3 of the inner wall 1097 is greater than the exterior height H4 of the inner wall. For example, in one embodiment, the interior height H3 is between 1 mm and 100 mm, more preferably between 3 mm and 25 mm, and even more preferably between 5 mm and 15 mm, and the exterior height H4 is between 1 mm and 100 mm, more preferably between 3 mm and 25 mm, and even more preferably between 5 mm and 10 mm. In the illustrated embodiment, for example, the interior height H3 is approximately 9.55 mm, and the exterior height H4 is approximately 6.55 mm.

As a result, the surface area of the interior surface of the inner wall 1097 is greater than the surface area of the exterior surface of the inner wall. In the illustrated embodiment, for example, the surface area of the interior surface of the inner wall 1097 is approximately 206.5 square millimeters (0.32 square inches), and the surface area of the exterior surface of the inner wall is approximately 132.6 square millimeters (0.21 square inches). In one suitable embodiment, the ratio between the surface area of the interior surface and the exterior surface of the inner wall 1097 is between 1 and 10. Suitably, the ratio is greater than 1 and less than 10. More preferably, the ratio between the surface area of the interior surface and the exterior surface of the inner wall 1097 is between 1.2 and 5 and, even more preferably, between 1.4 and 2. In the illustrated embodiment, for example, the ratio between the surface area of the interior surface and the exterior surface is approximately 1.55.

Suitably, a ratio between the interior surface of the inner wall 1097 and the cross sectional area of the inner wall with a thickness T2 is between 1 and 50. Suitably, the ratio is greater than 1 and less than 50. More suitably, the ratio between the interior surface of the inner wall 1097 and the cross sectional area at the thickness T2 is between 2 and 20 and, ever more suitably, between 5 and 10.

With reference now to FIG. 35, the second elliptical tubular plug 1065 has a major axis A1 and a minor axis A2. As a result, the maximum extent of the second elliptical tubular plug 1065 along the major axis A1 is greater than the maximum extent of the second elliptical tubular plug along the minor axis A2. For example, in one suitable embodiment, the major axis A1 can be between 6 mm and 133 mm, more preferably between 16 mm and 66 mm, and even more preferably between 20 mm and 26 mm, and the minor axis A2 can be between 4 mm and 107 mm, more preferably between 13 mm and 53 mm, and even more preferably between 16 mm and 21 mm. Suitably, the ratio between the major axis A1 and the minor axis A2 is between 1 and 10, more preferably between 1.2 and 5, and even more preferably between 1.5 and 2.

Figure 33:
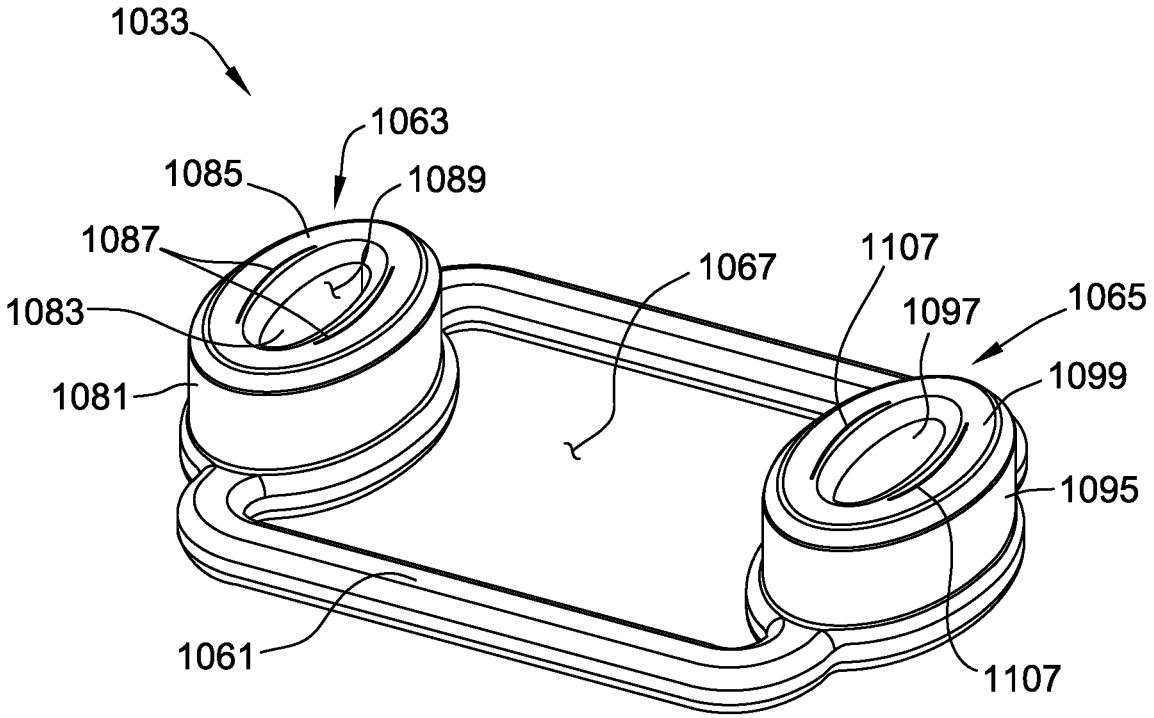
FIG. 33 is a perspective of the valve assembly of the lid assembly removed from the closure member.
Figure 34:
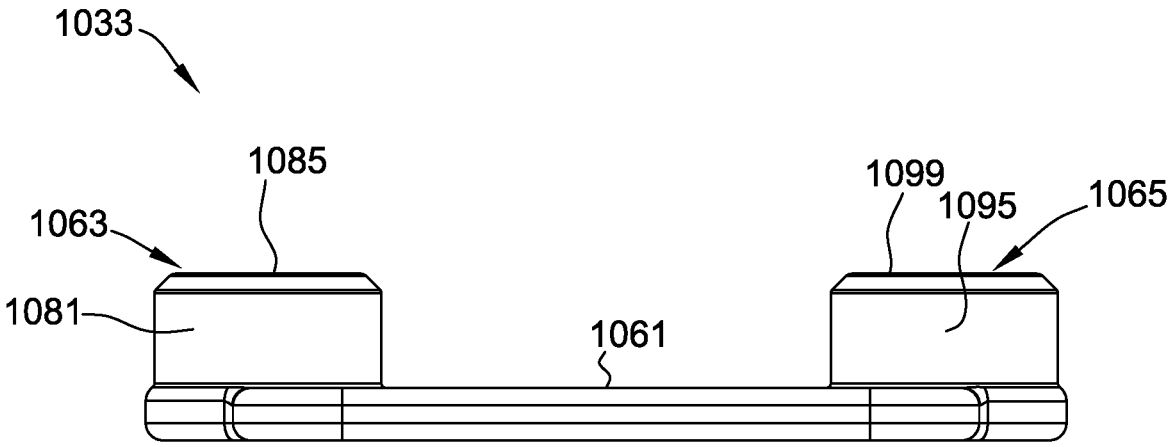
FIG. 34 is a side elevation of the valve assembly.

As seen in FIGS. 28 and 33, the closure member 1031 and the valve assembly 1033 cooperatively define a vent chamber 1109 and a suction chamber 1111. More specifically with respect to the vent chamber 1109, the concaved upper portion 1035 of the closure member 1031 and the inner wall 1083 of the first elliptical tubular plug 1063 cooperatively define the vent chamber when the valve assembly 1033 is connected to the closure member. In the illustrated embodiment, the volume of the vent chamber 1109 is approximately equal to the volume of the recess 1089 defined by the inner wall 1083 of the first elliptical tubular plug 1063 but it is understood that the vent chamber 1109 and the recess 1089 can have different volumes. The aperture 1041 in the upper portion 1035 of the closure member 1031 is in fluid communication with the vent chamber 1109 for maintaining the vent chamber generally at ambient pressure. The outer wall 1081 of the first elliptical tubular plug 1063 of the valve assembly 1033 engages the inner surface of the first elliptical socket 1055 of the closure member 1031 to form a seal between the vent chamber 1109 and the liquid chamber of the container 1003.

With respect to the suction chamber 1111, the passageway 1047 in the spout 1045 of the closure member 1031 and the inner wall 1097 of the second elliptical tubular plug 1065 cooperatively define the suction chamber when the valve assembly 1033 is connected to the closure member (FIG. 28). In the illustrated embodiment, the volume of the suction chamber 1111 is approximately equal to the volume of the recess 1103 defined by the inner wall 1097 of the second elliptical tubular plug 1065. The opening 1049 in the spout 1045 of the closure member 1031 is in fluid communication with the suction chamber 1111 for allowing a user to apply a suction (i.e., vacuum) pressure to the suction chamber by sucking on the spout. The outer wall 1095 of the second elliptical tubular plug 1065 engage the inner surface of the second elliptical socket 1057 of the closure member to form a seal between the suction chamber 1111 and the liquid chamber of the container 1003.

In the illustrated embodiment, the first elliptical tubular plug 1063 of the valve assembly 1033 is received in the first elliptical socket 1055 of the closure member 1031, and the second elliptical tubular plug 1065 is received in the second elliptical socket 1057. However, the valve assembly 1033 can be selectively repositioned to change its orientation such that the second elliptical tubular plug 1065 is received in the first elliptical socket 1055 of the closure member 1031, and the first elliptical tubular plug 1063 can be received in the second elliptical socket 1057.

Figure 29:
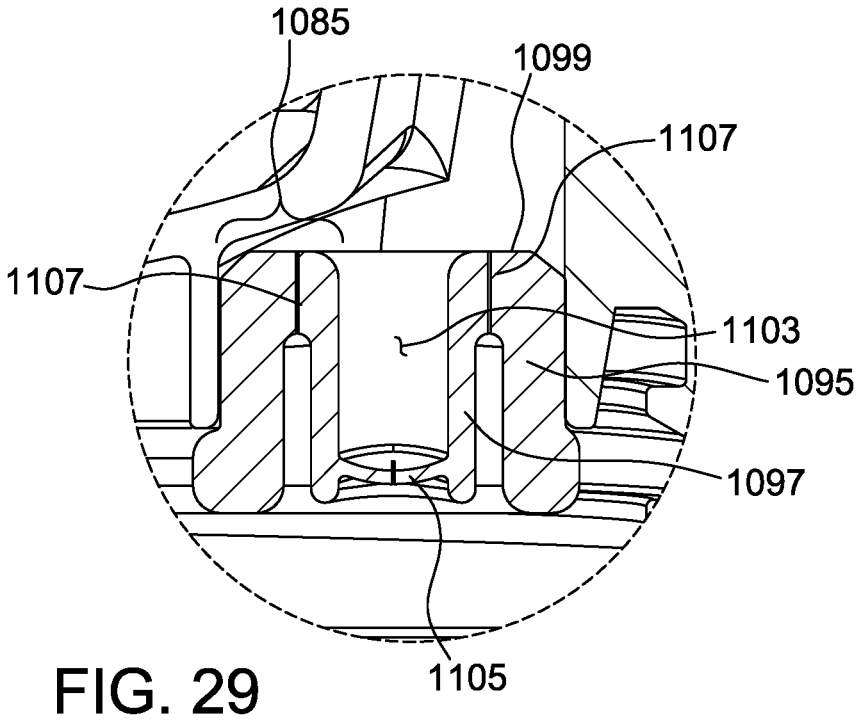
FIG. 29 is an enlarged fragmentary view of the cross-section illustrated in FIG. 28 taken from area "29" of FIG. 28.
Figure 39:
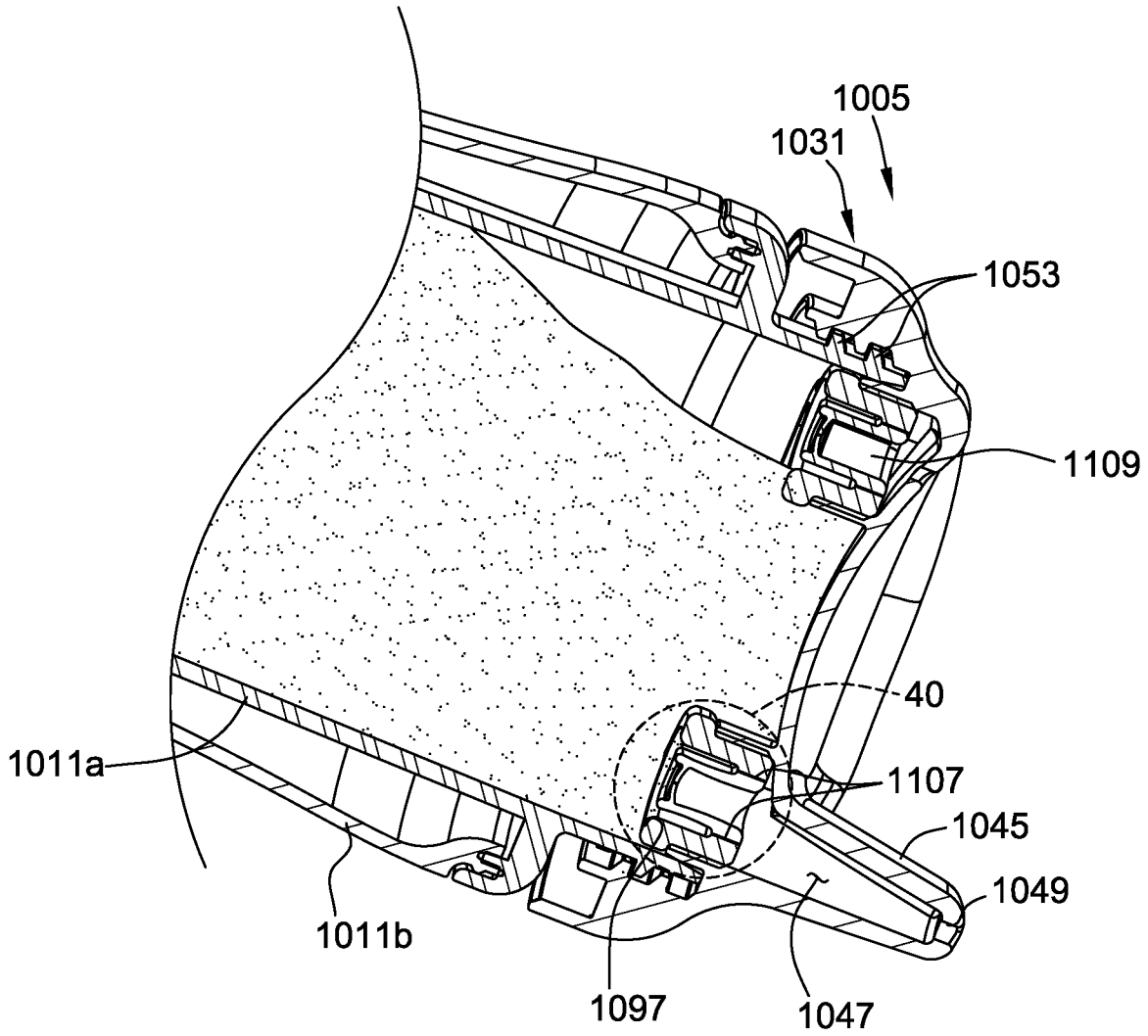
FIG. 39 is a fragmented, enlarged vertical cross-section of the leak resistant drinking cup, the cup being seen in a tilted, drinking position, the valve assembly being in the closed, sealed configuration thereby inhibiting liquid from exiting the cup.
Figure 40:
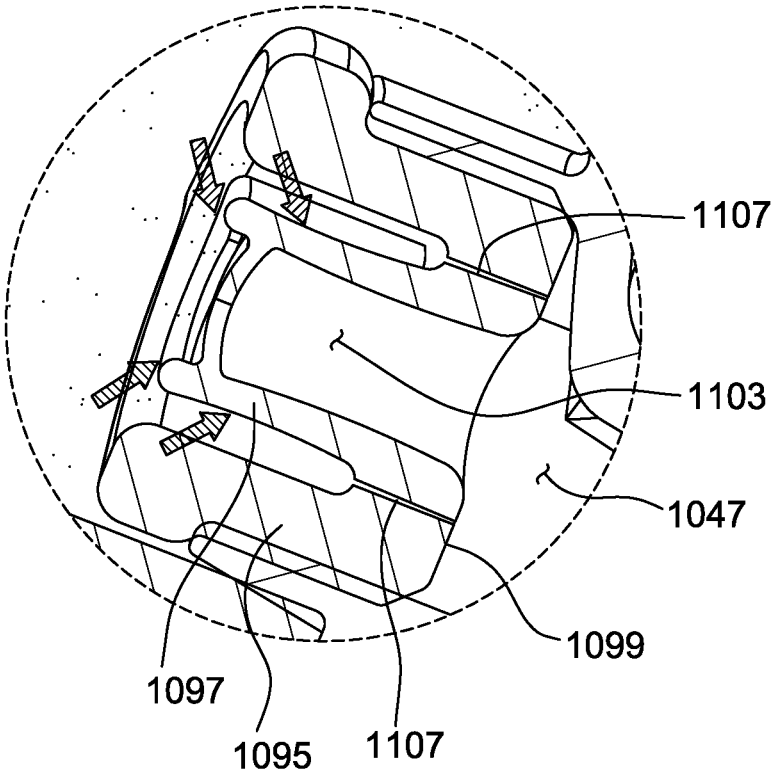
FIG. 40 is an enlarged fragmentary view of the cross-section illustrated in FIG. 39 taken from area "40" of FIG. 39.
Figure 41:
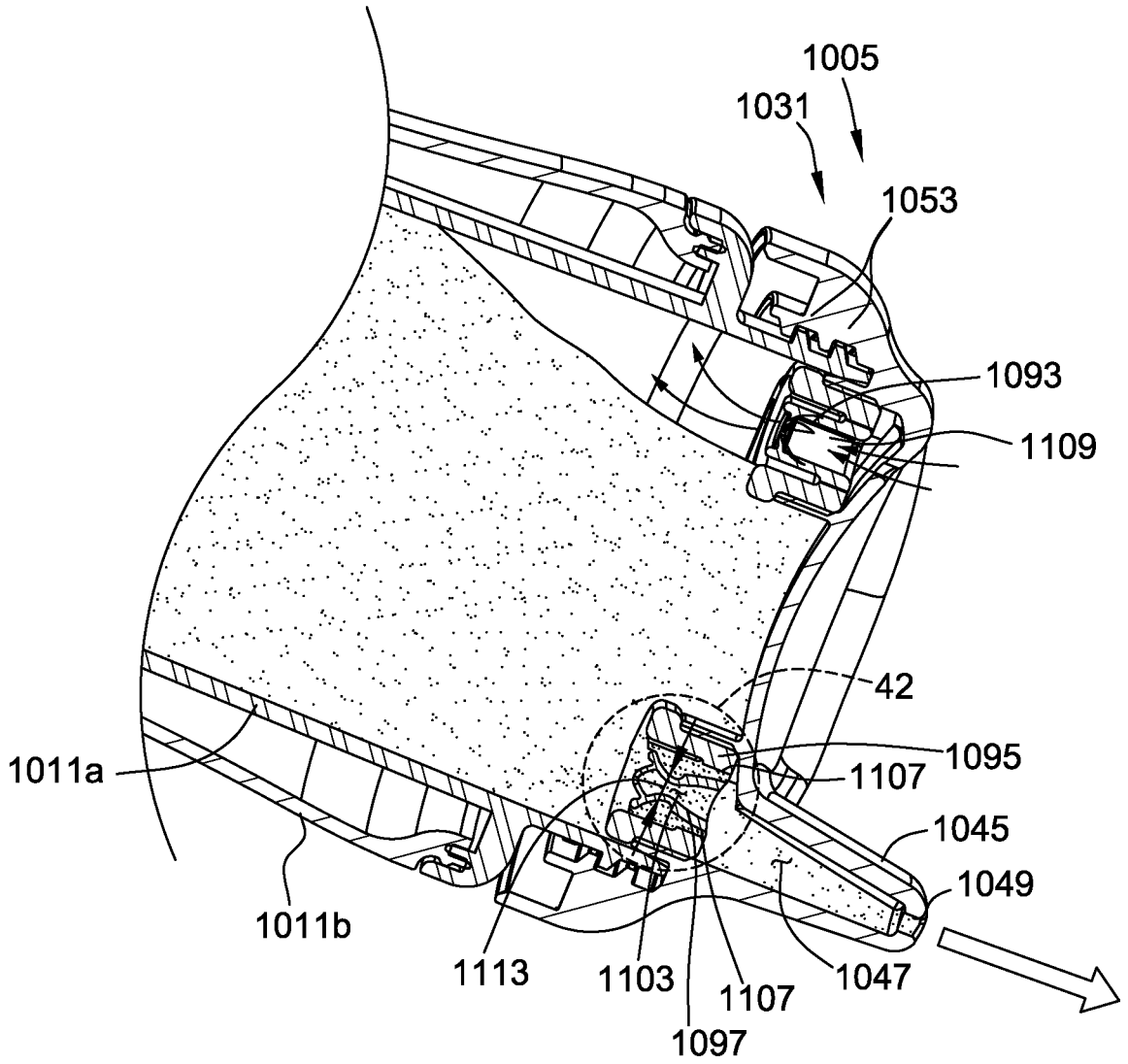
FIG. 41 is a fragmented, enlarged vertical cross-section similar to FIG. 39 but showing the valve assembly in an opened, unsealed configuration thereby allowing liquid to exit the cup.
Figure 42:
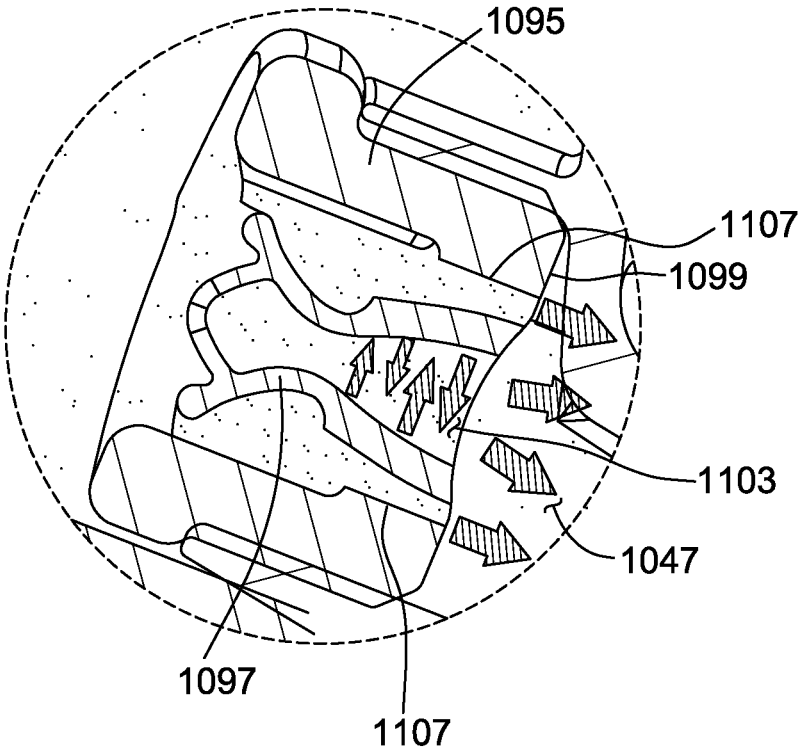
FIG. 42 is an enlarged fragmentary view of the cross-section illustrated in FIG. 41 taken from area "42" of FIG. 41.
Figure 43:
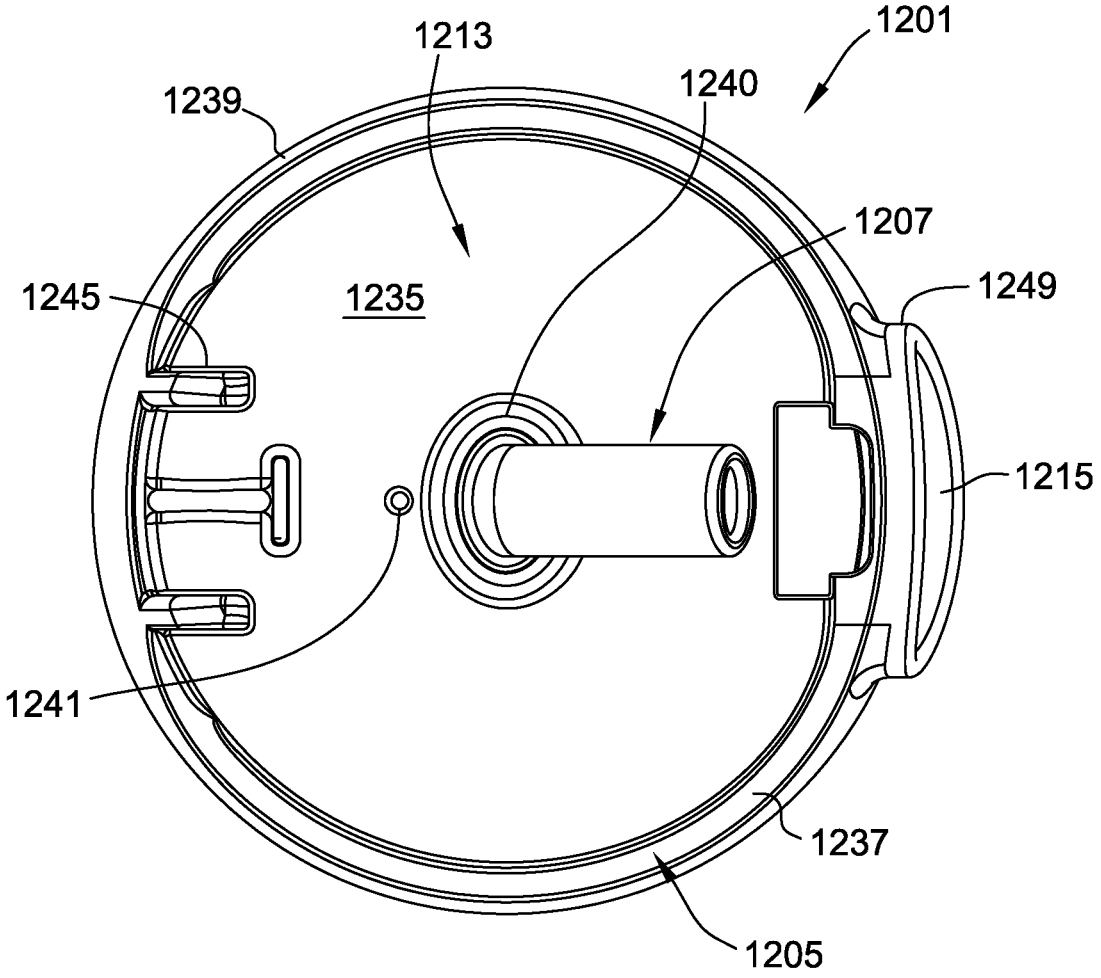
FIG. 43 is a top view of another suitable embodiment of a leak resistant drinking cup of the present disclosure in the form of a straw cup having a container and a lid assembly coupled to the container, with the straw cup of FIG. 43 illustrated with a cover of the lid assembly removed.
Figure 44:
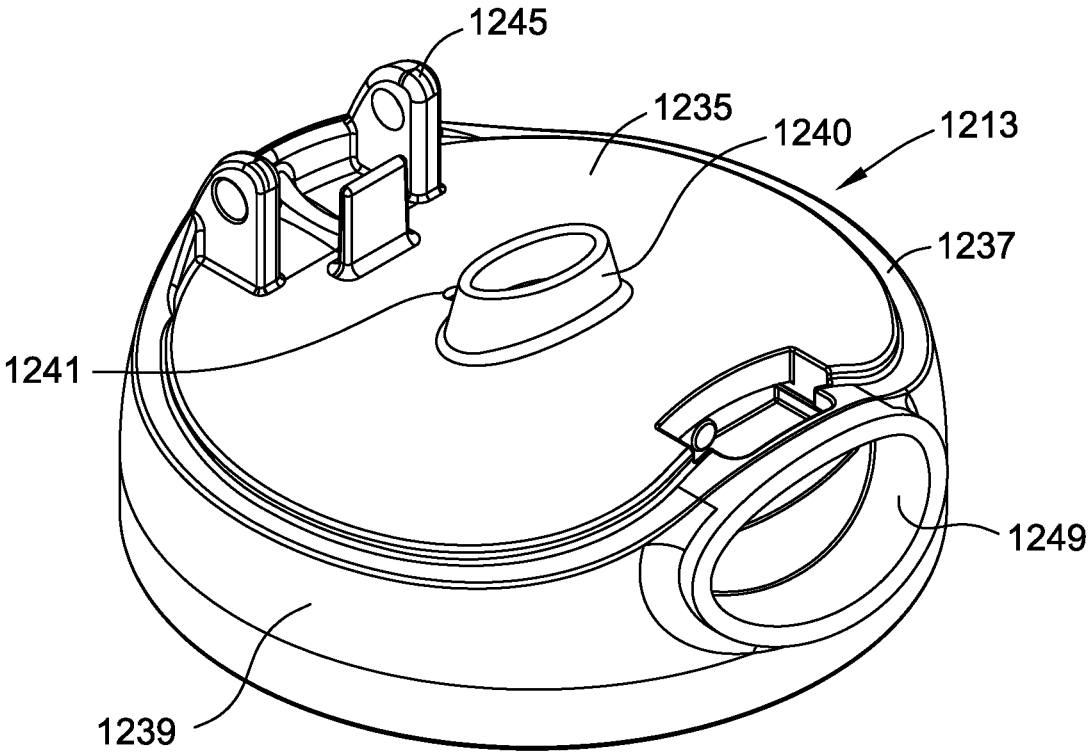
FIG. 44 is a perspective of a closure member of the lid assembly.
Figure 45:
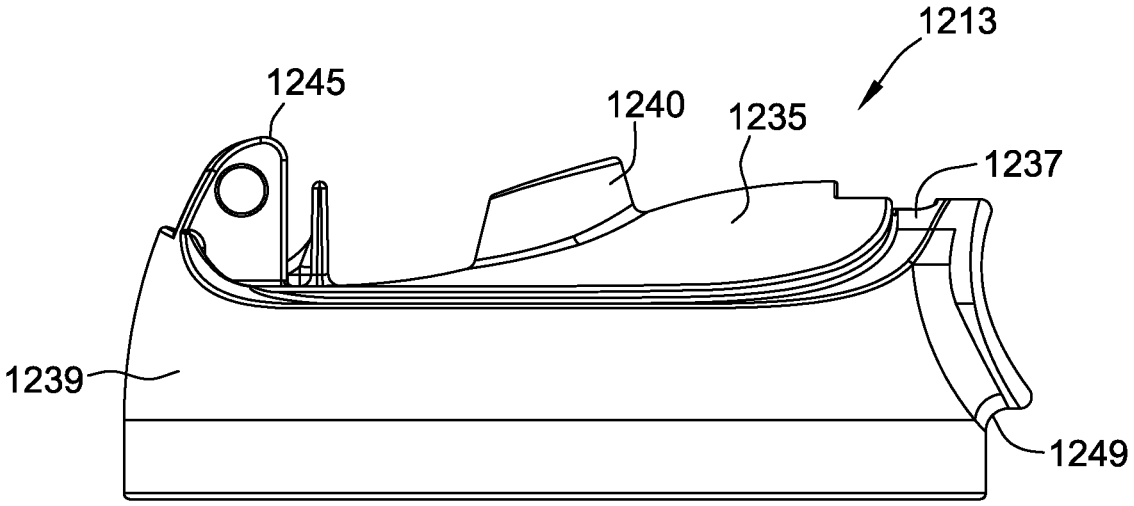
FIG. 45 is a side elevation of the closure member.
Figure 46:
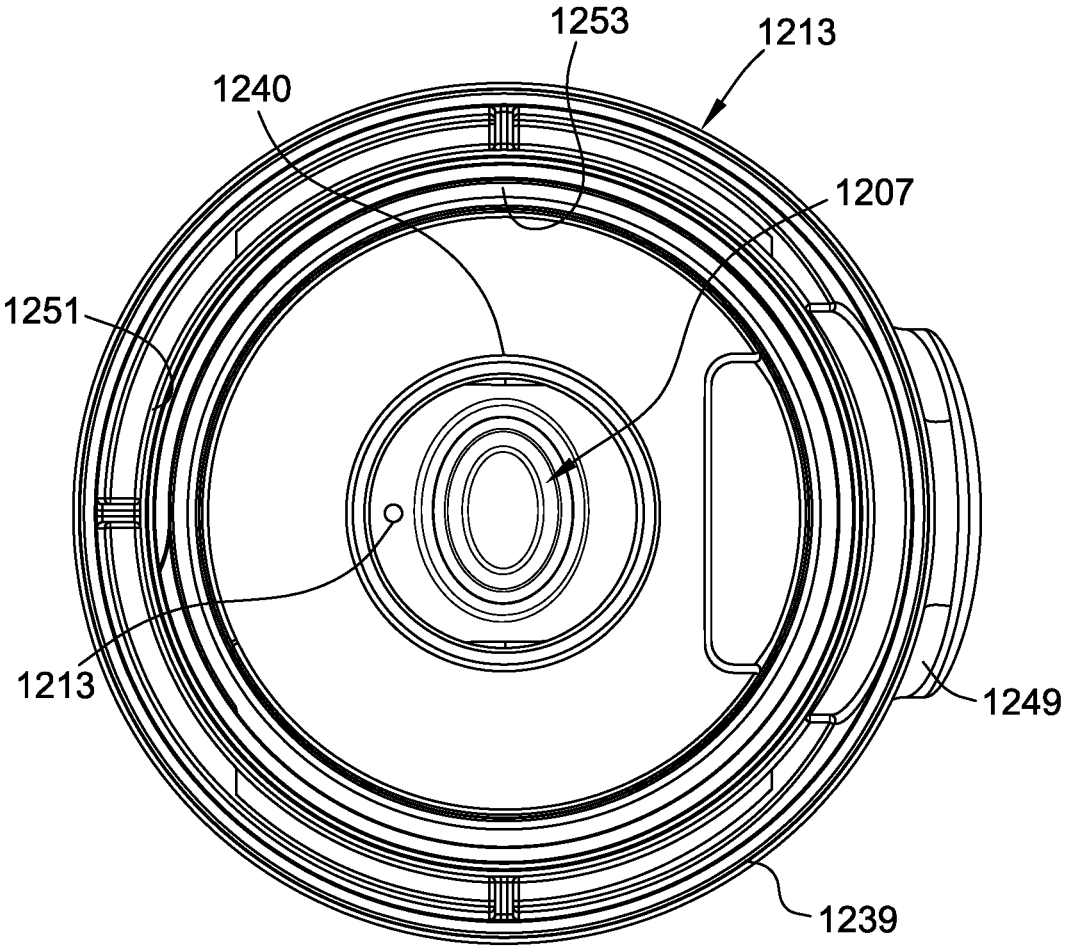
FIG. 46 is a bottom view of the lid assembly without the straw assembly attached thereto.
Figure 47:
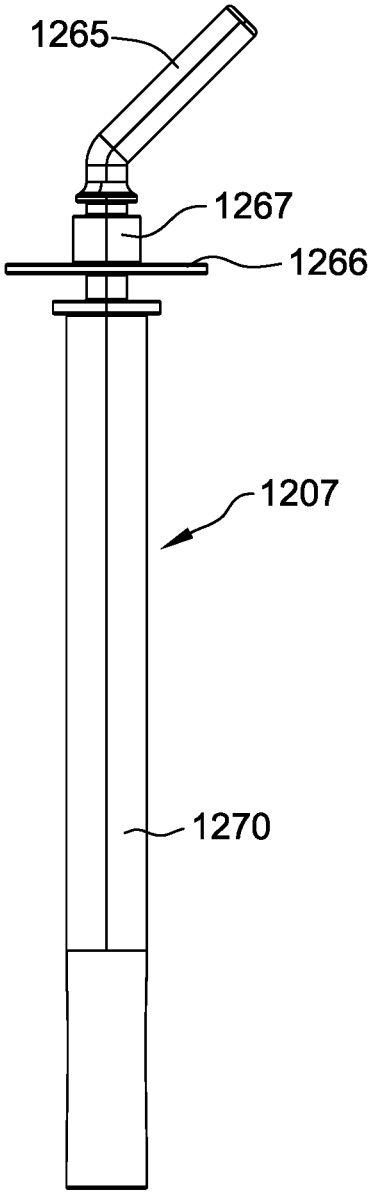
FIG. 47 is a side elevation of the straw assembly removed from the straw cup.
Figure 48:
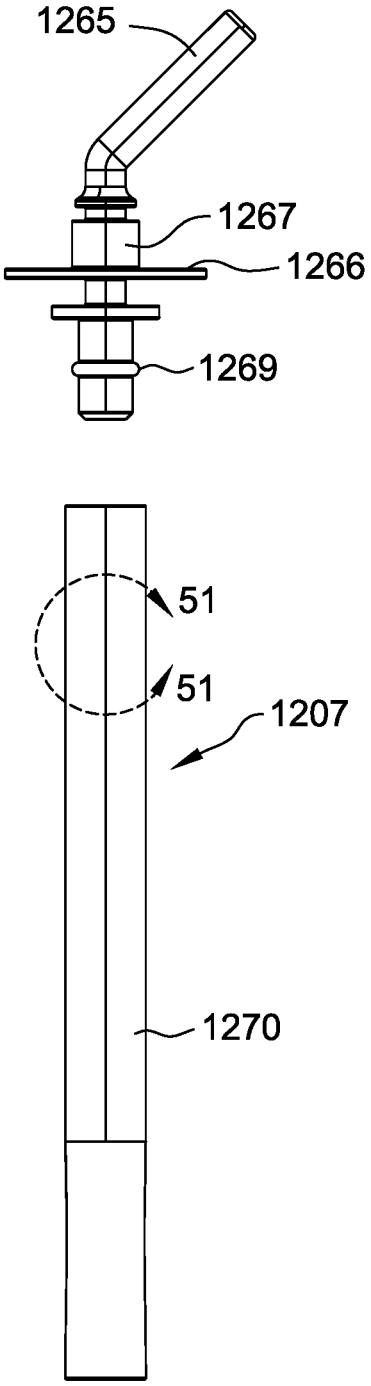
FIG. 48 is an exploded side view of the straw assembly.

Referring now to FIGS. 39 and 41, it is relatively easy for a small child (and more generally "a user") to get a drink out of the drinking cup 1001 by placing her lips around the spout 1045 so as to form a seal with the spout, tilting the cup so that liquid in the container 1003 flows into contact with the second elliptical tubular plug 1065, and sucking on the spout. It is understood, however, that liquid would flow into contact with the first elliptical tubular plug 1063 if the valve assembly 1033 was orientated in the opposite orientation such that the first elliptical tubular plug was received in the second elliptical socket 1057. Sucking on the spout 1045 removes air from the suction chamber 1111 through the opening 1049 in the spout and thereby applies vacuum pressure to the inner wall 1097 of the second elliptical tubular plug 1065 as oriented in FIGS. 39 and 41. Upon a threshold vacuum being applied to the inner wall 1097, the inner wall flexes inward, which moves the valve assembly 1033 from a sealed, closed configuration (FIGS. 28, 29, 39 and 40), which inhibits liquid from passing through the slits 1107 in the web 1099, to an unsealed, opened configuration, which allows liquid to pass through the slits (FIGS. 41 and 42). FIG. 29 is an enlarged fragmentary view of the cross-section illustrated in FIG. 28 wherein the valve assembly 1033 is in the sealed, closed configuration and not being acted upon in any manner. In other words, the valve assembly 1033 is in its initial, rest state. As seen therein, neither the outer wall 1095 nor the inner wall 1097 of the second elliptical tubular plug 1065 are deformed in any way. FIG. 40 is an enlarged fragmentary view of the cross-section illustrated in FIG. 39 wherein the valve assembly 1033 is in the sealed, closed configuration but with liquid acting on the exterior surface of the inner wall 1097 of the second elliptical tubular plug 1065 as indicated by arrows. As seen therein, the inner wall 1097 is deformed (e.g., bowed slightly inward between the web 1099 and the bottom 1105) by liquid acting on the exterior surface thereof. The inner wall 1097 can be similarly deformed by the container 1003 containing a warm liquid and/or a carbonated liquid.

Vacuum pressure applied by the user to the second elliptical tubular plug 1065 at or below (i.e., greater vacuum) the threshold vacuum causes at least a portion of the second elliptical tubular plug to flex inward toward the major axis A1 of the second elliptical tubular plug. More specifically and as illustrated in FIGS. 41 and 42, vacuum pressure acting on the interior surface of the inner wall 1097 causes the inner wall to flex inward toward the major axis A1 of the second elliptical tubular plug as indicated by arrows in FIG. 42. Once the inner wall 1097 is flexed (or otherwise moved or deformed) a sufficient amount, the slits 1107 in the web 1099 are altered to define a pathway therethough and allow liquid to pass the valve assembly 1033 as also indicated by arrows in FIG. 42. Thus, the user applying vacuum to the spout 1045 at or above the threshold vacuum permits liquid to flow past the valve assembly 1033 through the slits 1107 and into the passageway 1047 of the spout 1045. Once in the passageway 1047, the liquid flows out through the opening 49 and into the user's mouth for drinking.

The amount of vacuum pressure (applied by the user sucking on the spout 1045) needed to configure the valve assembly 1033 from its sealed (or closed) configuration to its unsealed (or opened) configuration is determined by the orientation of the valve assembly relative to the closure member 1031 and can be predetermined by varying the surface area of the interior surface of the inner wall 1083 of the first elliptical tubular plug 1063 or the surface area of the interior surface of the inner wall 1097 of the second elliptical tubular plug 1065. Suitably, the amount of vacuum pressure needed to move the valve assembly 1033 between its sealed and unsealed position is less than 5 inches of mercury. In one suitable embodiment, the amount of vacuum pressure needed to move the valve assembly 1033 between its sealed and unsealed position is between 2 inches of mercury and 5 inches of mercury. In the illustrated embodiment, for example, the amount of vacuum pressure needed to move the valve assembly 1033 between its sealed and unsealed position is about 3 inches of mercury.

Once the user stops applying a vacuum pressure to the spout 1045, the resiliency (or elasticity) of the valve assembly 1033 causes the valve assembly to move from the unsealed position back to the sealed position. More specifically and relative to the orientation illustrated in FIGS. 39 and 41, terminating the vacuum pressure applied to the interior surface of the inner wall 1097 of the second elliptical tubular plug 1065 results in the inner wall moving away from the major axis A1 of the second elliptical tubular plug and toward its prior position (shown in FIGS. 39 and 40). As the inner wall 1097 moves back to its rest position, the slits 1107 in the web 1099 are altered to close the pathway therethough and inhibit liquid from passing the valve assembly 1033. Thus, the user by stopping to apply vacuum to the spout 1045 at or above the threshold vacuum causes the valve assembly 1033 to return to its closed, sealed position and inhibits liquid from flowing past the valve assembly 1033 through the slits 1107 and into the passageway 1047 of the spout 1045.

As liquid is drawn out of the container 1003 by the child, the pressure within the liquid chamber of the container is reduced. Upon reaching a threshold vacuum pressure within the liquid chamber of the container 1003, the vent slit 1093 in the bottom 1091 of the first elliptical tubular plug 1063 opens allowing ambient air to pass through the aperture 1041 in the closure member 1031 and enter into the vent chamber 1109 (see, e.g., FIG. 41). From the vent chamber 1109, the ambient air passes through the vent slit 1093 and into the interior space of the container 1003 to bring the pressure within the liquid chamber to or approximately to ambient. Once the vacuum pressure within the liquid chamber of the container 1003 returns approximately to ambient, the vent slit 1093 in the inner wall 1083 of the circular tubular plug 1063 return to a sealed position inhibiting air from flowing into the chamber. It is understood that if the valve assembly 1033 was in the opposite orientation, the vent slit 1101 in the bottom 1105 of the second elliptical tubular plug 1065 would open in response to reaching a threshold vacuum pressure within the liquid chamber of the container 1003 and would close once the vacuum pressure within the liquid chamber of the container returned approximately to ambient.

FIGS. 43-52 illustrate another embodiment of a leak resistant drinking cup 1201 in the form of a straw cup similar to the straw cup of the embodiment of FIGS. 21-23. Like components are indicated with reference numbers "1*xxx*" with the "xxx" being the corresponding reference number from the embodiment of FIGS. 21-23. In this embodiment and as illustrated particularly in FIGS. 49-51, at least a portion of the valve assembly, indicated generally at 1280, is integrally formed within the straw extension 1270. More specifically, an elliptical tubular plug 1281 (substantially similar to the second elliptical tubular plug 1065 described above) is integrally formed with and located along the length of the straw extension 1270. In other words, the elliptical tubular plug 1281 is formed as a single piece with the straw extension 1270.

Figure 49:
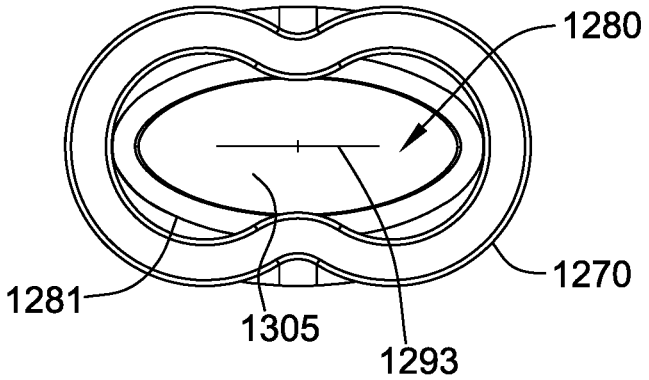
FIG. 49 is a bottom view of a straw extension of the straw assembly.
Figure 50:
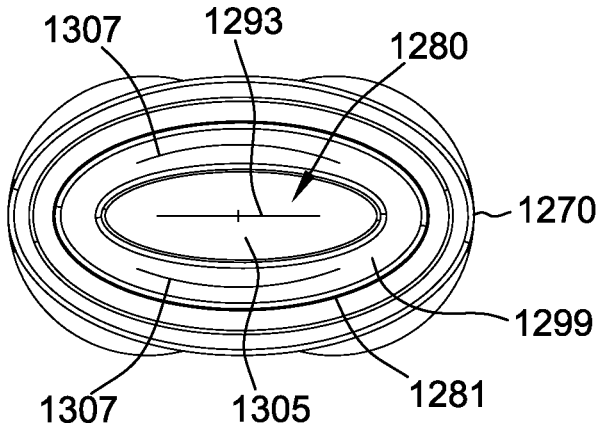
FIG. 50 is a top view of the straw extension.
Figure 51:
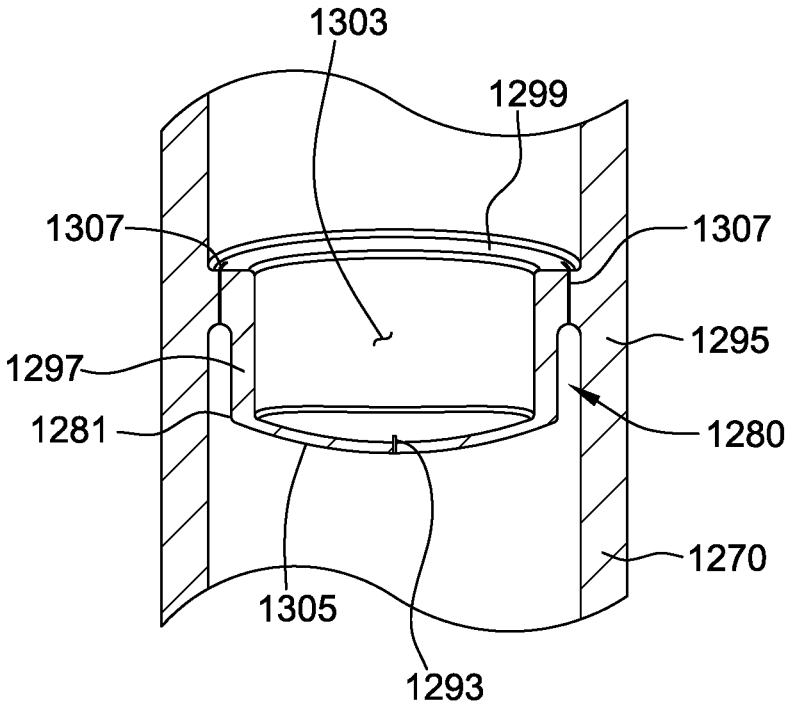
FIG. 51 is an enlarged fragmentary, cross-section taken from area "51" of FIG. 48.
Figure 52:
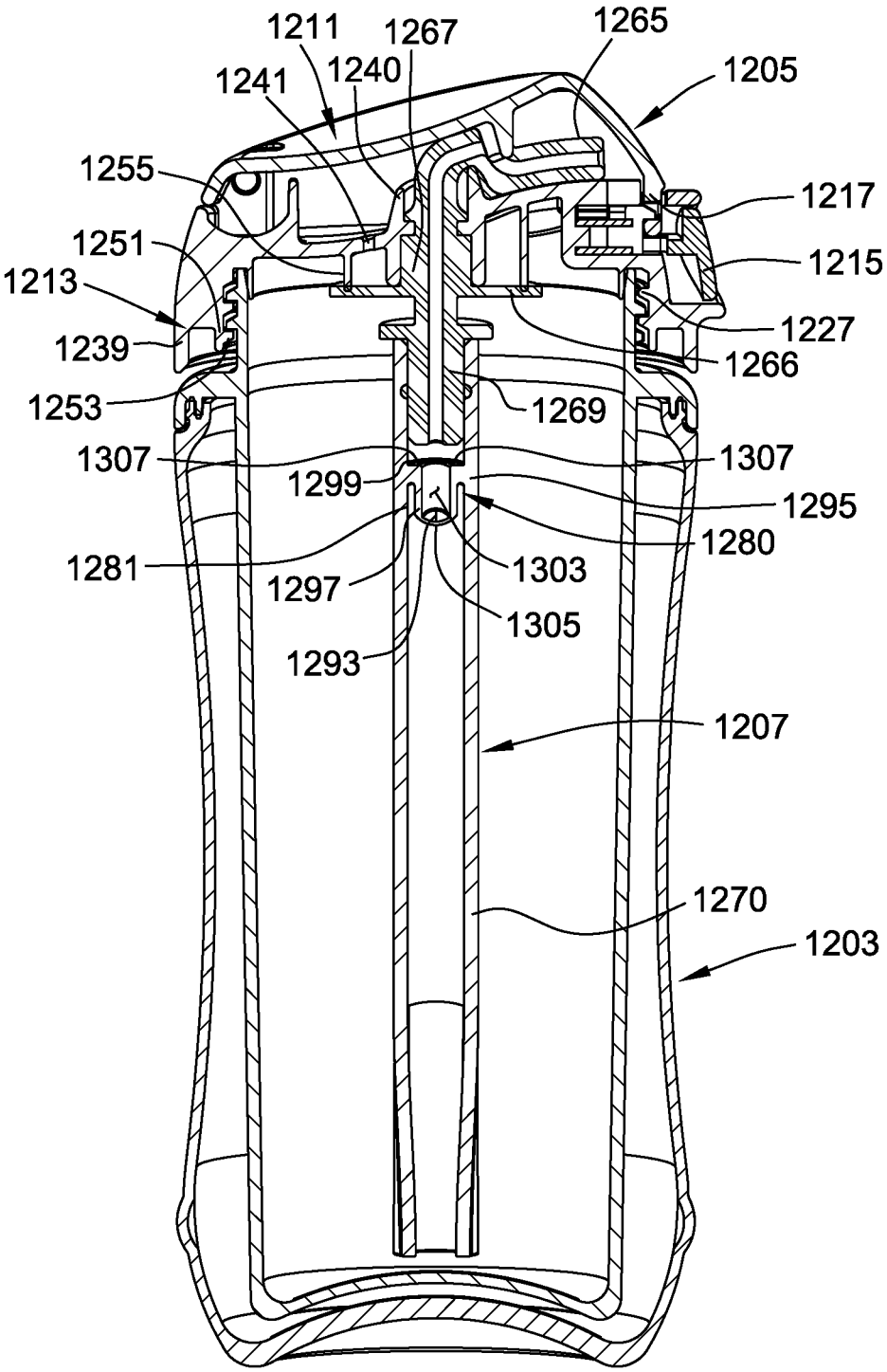
FIG. 52 is a vertical cross-section of the straw cup.
Figure 53:
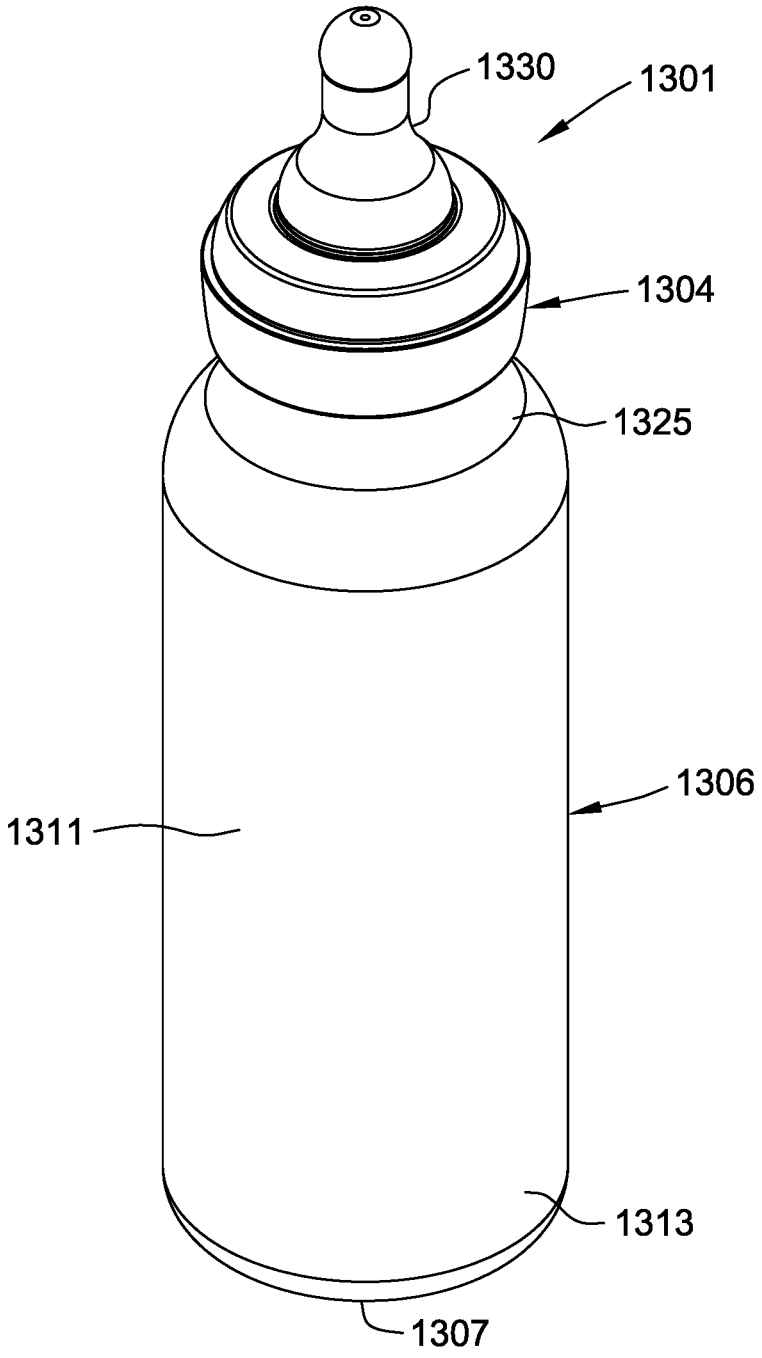
FIG. 53 is a perspective of yet another suitable embodiment of a leak resistant drinking cup of the present disclosure in the form of an infant bottle.

The elliptical tubular plug 1281 of the valve assembly 1280 includes an outer wall 1295 (which also defines part of the wall of the straw extension), an inner wall 1297, and a web 1299 extending between and connecting the outer and inner walls. The inner wall 1297 defines a recess 1303 having a generally concave bottom 1305. As illustrated in FIGS. 49 and 50, the bottom 1305 of the valve assembly 1280 includes a cruciform vent slit 1293 defined by two intersecting elongate slits. One of the slits defining the vent slit 1293 is significantly longer than the other. It is understood that the vent slit 1293 can have any suitable configuration including being defined by a single elongate slit.

The web 1299, as seen in FIG. 50, is non-circular, and more suitably, generally racetrack-shaped (e.g., elliptical, ovate) and defines the upwardly facing surface of the elliptical tubular plug 1281. The web 1299 includes a pair of slits 1307 disposed in the web spaced intermediate the outer and inner walls 1295, 1297 and extend through the thickness of the web. In the illustrated embodiment, the slits 1307 are generally arcuate (e.g., nonlinear) and follow approximately the same curvature as the inner and outer walls 1295, 1297. It is contemplated that the web 1299 can have fewer slits 307 (i.e., a single slit) or more than two slits without departing from some aspects of this disclosure.

It is easy for a young child (or any other user) to get a drink out of the cup 1201 by placing her lips around the upper tubular portion 1265 of the straw assembly 1207 so as to form a seal with the straw assembly and sucking so that liquid in the container 1203 is drawn up through the straw extension 1270 and other parts of the straw assembly 1207, and into the child's mouth. Sucking on the straw assembly 1207 removes air therefrom and applies vacuum pressure to the inner wall 1297 of the elliptical tubular plug 1281. Upon a threshold vacuum being applied to the inner wall 1297, the inner wall flexes inward, which moves the valve assembly 1280 from a sealed, closed configuration (FIG. 52), which inhibits liquid from passing through the slits 1307 in the web 1299, to an unsealed, opened configuration, which allows liquid to pass through the slits (not shown but substantially similar to FIGS. 41 and 42). More specifically, vacuum pressure applied by the user to the elliptical tubular plug 1281 at or below (i.e., greater vacuum) the threshold vacuum causes at least a portion of the elliptical tubular plug 1281 to flex inward toward a major axis of the elliptical tubular plug. Once the inner wall 1297 is flexed (or otherwise moved or deformed) a sufficient amount, the slits 1307 in the web 1299 are altered to define a pathway therethough and allow liquid to pass the valve assembly 1280. Thus, the user applying vacuum to the straw assembly 1207 at or above the threshold vacuum permits liquid to flow past the valve assembly 1280 through the slits 1307 and into the user's mouth for drinking.

Once the user stops applying a vacuum pressure to the straw assembly, the resiliency of the valve assembly 1280 causes the valve assembly to move from the unsealed position back to the sealed position. More specifically, terminating the vacuum pressure applied to the inner wall 1297 of the elliptical tubular plug 1281 results in the inner wall moving away from the major axis of the elliptical tubular plug and toward its original, at rest position (shown in FIG. 51). As the inner wall 1297 moves back to its rest position, the slits 1307 in the web 1299 are altered to close pathway therethough and inhibit liquid from passing the valve assembly 1280. Thus, the user by stopping to apply vacuum at or above the threshold vacuum causes the valve assembly 1280 to return to its closed, sealed position.

As liquid is drawn out of the container 1203 by the child, the pressure within the liquid chamber of the container is reduced. Upon reaching a threshold vacuum pressure within the liquid chamber of the container 1203, the diaphragm 1266 of the straw assembly 1207 moves away from interior socket 1255 of the closure member 1213 thereby allowing ambient air to pass through the aperture 1241 in the closure member and into the liquid chamber of the container 1203 to bring the pressure within the liquid chamber to or approximately to ambient. Once the vacuum pressure within the liquid chamber of the container 1203 returns approximately to ambient, the diaphragm 1266 of the straw assembly 1207 moves back into a sealed position with the interior socket 1255 of the closure member 1213.

FIGS. 53-59 illustrate another suitable embodiment of a leak resistant drinking cup of the present disclosure in the form of an infant nursing bottle, generally indicated at 1301. The infant bottle includes a container 1306, such as a bottle and more particularly a nursing bottle, and a collar (broadly, "a closure member"), generally indicated at 1304, for generally closing the bottle. The container 1306 is adapted to hold a quantity of liquid (e.g., milk) for consumption by a user, such as a nursing infant. The container 1306 can be made of any suitable material such as, without limitation, glass, polypropylene or other plastic, aluminum, or stainless steel. The container 1306 can also be made in any desired color or colors, and can be transparent, translucent, or opaque.

Figure 54:
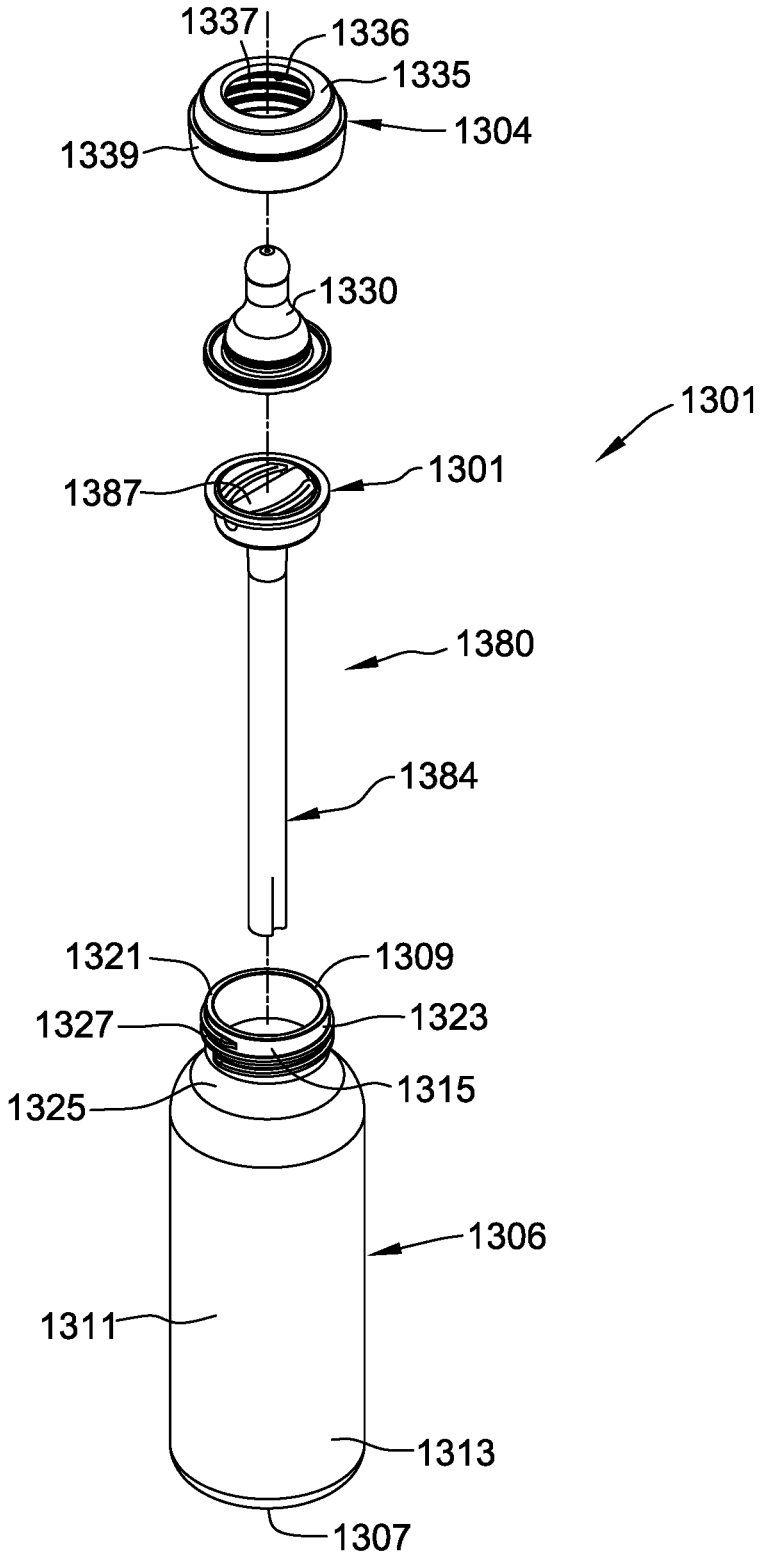
FIG. 54 is a perspective exploded view of the infant bottle.
Figure 55:
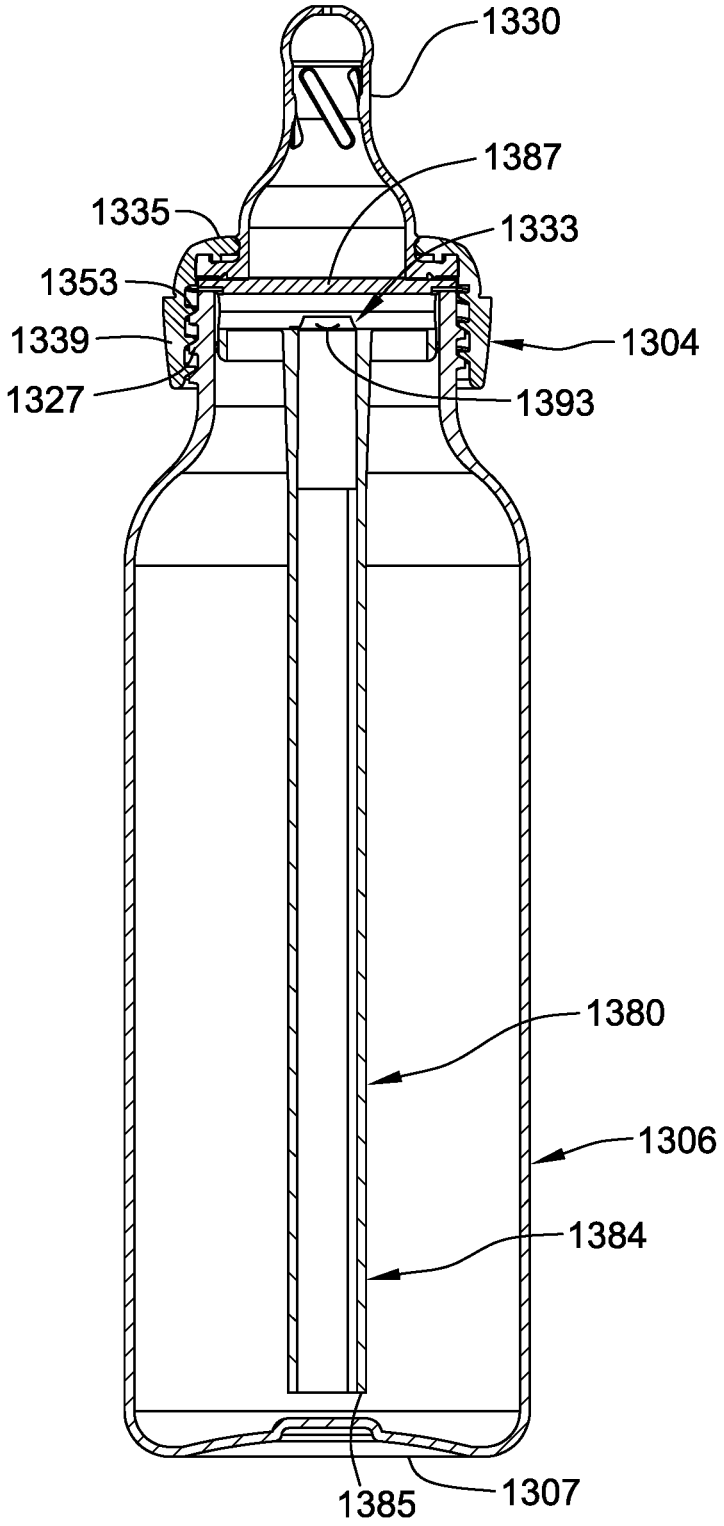
FIG. 55 is a vertical cross-section of the infant bottle.
Figure 56:
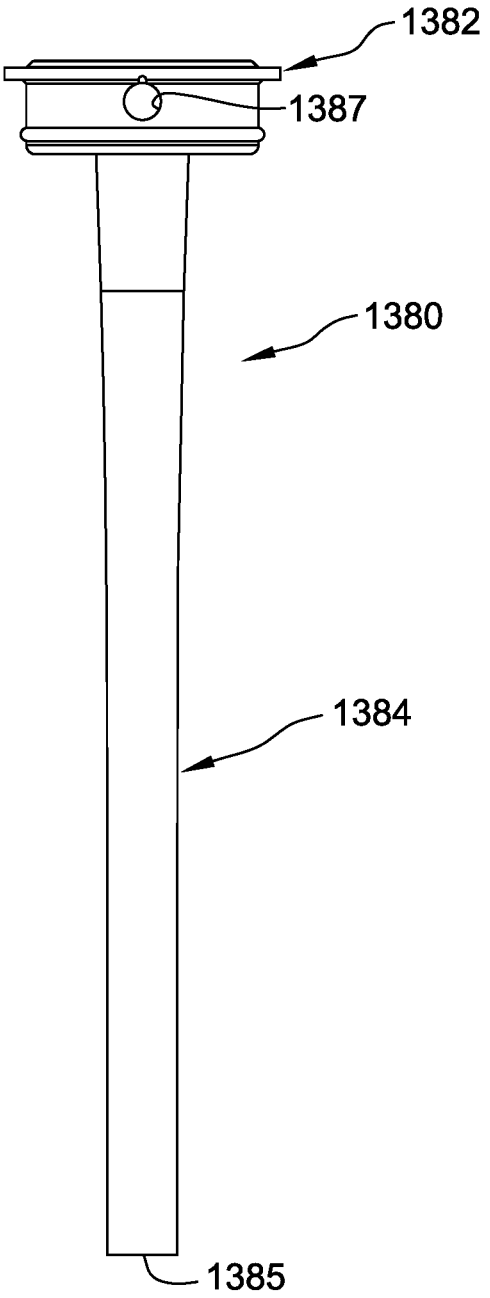
FIG. 56 is a side view of a vent assembly removed from the infant bottle.

As seen in FIG. 54, the container 1306 has a closed bottom 1307, an open top 1309, and a generally cylindrical side wall 1311 extending between the closed bottom 1308 and the open top 1309. The cylindrical side wall 1311 includes a base portion 1313 and a top (or neck portion) 1315 that is narrowed with respect to the base portion 1313 (FIG. 55). That is, in the illustrated embodiment, the top portion 1315 has a smaller diameter than the base portion 1313. It is understood, however, that in other suitable embodiments the top portion 1315 may only be slightly smaller in diameter than the diameter of the base portion 1313, or even the same diameter as the base portion, without departing from some aspects of this disclosure. The top portion 1315 includes a circular upper edge 1321, an attachment collar 1323 disposed beneath and adjacent to the upper edge, and a shoulder 1325 disposed below the attachment collar. The attachment collar 1323 as seen in FIG. 54 has external threads 1327 thereon.

The collar 1304 of the bottle 1301 is adapted for removable attachment to the container 1306 for selectively holding a nipple 1330 on the container. The collar 1304 and the nipple 1330 can be made of any suitable material. In one embodiment, for example, the nipple 1330 can be made of a substantially pliable material such as at least one of a rubber material, a silicone material, and a latex material, and the collar 1304 can be made of polypropylene. The nipple 1330 and the collar 1304 can be made in any desired color or colors, and may be transparent, translucent, or opaque.

As seen in FIGS. 54 and 55, the illustrated collar 1304 has an annular top panel 1335 defining a central opening 1336 and a depending side wall (or skirt) 1339. As seen in FIG. 55, the nipple 1330 can be selectively pulled (or otherwise inserted) through the central opening 1336 in the top panel 1335 of the collar 1304. It is understood, however, that the nipple 1330 and the collar 1304 may be configured other than as described and illustrated herein. The side wall 1339 of the collar 1304 has internal threads 1353 for threaded engagement with the external threads 1327 of the container 1306 to releasably secure the collar and hence the nipple 1330 on the container.

With reference to FIGS. 54-59, bottle 1301 also includes a vent assembly, indicated generally at 1380, to permit venting of the bottle 1301 during use. The vent assembly 1380 includes a vent insert, indicated general at 1382, and a vertical vent tube, indicated generally at 1384, extending downward from the vent insert. In the illustrated embodiment, the vertical vent tube 1384 is releasably attachable to the vent insert 1382, such as by friction fit. It is understood, however, that the vent insert 1382 and the vertical vent tube 1384 can be nonreasably attached or formed as a single piece. As seen in FIG. 55, the vertical vent tube 1384 includes an air outlet 1385 suitably arranged to be positioned adjacent the closed bottom 1308 of the container 1306.

The vent insert 1382 includes a horizontal vent tube 1387 in fluid communication with the vertical vent tube 1384 (FIG. 55). Disposed at the intersection of the vertical vent tube 1384 and horizontal vent tube 1387 is a portion of a valve assembly, indicated generally at 1333. More specifically and as illustrated in FIG. 55, the valve assembly 1333 includes a cruciform vent slit 1393 defined by two intersecting elongate slits that is positioned at the intersection of the vertical and horizontal tubes 1384, 1387. The vent slit 1393 can best be seen in FIG. 59.

Figure 57:
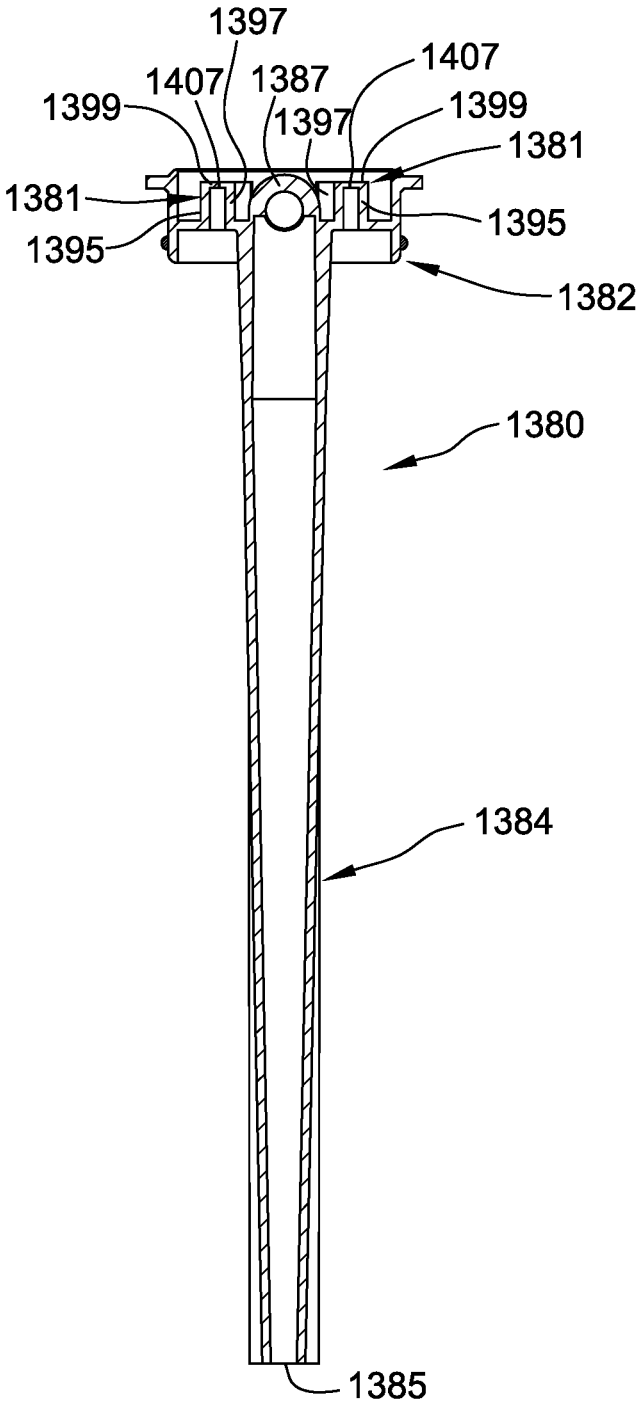
FIG. 57 is a vertical cross-section of the vent assembly.
Figure 58:
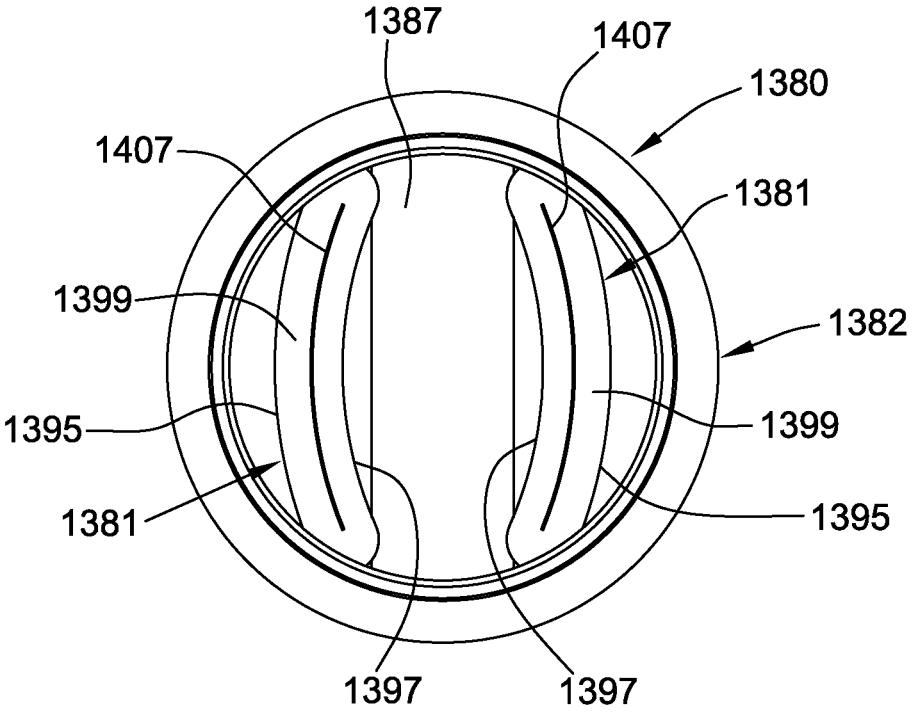
FIG. 58 is a top view of the vent assembly.
Figure 59:
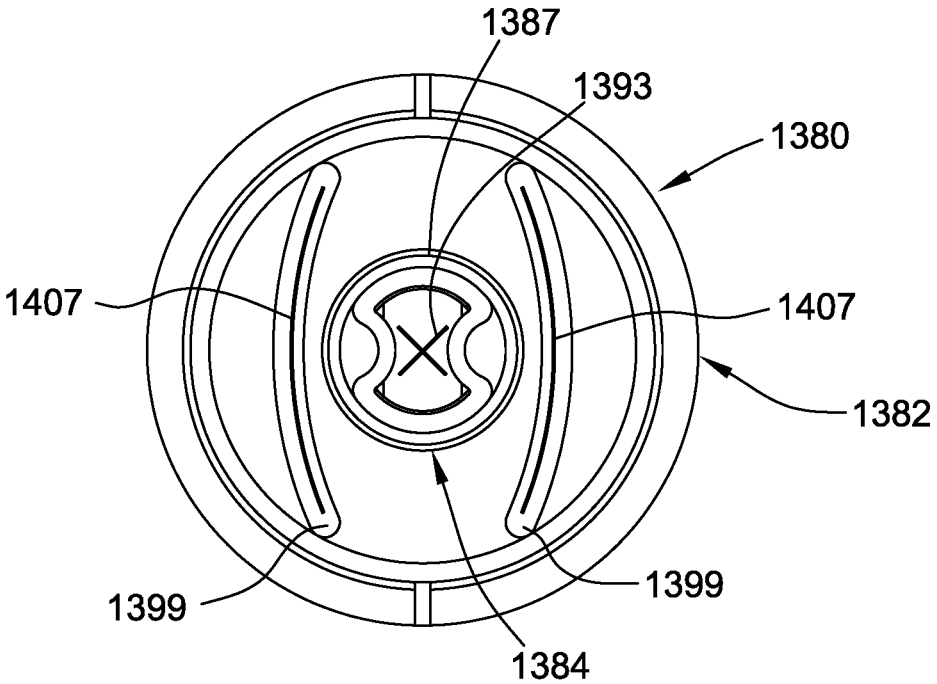
FIG. 59 is a bottom view of the vent assembly.

The valve assembly 1333 also includes a pair of sealing members 1381 integrally formed within the vent insert 1382. With reference now to FIGS. 57-59, each of the sealing members 1381 includes an outer wall 1395, an inner wall 1397, and a web 1399 extending between and connecting the outer and inner walls. Each of the sealing members 1381 is non-linear, and more suitably, generally arcuate. Each of the webs 1399, which define the upper facing surface of the sealing members 1381, includes a slit 1407 disposed in the web spaced intermediate the outer and inner walls 1395, 1397 and extend through the thickness of the web. In the illustrated embodiment, the slits 1407 are generally arcuate (e.g., nonlinear) and follow approximately the same curvature as the sealing members 1381.

It is easy for an infant to get a drink out of the bottle 1301 by placing her lips around the nipple 1330 so as to form a seal with the nipple, tilting the bottle 1301, and sucking so that liquid is drawn from the container 306 into the child's mouth. Sucking on the nipple 1330 removes air therefrom and applies vacuum pressure to the inner walls 1397 of each of the sealing members 1381. Upon a threshold vacuum being applied to the inner wall 1397, the inner wall flexes inward, which moves the valve assembly 1333 from a sealed, closed configuration (FIG. 55), which inhibits liquid from passing through the slits 1407 in the webs 1399, to an unsealed, opened configuration, which allows liquid to pass through the slits. More specifically, vacuum pressure applied by the user to the sealing members 1381 at or below (i.e., greater vacuum) the threshold vacuum causes at least a portion of each of the sealing members to flex inward. Once the inner wall 1397 is flexed (or otherwise moved or deformed) a sufficient amount, the slits 1407 in the web 1399 are altered to define a pathway therethough and allow liquid to pass the valve assembly 1333. Thus, the user applying vacuum to the nipple 1330 at or above the threshold vacuum permits liquid to flow past the valve assembly 1333 through the slits 1407 and into the user's mouth via the nipple 1330 for drinking.

Once the user stops applying a vacuum pressure to the nipple 1330, the resiliency of the valve assembly 1333 causes the valve assembly to move from the unsealed position back to the sealed position. More specifically, terminating the vacuum pressure applied to the inner wall 1397 of each of the sealing members 1381 results in the inner wall moving toward its original, at rest position (shown in FIG. 58). As the inner wall 1397 moves back to its rest position, the slits 1407 in the web 1399 are altered to close pathway therethough and inhibit liquid from passing the valve assembly 1333. Thus, the user by stopping to apply vacuum at or above the threshold vacuum causes the valve assembly 1333 to return to its closed, sealed position.

As liquid is drawn out of the container 1306 by the infant, the pressure within the liquid chamber of the container is reduced. Upon reaching a threshold vacuum pressure within the liquid chamber of the container 1306, the slit 1393 in the horizontal vent tube 1387 open thereby allowing ambient air to pass through the horizontal vent tube, passed the open slit, through the vertical vent tube 1384, and into the liquid chamber of the container 1306 to bring the pressure within the liquid chamber to or approximately to ambient. Once the vacuum pressure within the liquid chamber of the container 1306 returns approximately to ambient, the slits 1393 in the horizontal vent tube 1387 move back to their closed position.

When introducing elements of the present invention or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above without departing from the scope of the invention, it is intended that all matter contained in the above description and shown in the accompanying drawings shall be interpreted as illustrative and not in a limiting sense.

What is claimed is:

1. A valve assembly for a leak resistant drinking cup, the valve assembly comprising an elliptical tubular plug including an outer wall, an inner wall, and a web extending between and connecting the outer and inner walls, the web having at least one slit spaced from and disposed intermediate the inner and outer walls, the valve assembly being configurable between a sealed position wherein the slit is closed and liquid is inhibited from passing through the slit and an unsealed position wherein the inner wall flexes inward to open the slit and enable liquid to pass through the slit.

2. The valve assembly set forth in claim 1 wherein the tubular plug has a major axis and a minor axis, the maximum extent of the tubular plug along the major axis being greater than the maximum extent of the tubular plug along the minor axis.

3. The valve assembly set forth in claim 2, wherein the slit extends through the minor axis and is spaced from the major axis.

4. The valve assembly set forth in claim 2, wherein the inner wall is configured to flex inward toward the major axis.

5. The valve assembly set forth in claim 1 wherein the inner wall has a closed bottom and defines a recess.

6. The valve assembly set forth in claim 1 wherein the tubular plug defines a first tubular plug and the valve assembly comprises a second tubular plug spaced from the first tubular plug.

7. The valve assembly set forth in claim 1, wherein the inner wall has an exterior surface area and an interior surface area, the interior surface area being greater than the exterior surface area.

8. The valve assembly set forth in claim 7 wherein a ratio between the interior surface area and the exterior surface area of the inner wall is between 1 and 10.

9. The valve assembly set forth in claim 1 further comprising:

a platform; and a circular tubular plug extending upward from the platform, the circular tubular plug including an outer wall, an inner wall, and a web extending between and connecting the outer and inner walls, the inner wall having a concaved bottom, the concaved bottom having at least one vent slit therein, wherein the elliptical tubular plug is spaced from the circular tubular plug and extends upward from the platform, the inner wall having a closed bottom to define a recess, the web being moveable from the sealed position to the unsealed position by applying vacuum pressure to the inner wall.

10. The valve assembly set forth in claim 1, wherein the inner wall has a bottom with a vent slit disposed therein.

11. The valve assembly set forth in claim 10 wherein the tubular plug has a major axis and a minor axis, the major axis having a maximum extent greater than a maximum extent of the minor axis, a ratio between the maximum extent of the major axis and the maximum extent of the minor axis being greater than 1 and less than 10.

12. The valve assembly set forth in claim 10 wherein the inner wall has an interior height H1 that is defined by an interior surface of the inner wall, and an exterior height H2 that is defined by an exterior surface of the inner wall, the interior height H1 of the inner wall being greater than the exterior height H2 of the inner wall.

13. The valve assembly set forth in claim 10 in combination with a straw assembly, the valve assembly being disposed within the straw assembly.

14. The valve assembly set forth in claim 10 in combination with a vent assembly, the valve assembly being disposed within the vent assembly.

15. The valve assembly set forth in claim 1, wherein the elliptical tubular plug is a first tubular plug, the inner wall having a bottom and the bottom having a vent slit disposed therein, the valve assembly further comprising:

a second tubular plug including an outer wall, an inner wall, and a web extending between and connecting the outer and inner walls, the web having at least one slit disposed intermediate the inner and outer walls, the inner wall having a bottom and the bottom having a vent slit disposed therein, the valve assembly being configurable between a sealed position wherein liquid is inhibited from passing through the slit in the web and an unsealed position wherein liquid can pass through the slit in the web.

16. The valve assembly set forth in claim 15 wherein the first tubular plug is substantially the same as the second tubular plug.

17. A lid assembly for a leak resistant drinking cup, the lid assembly comprising:

the valve assembly set forth in claim 1; and a closure member having a liquid discharge opening and a socket circumscribing the liquid discharge opening, the socket being adapted to capture the elliptical tubular plug of the valve assembly.

18. The valve assembly set forth in claim 1, wherein the outer wall, the inner wall, and the slit are arcuate when the valve assembly is in the closed position.

* * * * *